US010214879B2

(12) United States Patent
Perez Soria et al.

(10) Patent No.: US 10,214,879 B2
(45) Date of Patent: Feb. 26, 2019

(54) TOOTH AND ADAPTOR FOR ATTACHMENT OF THE TOOTH TO A WORKING MACHINE

(71) Applicant: METALOGENIA RESEARCH & TECHNOLOGIES S.L., Premia de Mar (ES)

(72) Inventors: Francisco Perez Soria, Premia de Mar (ES); Fermin Sanchez Guisado, Premia de Mar (ES); Javier Rol Corredor, St. Adria del Besos (ES); Jorge Triginer Boixeda, Barcelona (ES)

(73) Assignee: METALOGENIA RESEARCH & TECHNOLOGIES S.L., Premià de Mar (ES)

( * ) Notice: Subject to any disclaimer, the term of this patent is extended or adjusted under 35 U.S.C. 154(b) by 175 days.

(21) Appl. No.: 15/307,470

(22) PCT Filed: Apr. 29, 2014

(86) PCT No.: PCT/EP2014/058694
§ 371 (c)(1),
(2) Date: Oct. 28, 2016

(87) PCT Pub. No.: WO2015/165504
PCT Pub. Date: Nov. 5, 2015

(65) Prior Publication Data

US 2017/0051475 A1 Feb. 23, 2017

(51) Int. Cl.
*E02F 9/28* (2006.01)

(52) U.S. Cl.
CPC ..... *E02F 9/2816* (2013.01); *E02F 9/2808* (2013.01); *E02F 9/2825* (2013.01); *E02F 9/2833* (2013.01); *E02F 9/2858* (2013.01)

(58) Field of Classification Search
CPC ..... E02F 9/2808; E02F 9/2816; E02F 9/2825; E02F 9/2858
See application file for complete search history.

(56) References Cited

U.S. PATENT DOCUMENTS 2,689,419 A 9/1954 Daniels et al.
3,675,350 A 7/1972 Mulcahy et al.
(Continued)

FOREIGN PATENT DOCUMENTS

WO 2013/083812 A1 6/2013

OTHER PUBLICATIONS

International Search Report of PCT/EP2014/058694, dated Jan. 23, 2015. [PCT/ISA/210].
(Continued)

*Primary Examiner* — Matthew D. Troutman
(74) *Attorney, Agent, or Firm* — Sughrue Mion, PLLC

(57) ABSTRACT

The present disclosure relates to a tooth (1) for attachment to the lip of a bucket of a working machine, such as an excavator or loader, via an adaptor, the tooth (1) comprising a cavity (103) for receiving a portion of said adaptor, the cavity (103) extending between said first and second opposed outer working surfaces (12, 14) from an open end (104), at said attachment end of the tooth, to a bottom end (105); the cavity (103) being delimited by an inner wall (102); said inner wall (102) comprising first and second internally facing inner walls (106, 107), being the internal surfaces associated with said first outer working surface and said second working outer surface (12,14), respectively, and opposing side walls (108), interconnecting said first and second inner walls (106, 107), the cavity defining a back portion (BP) extending along the Y axis, the back portion being at least partially located between the plane spanned by the X and Z axis and the open end (104) of the cavity, a front portion (FP) extending along the Y axis, the
(Continued)

front portion being located between the plane spanned by the X and Z axes and the bottom end (105) of the cavity; and a stepped portion (SP), interconnecting the back portion and the front portion; in the back portion, the first and second inner walls (106, 107), each comprises a pair of essentially planar back contact surfaces (130*a, b;* 140*a,b*), being separated by a back divider region (132, 142), extending beyond the pair of first contact surfaces. The disclosure also relates to an adaptor, and to the coupling between a tooth and an adaptor.

26 Claims, 17 Drawing Sheets

(56) References Cited

U.S. PATENT DOCUMENTS

| | | | | |
|---|---|---|---|---|
| 5,709,043 | A | 1/1998 | Jones et al. | |
| 8,429,838 | B2 * | 4/2013 | Ruvang | E02F 9/2825 37/452 |
| 9,290,915 | B2 * | 3/2016 | Marchand | E02F 9/2825 |
| 9,534,357 | B2 * | 1/2017 | Haslett | E02F 9/2833 |
| 2010/0236108 | A1 | 9/2010 | Ruvang | |
| 2011/0030247 | A1 * | 2/2011 | Ruvang | E02F 9/2825 37/455 |
| 2012/0304505 | A1 * | 12/2012 | Ruvang | E02F 9/2825 37/452 |
| 2014/0223786 | A1 * | 8/2014 | Rol Corredor | E02F 9/2841 37/459 |
| 2016/0002893 | A1 * | 1/2016 | Haslett | E02F 9/2833 37/453 |
| 2017/0051475 | A1 * | 2/2017 | Perez Soria | E02F 9/2825 |

OTHER PUBLICATIONS

Written Opinion of PCT/EP2014/058694, dated Jan. 23, 2015. [PCT/ISA/237].

* cited by examiner

TOOTH AND ADAPTOR FOR ATTACHMENT OF THE TOOTH TO A WORKING MACHINE

CROSS REFERENCE TO RELATED APPLICATIONS

This application is a National Stage of International Application No. PCT/EP2014/058694 filed Apr. 29, 2014, claiming priority based on European Patent Application No. 14382157.7 filed Apr. 28, 2014, the contents of all of which are incorporated herein by reference in their entirety.

FIELD OF INVENTION

The present invention relates to a tooth for attachment to the lip of a bucket of a working machine, such as an excavator or a loader, via an adaptor. The invention also relates to an adaptor for attaching the tooth to the lip of a bucket of a working machine.

BACKGROUND OF THE INVENTION

Working machines such as excavators and loaders having buckets or trenchers for digging or shoveling e.g. earth or stone debris, are commonly provided with one or more teeth, secured to the bucket via an adaptor. The teeth constitute wear parts which are removable from the adaptors so as to enable replacement of worn out teeth with new ones.

To perform digging or shoveling operations, the teeth should be able to penetrate into material such as earth or mud. To this end, the teeth may have an elongated outer shape, and narrowing from an attachment portion adjacent the adaptor (towards the bucket) to a relatively thin tip portion. Hence, at least towards the tip of the tooth, the tooth will assume a tooth-shaped appearance, having two major surfaces converging towards and meeting at the tip of the tooth.

To acquire the desired penetration capacity, the outer shape of the teeth should therefore exhibit a sufficient length and a suitable slimness.

In use, the teeth will be subject to considerable loads and generally to a rough environment. Therefore, the teeth must be strong and robust enough to resist breaking.

Moreover, there is a general requirement that the teeth, being replacement parts, must be available to a reasonable price. This raises a desire to reduce the amount of material used for the tooth. The requirements for an outer shape providing sufficient penetration, the requirements for strength and robustness of the teeth, and the desire to reduce the amount of material are diverging. Hence, it is a challenge to find a successful compromise between the requirements. To this end, a large variety of teeth with different designs have been proposed in the past.

The tooth and the adaptor must include corresponding features for enabling the coupling of the tooth to the adaptor. Such corresponding features are hereinafter referred to as a "coupling". Such a coupling should enable secure and fixed attachment of the tooth to the adaptor, and should have sufficient strength and robustness so as to resist the forces involved when the tooth is in use.

Moreover, the coupling should desirably allow removal of a worn out tooth from an adaptor, and enable attachment of a new tooth to the same adaptor.

In summary, it is desired that a coupling between a tooth and an adaptor shall fulfil several different requirements.

The need for a well-functioning coupling must be met taking also the general requirements of the tooth as a whole into account, such as those mentioned in the above.

To achieve a suitable coupling between a tooth and an adaptor, it is known to provide the tooth with a cavity extending from an attachment end of the tooth, and to provide the adaptor with a nose portion corresponding to the cavity, such that the tooth may be installed over the adaptor with the nose portion arranged inside the cavity. To secure the tooth to the adaptor, it is known to use an attachment pin, extending through aligned through holes in the cavity of the tooth and through corresponding through holes in the nose portion of the adaptor.

The adapters can be fixed to the blade in different ways, such as welded, they can be part of the blade as a cast nose or the can be mechanically attached. For instance, in mining, three part systems are used wherein the nose portion of the adapter forms part of the blade of the bucket, being a cast nose.

In couplings using an attachment pin, it is desirable to reduce the risk of breakage of the attachment pin when the tooth, in use, is subject to considerable loads.

Another issue with such couplings is that, even if the attachment pin does not break when the tooth is in use, the pin might be deformed. A deformed pin may be very difficult to remove from the through holes of the tooth and the adaptor, and therefore the removal of a worn out tooth from the adaptor may be complicated. Often, in this situation, the pin must be hammered out of the through holes.

This procedure is highly undesired, and to remove the inconvenience thereof, so called hammer-less couplings have been proposed.

In view of the above, it is generally desired to enable a coupling of the type having a cavity and a corresponding nose portion, through which an attachment pin may extend, and which ensures easy application and removal of the attachment pin, preferably by a hammer-less maneuver.

US 2010 0236108 describes an excavator tooth for attachment to a nose (adaptor) via a fastener extending through at least one of the side walls of the tooth. The excavator tooth include side walls having essentially planar nose-engaging interface surfaces formed therein, one surface resisting rotation of the tooth about the longitudinal axis in one direction, and another interface surface resisting rotation of the tooth in an opposite direction.

U.S. Pat. No. 5,709,043 descries an excavating tooth exhibiting bearing faces which are formed to widen significantly as they extend rearward, to provide broad bearing surfaces at the rear ends of the wear member. The bearing faces are placed at obtuse angles to converging walls and to side walls, so as to avoid areas of stress concentration.

A first object of the invention is to provide a tooth which enables coupling of said tooth to the lip of a bucket of a working machine via an adaptor, and which presents an alternative to, or an advantage over prior solutions in respect of one or more of the aspects mentioned in the above.

A second object of the invention is to provide an adaptor which enables coupling of a tooth to the lip of a bucket of a working machine via said adaptor, and which presents an alternative to, or an advantage over prior solutions in respect of one or more of the aspects mentioned in the above.

SUMMARY

The above-mentioned objects are achieved by a tooth in accordance with the invention.

In a first aspect, the invention relates to a tooth for attachment to the lip of bucket of a working machine, such as an excavator or loader, via an adaptor, the tooth having an exterior surface comprising two externally opposed outer working surfaces, namely a first working surface and a second working surface, the working surfaces having a width in a horizontal direction, intended to extend along said lip of a bucket, and having a length extending between an attachment end and a tip of said tooth, the working surfaces extending along said length while converging in a vertical direction to be connected at said tip of the tooth. The tooth further comprises a cavity for receiving a portion of said adaptor, the cavity extending between said first and second opposed outer working surfaces from an open end at said attachment end of the tooth, to a bottom end; the cavity being delimited by an inner wall. The inner wall comprising first and second internally facing inner walls, being the internal surfaces associated with said first outer working surface and said second working outer surface, respectively, and opposing side walls, interconnecting said first and second inner walls. The opposing side walls delimits opposing through holes for receiving a pin extending through the cavity for attachment of the tooth to the adaptor portion, a first axis X being defined extending through the centres of the opposite through holes, a second axis Y extending along the cavity from the open end of the cavity towards the bottom end of the cavity, and a third axis Z being orthogonal to said first and second axes X, Y, the three axes X, Y, Z thereby forming an orthogonal axes system, meeting at an origo, whereby each point of the inner wall may be defined by Cartesian coordinates (x, y, z).

The cavity defines a back portion extending along the Y axis, the back portion being at least partially located between the plane spanned by the X and Z axes and the open end of the cavity, a front portion extending along the Y axis, the front portion being located between the plane spanned by the X and Z axes and the bottom end of the cavity; and a stepped portion, interconnecting the back portion and the front portion.

In the back portion, the first and second inner walls each comprises a pair of essentially planar back contact surfaces, each pair of back contact surfaces being symmetrical about, and facing away from, the plane spanned by the Z and Y axes, so as to form an angle (beta, gamma) with the plane spanned by the X and Y axes being less than 35 degrees, each pair of back contact surfaces being separated by a back divider region, extending beyond the pair of first contact surfaces in the Z direction away from the plane spanned by the X and Y axes.

In the front portion, the first and second inner wall each comprises a pair of essentially planar front contact surfaces, being symmetrical about the plane spanned by the Z and Y axes.

All contact surfaces forms an angle (alfa) less than 5 degrees with the Y axis, as seen in any plane parallel to the plane spanned by the Z and Y axes.

The first and/or second front contact surfaces being located closer to the plane spanned by the X and Y axes than the corresponding back contact surfaces, and the first and/or second inner wall of the stepped portion forming a slope wherein at least a portion of the inner wall approaches the XY plane towards the bottom wall, interconnecting said first and/or second back contact surfaces and the corresponding first and/or second front contact surface.

A first stepped distance along the Z axis is bridged by the first inner wall along the stepped portion, between the first back contact surfaces and the first front contact surfaces; and a second stepped distance along the Z axis is bridged by the second inner wall along the stepped portion, between the second back contact surfaces and the second front contact surfaces; wherein 0.80 D1<D2<=D1.

The above-mentioned features applied in the back portion of the cavity will convey several advantages to the proposed tooth.

First, the proposed back portion enables an advantageous force distribution in the coupling between the tooth and the adaptor.

When the tooth is connected to the adaptor, contact between the tooth and the adaptor is to occur at the pairs of first and second back contact surfaces, but not at the first and second back divider regions, separating the respective pairs of back contact surfaces. The first and second back divider regions of the inner wall of the cavity are hence portions of the inner wall of the tooth which are not intended to be in contact with the adaptor.

Accordingly, along the back portion, in the first inner wall and in the second inner wall, the contact between the tooth and the adaptor is to occur over two contact surfaces which are spaced along the X axis. This means that loads which will be distributed over the first inner wall or the second inner wall in the back portion are to be distributed between two separated planar contact surfaces, working in parallel. This will diminish the stress in the tooth material. The separation of contact surfaces using a divider region will reduce the bending moment and consequently the stresses in the tooth material of the first or second inner wall at the centre of the tooth, along the plane spanned by the Z and Y axes. By reducing the stresses, the risk of the tooth cracking or breaking is diminished. Accordingly, the thickness of the tooth wall (between the first and/or second inner wall and the corresponding outer working surface) may be reduced, which enables use of a lesser amount of material, with maintained strength and robustness.

Moreover, each pair of first and second back contact surfaces is symmetrical about, and facing away from, the plane spanned by the Z and Y axes, so as to form an angle (beta/gamma) with the plane spanned by the X and Y axes being less than 35 degrees.

When one of the pairs of back contact surfaces is active distributing loads to the corresponding back contact surfaces of the nose portion of the adaptor, the forces involved will hence have a component acting in a direction towards the plane spanned by the Y and Z axes. This in turn means that, when loads are applied to the contact surfaces, the effect thereof will be that the tooth is further secured onto the adaptor. This contributes to a secure coupling.

Also, the arrangement with the pairs of inclined back contact surfaces being separated by the back divider region, extending beyond the inclined back contact surfaces in a direction away from the plane spanned by the X and Y axes, enables the contour of the inner walls, and consequently also the contour of the outer surfaces, of the tooth to be optimized for wear purposes.

As briefly mentioned in the above, when the tooth is in use, the first and second outer working surfaces will be subject to wear, gradually removing material from said outer working surfaces. Generally, the wear will start at the tip of the tooth, and eventually, by continued wear, shorten the tooth. If the wear should reach the contact surfaces between the tooth and the adaptor, the connection between the tooth and the adaptor will be impaired, and the tooth must be replaced.

Generally, when subject to wear, the outer working surfaces of the tooth will be altered so as to follow a wear curve, as material will gradually be removed from the first and second working surfaces of the tooth. Hence, the first and/or second working surface may assume a curved outer shape, which is different from the original shape. Such a wear curve may be described, when seen in a cross direction along an XZ plane, as a symmetrical curve having an apex at the Z axis and sloping towards the side walls of the tooth.

In the suggested tooth, if an outer working surface is subject to wear, and gradually conforms to such a wear curve, it will be understood that the back contact surfaces of the corresponding inner wall will be protected by the back divider region extending beyond the back contact surfaces. In other words, the back contact surfaces will be the last portions of the inner wall of the cavity to be affected by the wear. This ensures that the tooth may remain stably secured on the adaptor even when considerable wear has taken place.

Moreover, advantageously, the first and/or second back divider region and the outermost portions (towards the side surfaces) of the corresponding back contact surfaces may be positioned along a curve approximately corresponding to a wear curve. Hence, it may be ensured, that when wear occurs, the contact surfaces are the last surfaces to be affected thereby. Also, the arrangement will make good use of the material in the tooth, since the tooth will function satisfactorily until much of the material originally provided between the outer surfaces and the inner walls is worn away.

Hence, there is an efficient use of material, since a relatively large portion of the material used to form the tooth will be available for use and wear. When the tooth is finally worn out and must be replaced, a relatively small proportion of the initial amount of material of the tooth remains.

Also, the back divider region extending beyond the back contact surfaces in the first and second inner walls of the cavity enables the corresponding back divider regions of the nose portion of the adaptor to extend beyond the back contact surfaces of the adaptor. Hence, the back divider regions of the nose portion will add material to the nose portion, whereby the strength of the nose portion may be improved.

It will be understood that the explanations in the above apply equally to the first back contact surfaces and the first back divider region and to the second back contact surfaces and the second back divider region.

In accordance with embodiments, the angle (beta, gamma) is less than 25 degrees, preferably 10 to 20 degrees, preferably 12 to 17 degrees, most preferred about 15 degrees.

Generally, the respective angles of inclination of the first and second back contact surfaces should be selected so as to accomplish the desired tightening effect, while still allowing for distribution of the vertical forces to which the tooth is subject during use. Moreover, the form of the wear curve as explained in the above, may be taken into account when selecting a suitable angle. The above-mentioned angles have been found to be particularly useful in order to provide the desired effects.

In accordance with the first aspect of the invention, the cavity defines a back portion extending along the Y axis, the back portion being at least partially located between the plane spanned by the X and Z axes and the open end of the cavity, a front portion extending along the Y axis, the front portion being located between the plane spanned by the X and Z axes and the bottom end of the cavity; and a stepped portion, interconnecting the back portion and the front portion.

Contact surfaces are provided in the back portion and in the front portion of the cavity, on the first and second internally opposing inner walls. When in use, the back and front, first and second contact surfaces of the tooth will be in contact with corresponding surfaces of the adaptor, and hence be efficient to transfer forces applied to the tooth to the adaptor.

When the tooth is in use, attached to a bucket via the adaptor, vertical loads applied to the first or second outer surface of the tooth, and adjacent the tip of the tooth, will frequently appear. Moreover, such forces may be relatively large. Accordingly, it is desired that the coupling shall be well adapted to withstand such vertical loads.

Vertical loads will generally be transferred from the first or second outer working surface, adjacent the tip of the tooth, to the first or second contact surfaces of the first or second inner wall of the cavity. The front and back contact surfaces will be working in pairs. If a vertical force is acting towards the second outer wall adjacent the tip of the tooth, the first back contact surfaces and the second front contact surfaces will form a pair transmitting the load created by the vertical force to the nose portion of the adaptor.

Similarly, if a vertical force is acting towards the first outer wall adjacent the tip of the tooth, the second back contact surfaces and the first front contact surfaces will form a pair transmitting the load to the nose portion of the adaptor.

In order for the contact surfaces to efficiently transfer vertical loads, it is generally desired that the contact surfaces shall be as close to parallel to each other, and to the Y axis, as possible (as seen in any plane parallel to the plane spanned by the Y and Z axes). However, in order to enable fitting and removal of the tooth onto/from the adaptor, a slight deviation from parallel surfaces may be necessary. The deviation could be up to 5 degrees, preferably no more than 2 degrees.

Therefore, all of said first and second back and front contact surfaces are to form an angle (alfa) of less than 5 degrees with the Y axis, as seen in any plane parallel to the plane spanned by the Z and Y axes. Preferably, the angle alfa may be less than 2 degrees.

At least the first and the second back contact surfaces are to form the same angle (alfa) of less than 5 degrees with the Y axis. This defines the Y-axis at the bisector between the first and second back contact surfaces.

The back portion extends along the Y axis, and is at least partially located between the plane spanned by the X and Z axes and the open end of the cavity. This means that the entire back portion may be situated between the XZ plane and the open end, and said back portion may or may not extend from the XZ plane. Alternatively, the back portion may extend from a position behind the XZ plane, over the XZ plane and towards a position located forwardly of the XZ plane. (Behind meaning towards the open end of the cavity and forward meaning towards the bottom end of the cavity.)

As will be described in the below, the first and second pairs of back contact surfaces, with the corresponding back divider regions, are extending in the back portion of the cavity, and hence the back contact surfaces will be at least partially extending behind the plane spanned by the X and Z axes, that is behind the centres of the holes for the attachment pin. The first and second front contact surfaces are, in contrast, arranged in the front portion, which is located in front of the centres of the holes for the attachment pin. By means of this arrangement, and as the front and back contact surfaces are working in pairs as explained in the above, a force distribution is enabled, which diminishes the strain on the area of the tooth adjacent the holes for the attachment pin. This may diminish the risk that the tooth is broken or damaged in the area adjacent the through holes for the attachment pin.

Accordingly, the attachment pin arrangement is protected from overload. This in turn invokes that the function of the pin may be maintained during use of the tooth, resulting in a stable attachment and maintained possibilities for easy removal of the tooth from the adaptor.

At least one pair out of the two pairs of first and second front contact surfaces is located closer to the plane spanned by the X and Y axes than the corresponding back contact surfaces.

The arrangement of at least one out of the first and second back and front contact surfaces in different planes, with the front contact surfaces closer to the plane spanned by the X and Y axes than the corresponding back contact surfaces, contributes to the controlled force distribution protecting the pin area of the connection. Moreover, the arrangement provides for a cavity becoming narrower in the direction towards the tip of the tooth, hence following the general requirement for a tooth having an outer surface tapering towards the tip.

The cavity defines a stepped portion, interconnecting the back portion and the front portion. In the stepped portion, the first and/or second inner wall forms a slope interconnecting the first and/or second back contact surface and the corresponding first and/or second front contact surface (which surfaces are located in different planes).

The slope should advantageously be curved. Preferably, the slope may be S-shaped.

It will be understood, that for being a "slope", the slope should deviate from the plane of the first (or second) back contact surface, and approach the plane spanned by the X and Y axes, so as to interconnect with the first (or second) front contact surface.

The "slope" could comprise one or more sloping regions in the inner wall of the stepped portion.

Advantageously, the slope could interconnect a front and a back contact surface being mutually arranged such that, if they were interconnected by a straight line, such a line would form an angle of more than 10 degrees, preferably more than 20 degrees with the plane spanned by the X and Y axes. (As seen in any plane parallel to the plane spanned by the Y and Z axes, and referring to the smallest angle between the planes.)

An "essentially planar" surface is defined herein as a surface substantially coinciding with a planar imaginary square having the dimensions D×D, where any deviations from such a square is less than 0.2 D. Such a surface may be a contact surface, provided other conditions defined herein are fulfilled. Preferably, an essentially planar surface herein could be a surface substantially coinciding with a planar imaginary square having the dimensions D×D where any deviations from such a square is less than 0.1 D.

All of the first and second, back and front contact surfaces advantageously form an angle alfa of less than 2 degrees with the Y axis, preferably the same angle alfa.

In the back portion, the first inner wall will comprise a pair of essentially planar first back contact surfaces which are symmetrical about, and facing away from, the plane spanned by the Z and Y axes, so as to form an angle beta with the plane spanned by the X and Y axes being less than 35 degrees. In addition, the pair of first back contact surfaces are separated by a first back divider region where the inner first wall extends beyond the pair of first contact surfaces in the Z direction away from the XY plane.

Similarly, in the back portion, the second inner wall will comprise a pair of essentially planar second back contact surfaces, being symmetrical about, and facing away from, the plane spanned by the Z and Y axes, so as to form an angle gamma with the plane spanned by the X and Y axes being less than 35 degrees, the pair of second back contact surfaces being separated by an second back divider region where the inner second wall extends beyond the pair of second contact surfaces in the Z direction away from the XY plane.

The above-mentioned features applied in the back portion of the cavity enables a proposed tooth, with several advantages in relation to the prior art, as outlined in the above.

Generally, the respective angles of inclination of the first and second back contact surfaces should be selected so as to accomplish the desired tightening effect, while still allowing for distribution of the vertical forces to which the tooth is subject during use. Moreover, the form of the wear curve as explained in the above, may be considered when selecting the angles.

To this end, the angle beta may be 10 to 20 degrees, preferably 12 to 17 degrees, most preferred about 15 degrees.

Similarly the angle gamma may be 10 to 20 degrees, preferably 12 to 17 degrees, most preferred about 15 degrees.

In particular for excavator applications, the angle gamma of the second inner wall may be substantially equal to the angle beta of the first inner wall.

In accordance with embodiments, the pairs of first and/or second back contact surfaces extend substantially from the opposing side walls, and preferably substantially all the way to the respective back divider region.

The provision of the back contact surfaces extending substantially from the opposing side walls will enable as large separation of the pair of contact surfaces as possible, and move the load transfer between the tooth and the adaptor away from the plane spanned by the Z and Y axes.

The back contact surfaces extending substantially from the opposing side walls, to the respective back divider region, enable the provision of relatively large back contact surfaces.

Advantageously, the first and/or second inner wall may, in the back portion, substantially consist of the corresponding pair of back contact surfaces and the corresponding back divider region.

Generally, sharp corners and edges are to be avoided when shaping the tooth cavity and the adaptor nose, since any such sharp portions will risk giving rise to load concentrations, which may weaken the coupling.

Accordingly, although it is desired that the essentially planar pair of back contact surfaces shall extend substantially from the opposing side walls, it is understood that a smoothly curved corner region between each side wall and back contact surface may be provided.

In accordance with embodiments, the back portion, comprising the first and second back contact surfaces, may extend from the plane spanned by the Z and X axes and over a distance along the Y axis towards the open end of the tooth corresponding to at least the greatest radius r of the opposing holes, preferably at least 2r.

Accordingly, the back contact surfaces are at least partially located behind the through holes of the tooth. This provides an advantageous load distribution in the coupling, diminishing the stress and/or strain in the through hole area.

In accordance with embodiments, the back portion, comprising the first and second back contact surfaces, may extend also in front of the plane spanned by the Z and X axes, and preferably over a distance along the Y axis towards the bottom end of the cavity corresponding to at least the greatest radius of the opposing through holes.

Hence, the back portion may advantageously extend forwardly of the plane spanned by the Z and X axes, at least over the entire through hole. This arrangement may contribute to an advantageous load distribution in the trough hole area.

In accordance with embodiments, along the back portion, each one out of the pair of the first and/or second back contact surfaces may extend at least over a distance along the X axis of 0.2×WI, where WI is the extension of the first or second inner wall along the X axis, as seen in a cross section parallel to the plane spanned by the X and Z axes.

In accordance with embodiments, and in particular for excavator applications, it is suitable that, throughout a majority of the back portion, the extension along the X axis of the first back contact surfaces is substantially equal to the extension along the X axis of the opposing second back contact surfaces.

With the expression "a majority" is meant herein at least 50%, preferably at least 70%, most preferred at least 80%.

When it is referred to the majority of any one out of the back portion, the stepped portion, or the front portion, it is, unless otherwise stated, referred to the majority of the extension of the back portion, stepped portion, or front portion, along the Y axis.

The first and second back contact surfaces are each separated by a first and second back divider region, respectively.

Advantageously, the first and/or second back divider region may comprise a pair of back divider side surfaces, being symmetrical about, and facing towards, the plane spanned by the Z and Y axes.

Advantageously, the first and/or second pair of back divider surfaces extends substantially from the first and/or second back contact surfaces, respectively.

As previously explained, sharp corners and edges should be avoided, which is why the divider side surfaces may be joined to the back contact surfaces via smoothly curved junction regions.

The extension of the first and/or second back divider region in the Z direction away from the XY plane may hence be determined by the extension of the respective pair of back divider side surfaces in said direction.

In accordance with embodiments, the first and/or second back divider region and hence the corresponding back divider side surfaces may form part of a larger continuous structure formed by the inner wall, such as a ridge. Such a larger continuous structure may extend through one or more out of the back portion, stepped portion, and front portion.

In accordance with embodiments, over a majority of the back portion of the cavity, the extension of the first back divider region in the Z direction away from the XY plane is substantially the same as the extension of the second back divider region in the Z direction away from the XY plane.

In accordance with embodiments, the extension of the first and/or second back divider region in the Z direction away from the XY plane has a maximum adjacent the open end of the cavity and is diminishing as seen along the Y axis towards the bottom end of the cavity.

With the extension of the divider region in the Z direction diminishing towards the bottom end of the cavity, it is possible to design a tooth having an outer surface narrowing towards the tip thereof, as is desired for ensuring sufficient penetration of the tooth when in use. Moreover, it will be understood that the advantages with the divider region separating the first and second back contact surfaces are most pronounced in the back portion of the cavity of the tooth.

The divider side surfaces of the cavity are generally not intended to be in contact with the adaptor's nose portion. Accordingly, some variation of the shape of the divider side surfaces may be tolerated, as long as the tooth fits on the intended adaptor's nose portion.

However, generally, it is desired that the divider side surfaces form curved or gently curved portions, again avoiding sharp edges or corners.

In accordance with embodiments, for the first and/or the second back divider region, each one of the pair of divider side surfaces may comprise a steeper region, wherein a tangent to the side surface in the XZ plane forms an angle of more than 45 degrees with the X axis, followed by a flatter region, wherein a tangent to the side surface in the XZ plane forms an angle of less than 45 degrees with the X axis.

Hence, the steeper region of each one of the pair of divider side surfaces may have a greater extension along the Z axis than along the X axis. Since this surface is not intended to take up any vertical loads applied substantially parallel to the Z axis, such a configuration is suitable.

However, to provide for sufficient strength while avoiding load concentrations in the tooth and/or adaptor, in accordance with embodiments, for the first and/or second back divider region, along a majority of the steeper region's length along the X axis, a tangent to the side surface in the XZ plane forms an angle of more than 45 degrees and less than 80 degrees with the X axis towards the Z axis, preferably less than 70 degrees.

In accordance with embodiments, for the first and/or second back divider region, along a majority of the flatter region's length along the X axis, a tangent to the divider side surface in the XZ plane may form an angle of less the 5 degrees with the X axis towards the Z axis.

Hence, the flatter region may, at least along a portion thereof, be essentially parallel to the X axis.

In the front portion, the first and second inner wall each comprises a pair of essentially planar first or second front contact surfaces, being symmetrical about the plane spanned by the Z and Y axes.

In accordance with embodiments, the pair of first and/or second front contact surfaces may comprise two front contact surfaces being located in the same plane, parallel to the plane spanned by the X and Y axes. In this case, the definition of the two surfaces forming a "pair" is simply made by referring to the surface extending on one side of the ZY plane as one of the surfaces in the pair, and the surface extending on the other side of the ZY plane as the other surface in the pair.

However, it is preferred that the pair of first and/or second front contact surfaces comprises two front contact surfaces being symmetrical about, and facing away from, the plane spanned by the Z and Y axes.

According to embodiments, in the front portion, the first and/or second inner wall may comprise a pair of essentially planar first and/or second front contact surfaces, being symmetrical about, and facing away from, the plane spanned by the Z and Y axes, so as to form a respective angle delta, epsilon with the plane spanned by the X and Y axes being less than 35 degrees.

In accordance with embodiments, the angle delta and/or the angle epsilon is less than 25 degrees, preferably 10 to 20 degrees, preferably 12 to 17 degrees, most preferred about 15 degrees.

The above mentioned features applied in the front portion will provide essentially the same advantages as when the features are applied in the back portion of the cavity.

Preferably, the angle delta is substantially equal to the angle beta, and the angle epsilon is substantially equal to the angle gamma. Hence, the first front and back contact surfaces will extend in parallel to each other, and the second back and front contact surfaces will extend in parallel to each other.

In accordance with embodiments, the first and/or second front and corresponding back contact surfaces may be arranged in parallel planes, the planes being in a translated relationship, such that the first and/or second front contact surfaces are located closer to the plane spanned by the Y and Z axes, than the corresponding back contact surfaces.

In accordance with embodiments, in the front portion, there is at least a divided portion, wherein the pair of first and/or the pair of second front contact surfaces may be separated by a first and/or second front divider region, respectively, where the inner first and/or second wall extend beyond the pair of first/second front contact surfaces in the Z direction away from the XY plane.

It will be understood, that a separation of the contact surfaces by a divider region in the front portions of the cavity will provide essentially the same advantages as in the back portions of the cavity. However, due to the force distribution, the advantages with providing a divider region in the front of the cavity are not as pronounced as in the back. Moreover, since the need for penetration of the tooth requires that its outer shape narrows towards the tip thereof, the provision of a divider region should be balanced with the room available therefore.

Accordingly, although the pair of front contact surfaces may advantageously be separated by a divider region, this is not necessary to achieve some of the advantages previously mentioned herein.

The front divider region may comprise one or more of the features mentioned in the above relating to the back divider region.

Alternatively or in addition to the above, in the front portion, according to embodiments, there is at least a connected portion wherein the pair of first and or the pair of second front contact surfaces may be connected by a first/second front connecting region where the inner first and/or second wall extend in the Z direction along or towards the XY plane.

Hence, the connection region is directed along or towards the XY plane, which is in contrast to the divider region being directed away from the XY plane. The connection region is however not to have an extension along the Z axis being comparable to that of the divider regions. Instead, the connection region is to form a smooth, curved connection between the pair of front contact surfaces.

In accordance with embodiments, the connected portion comprising the first and/or second front contact surfaces and the corresponding connecting region there between may form part of a larger, continuous structure. Such a structure may be a continuous ledge comprising also the first and/or second back contact surfaces, and extending so as to partially surround a continuous ridge as described in the above.

Advantageously, any such connected portion of the front portion should be located closer to the bottom end of the cavity than a divided portion of the front portion.

In accordance with embodiments, in the front portion, the pair of second and/or first front contact surfaces may be joined by a connecting region, at least in a connected portion located towards the bottom end of the cavity. Most preferred, both pairs of second and first front contact surfaces may be joined by a connecting region in such a connected portion. In this case, a frontmost portion of the front portion of the cavity, towards the bottom end, may form an approximately four sided shape, comprising the opposing side walls, the pair of first contact surfaces with their connected region, and the pair of second contact surfaces with their connected region.

However, the extension along the Y axis of the connected portion of the first wall need not be similar to the length of the connected portion of the second side wall.

The stepped portion of the cavity extends between the back portion and the front portion of the cavity. By terms of definition, the back portion of the cavity is a portion along the length of the Y axis within which both the first and the second inner walls display a pair of first or second back contact surfaces, respectively, separated by a divider region and as described in the above. The front portion of the cavity is a portion along the length of the Y axis within which both the first and the second inner walls display a pair of first or second front contact surfaces.

The stepped portion of the cavity interconnects the back portion and the front portion.

One or more of the essentially planar contact surfaces may optionally extend from the back or front portion into the stepped portion of the cavity. (For example, if the second back surfaces should extend further in a direction along the Y axis than the first back surfaces, the back portion is defined so as to end at the end of the first back surfaces. Hence, the second back surfaces would extend into the stepped portion.)

The stepped portion shall interconnect at least the first and/or second back contact surfaces and the first and/or second front contact surfaces which are located in different planes. To this end, the stepped portion comprises a slope.

The term "slope" is used in a general manner. The slope may comprise one or more surfaces, surface structures or surface regions.

In accordance with embodiments, in the stepped portion, the first and/or second inner wall merges with the first and/or second back contact surfaces, the first and/or second back divider region, and with the first and/or second front contact surfaces, forming said slope(s) at least between the first and/or second back contact surfaces and the first and/or second front contact surfaces.

In accordance with embodiments, the slope is curved, preferably forming an S-shape.

With S-shaped is meant, not that the curve follows the full contour of an S, but that it includes a flatter portion, inclining towards the plane spanned by the X and Y axes to a lesser degree, followed by a steeper portion, wherein a greater inclination towards the plane spanned by the X and Y axes takes place, followed by another flatter portion. This shape may be seen as slightly similar to the mid-section of the letter S.

In accordance with embodiments, the stepped portion may, in the first and/or second inner wall, form a pair of sloping first or second surfaces, extending between and merging with the corresponding back contact surfaces and the corresponding front contact surfaces.

Advantageously, the pair of sloping first surfaces may be symmetrical about, and at least partially facing away from, the plane spanned by the Z and Y axes, so as to merge with the corresponding front and back contact surfaces.

In accordance with embodiments, the stepped portion may form an intermediate divider region, extending between the sloping first surfaces, and moreover extending between and merging with the first back divider region and the first front divider region or the first front connected region.

Although the intermediate divider region may advantageously have a sloping or stepped shape, in order to follow a general, narrowing contour of the tooth, this is not necessary. The front contact surfaces is to be closer to the plane spanned by the X and Y axes than the back contact surfaces, meaning that the surfaces of the stepped portion interconnecting these contact surfaces must be sloped—this is the sloping first surfaces mentioned in the above. However, since the purpose of the divider region in the stepped portion of the tooth is to give room for a corresponding protruding divider region of the adaptor, which in turn provides strength to the adaptor, the divider region could be arranged having other shapes in the stepped region. Accordingly, the divider region in the stepped portion of the cavity is referred to as an "intermediate" divider region rather than a "sloping" divider region—as there is indeed no requirement that this particular region shall be sloping.

The first back divider region, the intermediate divider region, and any first front divider region may hence form a continuous divider region, the maximum extension of which in the Z direction away from the XY plane is diminishing from a maximum adjacent the open end of the cavity along the Y axis towards the bottom end of the cavity.

Such a continuous divider region may form a ridge, extending from the open end of the cavity towards the bottom end thereof. The ridge may be partially surrounded by a ledge as described in the above.

As has been discussed in the above, the divider regions (back, front and/or intermediate) contribute to several advantages with the wear connection. The separation of the contact surfaces contributes to a more even force distribution in the wall surrounding the cavity of the tooth. Accordingly, less material is required to form a sufficiently strong tooth, and a tooth having a relatively thin wall of material surrounding the cavity may be formed.

When considering the divider region(s) of the nose portion of the adaptor, the reverse will be true. In the divider region(s) of the adaptor, more material is added, contributing to the strength of the adaptor. Accordingly, the arrangement with the contact surfaces and the divider region contributes to an advantageous distribution of volume between the tooth cavity walls and the adaptor portion, out of the total volume available for the connection between tooth and adaptor.

The divider regions may advantageously form a continuous divider region, being shaped so as to follow the general, narrowing space of the tooth, Accordingly, the continuous divider region may form a structure, e.g. a ridge. Preferably, the height of the continuous divider region (Z direction) may diminish towards the bottom end of the cavity.

In accordance with embodiments, a first and/or second continuous divider region (formed by the back, intermediate and/or front divider regions) may extend through the back portion of the cavity, and at least to a distance r in front of the plane spanned by the X and Z axes, where r is the radius of the through hole, preferably at least 1.5 r.

Hence, the continuous divider region will extend over the throughole of the tooth (or the adaptor portion) and, for the adaptor portion, contribute to the strength of the adaptor over the region of the throughole.

Advantageously, the height (z-direction) of the continuous divider region may diminish softly, preferably following a radius R.

The continuous divider region may diminish in height along the Z axis, and width along the X axis, in a direction along the Y axis towards the bottom end. It may advantageously be the steeper regions of the divider side surfaces which diminishes in height and width (Z and X). The flatter region of the divider side surfaces may then remain essentially constant, interconnecting the steeper regions, until eventually merging into the front contact surface.

Advantageously, portions of, or preferably the entire continuous divider region may comprise one or more of the features as described in connection with the back divider region.

In accordance with embodiments of a tooth as proposed herein, for the first and/or second back divider region, a pair of essentially planar secondary first and/or second back contact surfaces, extends from the back divider side surfaces towards the YZ plane, the secondary first and/or second back contact surfaces being symmetrical about, and facing away from, the plane spanned by the Z and Y axes, so as to form an angle (eta, theta) with the plane spanned by the X and Y axes being less than 35 degrees.

Advantageously, the essentially planar secondary first and/or second back contact surfaces are substantially parallel to the respective first and/or second back contact surfaces.

In an initial state, when the tooth and the nose portion of the adaptor are interconnected, the back divider regions of the tooth and the nose portion are not to be in contact with each other. Accordingly, the height of the back divider regions of the cavity of the tooth is slightly higher, and the width of the back divider regions of the cavity of the tooth is slightly wider, than the height and width of the corresponding back divider regions of the nose portion. Instead, contact between the tooth and the nose portion is ensured via the front and back first/second contact surfaces.

However, during use, and under certain load conditions, the tooth and/or the adaptor nose may become subject to inner deformation, affecting the contact surfaces. In this case, a situation may occur in which the secondary contact surfaces of the back divider regions of the tooth and the adaptor nose come into contact with each other. Accordingly, the secondary contact surfaces may be effective to take over distribution of some of the loads of which the tooth and adaptor is affected.

According to embodiments, secondary contact surfaces as described in the above may be applied also to the front divider region(s) and/or the intermediary divider region(s).

According to embodiments, continuous secondary contact surfaces may be formed, extending along a continuous divider region e.g. through the back portion, the stepped portion, and the front portion of the cavity.

As discussed in the above, the first and second inner walls of the cavity will be effective to transfer vertical loads applied to the tip of the tooth when in action. However, the tip of the tooth may also be subject to horizontal loads.

Such horizontal loads will generally be transferred to the adaptor portion via the opposed side surfaces of the cavity, and the opposed side surfaces of the adaptor. Again, as for the first/second inner walls, the side surfaces will work in pairs. Each working pair will include a front side surface extending through the front portion of the cavity, and a back side surface extending through the back portion of the cavity, said front and back side surfaces being located on opposite sides of the plane spanned by the Z and Y axes.

To this end, at least in the back portion of the cavity, the opposing side surfaces advantageously comprise opposing, essentially planar, back side contact surfaces.

Moreover, in the front portion of the cavity, the opposing side surfaces may advantageously comprise opposing, essentially planar front side contact surfaces.

Preferably, the back side contact surfaces and the front side contact surfaces are located in different planes. Accordingly, the opposing side walls are adapted to provide a slimmer shape of the cavity towards the bottom end thereof.

Advantageously, the entire front side contact surfaces are located closer to the plane spanned by the Z and Y axes than the entire back side contact surfaces.

Advantageously, the opposing front side contact surfaces may extend substantially from the bottom end of the cavity.

In accordance with embodiments, the opposing back side contact surfaces extend at least from the plane spanned by the X and Z axes, in a direction towards the open end of the cavity along the Y axis, over a distance r, preferably 2r, where r is the maximum radius of the through holes.

Accordingly, the tooth and the adaptor portion may be kept relatively large in the area around the through holes, such that sufficient material and thereby sufficient strength of the components may be achieved despised the presence of said holes.

In accordance with embodiments, the opposing back side contact surfaces may extend at least from the plane spanned by the X and Z axes, in a direction towards the bottom end of the cavity along the Y axis, at least over a distance r, where r is the maximum radius of the through holes.

Advantageously, the opposing side surfaces may define opposing sloping side surfaces interconnecting the back side contact surfaces and the front side contact surfaces.

The sloping side surfaces will hence be sloping in a direction towards the plane spanned by the Z and Y axes.

To this end, the sloping side surfaces may comprise curved surfaces.

In accordance with embodiments, the pair of front side contact surfaces and the pair of back side contact surfaces may preferably form an angle with the YZ plane being less than 5 degrees, preferably less than 2 degrees.

This is because, similar to the situation with the first and second front and back contact surfaces, when considering the load distribution, it is preferred that the front side contact surfaces and the back side contact surfaces are parallel to the plane spanned by the Z and Y axes. However, for enabling assembly of the tooth and the adaptor portion, a slight deviation from this must be allowed.

In accordance with embodiments, the back side contact surfaces may extend over a distance in the direction of the Z axis corresponding to at least 3 r, where r is the maximum radius of the through holes.

Advantageously, the back side contact surfaces extend also in front of the plane spanned by the X and Z axes, at least over a distance r, so as to extend over the entire through hole. Preferably, the back side contact surfaces may extend a distance at least 1.5 r in front of the X and Z axes.

By terms of definition, all back contact surfaces (side, first, or second) must have an extension in the back portion of the cavity. However, the back contact surfaces need not be confined to the back portion of the cavity but may continue their extension beyond the plane spanned by the X and Z axes. In this case, the back contact surface will have one area portion extending behind the plane spanned by the X and Z axes, and one area portion extending forward of the plane spanned by the X and Z axes.

The respective extensions of the back contact surfaces (side, first, or second) need not be the same. It is required that the first and second back contact surfaces extend through the entire back portion (by definition). However, the same is not required for the back side surfaces, although it is advantageous that also the back side surfaces extend through the entire back portion.

Having discussed vertical forces and transversal forces that may affect the tip of the tooth, when in working condition, longitudinal forces will now briefly be mentioned. Longitudinal forces may act on the tip of the tooth and generally along a length direction thereof. Such forces are primarily to be taken up by a contact surface in the form of an inner bottom wall of the cavity.

The inner bottom wall of the cavity will hence, when in use, contact the free end of the adaptor, and forces may be transmitted between the surfaces thereof.

An alternative manner of describing a desired geometry for the cavity is to consider the contour of the cavity along the back portion. Accordingly, a tooth having a cavity defined as described in the above, wherein, in the back portion, the first and/or second inner walls displays a contour formed by points x, z, the contour being symmetrical about the Z axis and having a maximum width WI along the X axis.

The contour may be defined by the following:

In peripheral portions at abs (x) greater than or equal to 0.9×WI/2, a first maximum abs(z) is defined in a pair of points (x1, z1).

(In a pair of points (x, z) as referred to herein, x will be negative in one of the points of the pair, and positive in one of the points of the pair. The value of x is the same in both points of the pair. Z will be positive or negative in both points of the pair, and the value of z is the same in both points of the pair.)

For abs(x) less than abs(x1): abs(z) is diminishing until a minimum abs(z) is defined at a pair of points (x2, z2), and for abs(x) less than abs(x2): abs(z) is increasing until a maximum abs(z) is defined at a pair of points (x3, z3), wherein abs(z3)>abs(z1)>abs(z2).

The points (x1, z1); (x2, z2), and (x3, z3) of the first wall need not be similar to those of the second wall. Instead, the appearances of the contour of the first inner wall and the contour of the second wall may vary, and be adapted to various applications.

With "abs(coordinate)" is meant the absolute value of the coordinate.

It should be noted that if x=0, which may be the case with (x3, z3), the two points of the pair will coincide.

The above-mentioned description explains the contour enabling inclined surfaces to provide locking effect, as well as the favourable appearance of the contour when subject to wear.

Advantageously, abs(z3)−abs(z1)>0.03×WI. This sets a relationship between the width of the first or second wall, and the height of the back divider region, which is advantageous in terms of force distribution and strength.

Advantageously, abs(z3)−abs(z1)<0.6×WI.

According to embodiments, (x1, z1); (x2, z2), and (x3, z3) of the first inner wall may be equal to (x1, z1); (x2, z2), and (x3, z3) of the second inner wall.

It will be understood, that with the above description, between the pairs of (x1, z1) and (x2, z2), the contour generally follows a straight line z=k×abs(x)+K, where k and K are constants. The straight lines correspond to the pairs of essentially planar back contact surfaces, which will hence extend between the pairs of points (x1, z1) and (x2, z2); with the first and second back divider regions extending between the points (x2, z2) (negative x2) and (x2, z2) (positive x2), including the maximum points (x3, z3).

The constant k=tan(beta) (or k=tan(gamma)) where beta, gamma may be as described in the above.

The minimum abs(z) points (at (x2, z2)) will be defined in the junctions between the essentially planar back contact surfaces and the back divider region.

Indeed, one could consider the contour of the first and second inner walls of cavity as deviations from opposing, imaginary planes incorporating the minimum z points.

For this, along the back portion, the minimum z of the contours of the first and second inner walls, respectively, are located on two opposing, imaginary minimum z back planes; and along the front portion, the minimum z of the contours of the first and second inner walls, respectively, are located on two opposing, imaginary minimum z front planes.

The minimum z front and back planes all forming the same angle alfa being less than 5 degrees with the Y-axis.

In the first and/or the second inner wall, the minimum z front plane is located closer to the XY plane than the minimum z back plane, and in the stepped portion of the cavity, said first/second inner wall interconnects the minimum z front plane with the minimum z backplane.

Indeed, it is believed that the above-mentioned contour and the suggested relationships between points in the contour, may be advantageous also for a tooth and a corresponding adaptor, which do not display the other above-mentioned features relating to the front portion and the stepped portion of the device. Several of the advantages mentioned in the above, e.g. enabling use of lesser amounts of material and a favourable behaviour during use and wear, might be achieved with other designs of the cavity than the one described in the above and in the embodiments.

Hence, the above-mentioned objects may alternatively be achieved by a tooth for attachment to the lip of a bucket of a working machine, such as an excavator or loader, via an adaptor, the tooth having an exterior surface comprising two externally opposed outer working surfaces, namely a first working surface (and a second working surface, the working surfaces having a width (W) in a horizontal direction (H), intended to extend along said lip of a bucket, and having a length (L) extending between an attachment end and a tip of said tooth, the working surfaces extending along said length (L) while converging in a vertical direction (V) to be connected at said tip of the tooth, the tooth further comprising a cavity for receiving a portion of said adaptor, the cavity extending between said first and second opposed outer working surfaces from an open end, at said attachment end of the tooth, to a bottom end; the cavity being delimited by an inner wall; said inner wall comprising first and second internally facing inner walls, being the internal surfaces associated with said first outer working surface and said second working outer surface, respectively, and opposing side walls, interconnecting said first and second inner walls, the opposing side walls delimiting opposing through holes for receiving a pin extending through the cavity for attachment of the tooth to the adaptor portion, a first axis X being defined extending through the centres of the opposite through holes, a second axis Y extending along the cavity from the open end of the cavity towards the bottom end of the cavity, and a third axis Z being orthogonal to said first and second axes X, Y, the three axes X, Y, Z thereby forming an orthogonal axes system, meeting at an origo, whereby each point of the inner wall may be defined by Cartesian coordinates (x, y, z), the cavity defining a back portion extending along the Y axis, the back portion being at least partially located between the plane spanned by the X and Z axes and the open end of the cavity; and, wherein, in the back portion, for each point y along the x axis, the first back wall and the second back wall each displays a contour formed by points (x, z), the contour being symmetrical about the Z axis and having a maximum width WI along the X axis, the contour being defined by the following: in peripheral portions at abs (x) greater than or equal to 0.9×WI/2, a first maximum abs(z) is defined in a pair of points (x1, z1), for abs (x) less than abs (x1), abs(z) is diminishing until a minimum abs(z) is defined at a pair of points (x2, z2), and for abs (x) less than abs(x2), z is increasing until a maximum abs(z) is defined at a pair of points (x3, z3), wherein abs(z3)>abs(z1)>abs(z2), and abs(z3)−abs(z1) >0.03×WI, preferably abs(z3)−abs(z1)<0.6×WI.

Advantageously, abs(z3)−abs(z1)>0.1×WI. Preferably, abs(z3)−abs(z1)<0.3×WI.

The second variant of a tooth as described in the above may be combined with any of the features mentioned in relation to the first variant of a tooth in the above.

In a tooth as described herein, a first stepped distance (D1) along the Z axis is bridged by the first inner wall along the stepped portion, between the first back contact surfaces and the first front contact surfaces; and a second stepped distance (D2) along the Z axis is bridged by the second inner wall along the stepped portion, between the second back contact surfaces and the second front contact surface; wherein 0.80 D1<D2<=D1.

In the stepped portion, the first and the second inner wall will each form a slope between the respective front surface and the respective back surface. The stepped portion will hence bridge the distances along the Z axis between the front surfaces and the respective back surfaces.

The "stepped distance" is to be measured over the entire stepped portion, that is, from the back surfaces at the junction between the back portion and the stepped portion, to the front surfaces at the junction between the stepped portion and the front portion.

If the front and back contact surfaces do not extend in parallel, the distance as measured along the Z axis might have different values in different planes parallel to the plane spanned by the Z and Y axes. In this case, the minimum measurable distance along the Z axis is to be the "stepped distance".

The relationship between the first stepped distance D1 and the second stepped distance D2 will be relevant to the degree of symmetry of the cavity.

If the first stepped distance equals to the second stepped distance, the first and second front and back contact surfaces are symmetrically arranged. Such embodiments might be particularly advantageous for certain applications, such as excavator applications.

Also embodiments where the first stepped distance deviates slightly from the second stepped distance may be advantageous for such applications. Hence, 0.80 D1<D2<=D1, may be a suitable range for such applications.

In accordance to embodiments, 0.90 D1<D2<=D1.

In accordance to embodiments, as mentioned in the above, D1 may be substantially equal to D2. When D1 is equal to D2, advantageously the entire cavity may be substantially symmetrical about the plane spanned by the X and Y axes.

It will be understood, that the above description of features and advantages made in relation to a tooth, are applicable also to the adaptor to which the tooth is to be connected. Generally, all features described in relation to the tooth have a corresponding counterpart in the adaptor.

In view of the above, the object of the invention is achieved by an adaptor for attachment of a tooth to the lip of a bucket of a working machine, such as an excavator or loader, the adaptor comprising a connector portion for arrangement to or in a bucket, and a nose portion for arrangement in a corresponding cavity of a tooth, the nose portion having a width in a horizontal direction (H), intended to extend along the lip of bucket, and having a length extending in a longitudinal direction (L) from a connector end adjacent the connector portion of the adaptor, to a free end, and having an outer wall, the outer wall comprising a first outer wall and an externally opposed second outer wall, and externally opposing side walls, interconnecting said first and second outer walls, the nose portion delimiting a through hole, extending between said opposing side walls, for receiving a pin extending through the nose portion for attachment of the tooth to the adaptor, a first axis X being defined extending through the centre of through hole, a second axis Y extending along the nose portion from the connector end of the nose portion towards the free end of the nose portion, and a third axis Z being orthogonal to said first and second axes X, Y, the three axes X, Y, Z thereby forming an orthogonal axes system, meeting at an origo, whereby each point of the outer wall may be defined by Cartesian coordinates (x, y, z), wherein the nose portion defining a back portion extending along the Y axis, the back portion being at least partially located between the plane spanned by the X and Z axes and the connector end of the nose portion, a front portion extending along the Y axis, the front portion being located between the plane spanned by the X and Z axes and the free end of the nose portion; and a stepped portion, interconnecting the back portion and the front portion; in the back portion, the first and second outer walls, each comprises a pair of essentially planar back contact surfaces, each pair of back contact surfaces being symmetrical about, and facing towards, the plane spanned by the Z and Y axes, so as to form an angle (beta, gamma) with the plane spanned by the X and Y axes being less than 35 degrees, each pair of back contact surfaces being separated by a back divider region, extending beyond the pair of first contact surfaces in the Z direction away from the XY plane; in the front portion, the first and second outer wall each comprises a pair of essentially planar front contact surfaces, being symmetrical about the plane spanned by the Z and Y axes, all contact surfaces forming an angle (alfa) less than 5 degrees with the Y axis, as seen in any plane parallel to the plane spanned by the Z and Y axes, the first and/or second front contact surfaces being located closer to the plane spanned by the X and Y axes than the corresponding back contact surfaces, and the first and/or second outer wall of the stepped portion forming a slope wherein at least a portion of the outer wall approaches the XY plane towards the bottom wall, interconnecting said first and/or second back contact surfaces and the corresponding first and/or second front contact surface.

A first stepped distance (D1) along the Z axis is bridged by the first inner wall along the stepped portion (SP), between the first back contact surfaces and the first front contact surfaces; and a second stepped distance (D2) along the Z axis is bridged by the second inner wall along the stepped portion (SP), between the second back contact surfaces and the second front contact surface; wherein 0.80 D1<D2<=D1.

The connector portion may form a portion for attaching the adaptor to a bucket. However, the term connector portion is also to encompass the portion of an adaptor being cast as an integral portion of a bucket being directed towards the remainder of the bucket.

According to embodiments, the angle (beta, gamma) is less than 25 degrees, preferably 10 to 20 degrees, preferably 12 to 17 degrees, most preferred about 15 degrees.

According to embodiments, the angle gamma of the second outer wall is substantially equal to the angle beta of the first outer wall.

According to embodiments, the pairs of first and/or second back contact surfaces extend substantially from the opposing side walls, and preferably substantially to the respective back divider region.

According to embodiments, the back portion, comprising the first and second back contact surfaces extends at least from the plane spanned by the Z and X axes, and over a distance along the Y axis, in a direction towards the connector end, corresponding to at least the greatest radius (r) of the opposing through hole, preferably at least 2r.

According to embodiments, the back portion, comprising the first and second back contact surfaces extends also in front of the plane spanned by the Z and X axes and preferably over a distance along the Y axis, in a direction towards the free end, corresponding to at least the greatest radius (r) of the through hole.

According to embodiments, each one out of the pair of the first and/or second back contact surfaces extends at least over a distance along the X axis of 0.2×WI, where WI is the extension of the first/second outer wall along the X axis.

According to embodiments, throughout a majority of the back portion, the extension along the X axis of the first back contact surfaces is substantially equal to the extension along the X axis of the opposing second back contact surfaces.

According to embodiments, the first and/or second back divider region comprises a pair of divider side surfaces, being symmetrical about, and facing away from, the ZY plane.

According to embodiments, the pair of divider side surfaces of the first and/or second back divider region extends substantially from the first and/or second back contact surfaces, respectively.

According to embodiments, the extension of the first and/or second back divider region in the Z direction away from the XY plane is determined by the extension of the corresponding pair of divider side surfaces in said direction.

According to embodiments, through a majority of the back portion of the nose portion, the extension of the first back divider region in the Z direction away from the XY plane is substantially equal to the extension of the second back divider region in the Z direction away from the XY plane.

According to embodiments, the extension of the first and/or second back divider region in the Z direction away from the XY plane has a maximum adjacent the connector end of the nose portion and is diminishing along the Y axis towards the free end of the nose portion.

According to embodiments, for the first and/or second back divider region, each one of the pair of divider side surfaces comprises a steeper region wherein a tangent to the side surface in the XZ plane forms an angle of more than 45 degrees with the X axis, followed by a flatter region wherein a tangent to the side surface in the XZ plane forms an angle of less than 45 degrees with the X axis.

According to embodiments, said steeper region of each one of the pair of divider side surfaces has a greater extension along the Z axis than along the X axis.

According to embodiments, for the first and/or second back divider region, along a majority of the steeper region's length along the X axis, a tangent to the side surface in the XZ plane forms an angle of more than 45 degrees and less than 80 degrees with the X axis towards the Z axis.

According to embodiments, for the first and/or second back divider region, along a majority of the flatter region's length along the X axis, a tangent to the divider side surface in the XZ plane forms an angle of less the 5 degrees with the X axis towards the Z axis.

According to embodiments, for the first and/or second back divider region, a pair of essentially planar secondary first and/or second back contact surfaces extend from the divider side surfaces towards the YZ plane, the secondary first/second back contact surfaces being symmetrical about, and facing towards, the plane spanned by the Z and Y axes, so as to form an angle (eta, theta) with the plane spanned by the X and Y axes being less than 35 degrees.

According to embodiments, the essentially planar secondary first/second back contact surfaces are substantially parallel to the respective first/second back contact surfaces.

According to embodiments, the back portion extends along a portion of the y axis where, for each point y along the X axis, the first and/or second outer wall displays a contour formed by points (x, z), the contour being symmetrical about the Z axis and having a width WI along the X axis, the contour being defined by the following:

in peripheral portions at abs (x) greater than or equal to 0.9×WI/2, a first maximum abs(z) is defined in a pair of points (x1, z1), for abs (x) less than abs (x1), abs(z) is diminishing until a minimum abs(z) is defined at (x2, z2), and for abs (x) less than abs(x2), z is increasing until a maximum abs(z) is defined at (x3, z3), wherein abs(z3)>abs (z1)>abs(z2), and abs(z3)−abs(z1)>0.03×WI, preferably abs (z3)−abs(z1)<0.6×WI.

Advantageously, abs(z3)−abs(z1)>0.1×WI. Preferably, abs(z3)−abs(z1)<0.3×WI.

According to embodiments, (x1, abs(z1)); (x2, abs(z2)), and (x3, abs(z3)) of the first outer wall may be similar to (x1, abs(z1)); (x2, abs(z2)), and (x3, abs(z3)) of the second outer wall.

According to embodiments, in the front portion, the first and/or second outer wall comprises a pair of essentially planar first and/or second front contact surfaces, being symmetrical about, and facing towards, the plane spanned by the Z and Y axes, so as to form an angle (delta, epsilon) with the plane spanned by the X and Y axes being less than 35 degrees.

According to embodiments, the angle delta and/or the angle epsilon is less than 25 degrees, preferably 10 to 20 degrees, preferably 12 to 17 degrees, most preferred about 15 degrees, preferably the angle delta is substantially equal to the angle beta, and the angle epsilon is substantially equal to the angle gamma.

According to embodiments, in the front portion, there is at least a divided portion wherein at least one, preferably both, of the pair of first and second front contact surfaces is separated by a first or second front divider region where the outer first or second wall extends beyond the pair of first or second front contact surfaces in the Z direction away from the XY plane.

According to embodiments, in the front portion, there is at least an interconnected portion wherein at least one, preferably both, of the pairs of first or second front contact surfaces are connected by a first or second front connecting region where the outer first/second wall extend in the Z direction along or towards the XY plane.

According to embodiments, said connected portion is located closer to the free end of the nose portion than said divided portion.

According to embodiments, the second outer wall in the stepped portion forms a slope, approaching the plane spanned by the X and Y axes while extending towards the free end, and interconnecting said second back contact surfaces and said second front contact surfaces.

According to embodiments, in the stepped portion, the first and/or second outer wall merges with the first and/or second back contact surfaces, the first and/or second back divider region, and with the first and/or second front contact surfaces, forming said slope(s) at least between the first and/or second back contact surfaces and the first and/or second front contact surfaces.

According to embodiments, said slope is curved, preferably forming an S-shape.

According to embodiments, said first front and back contact surfaces, being connected by said slope, are arranged such that, if they were interconnected by a straight line, such a line would form an angle of more than 10 degrees, preferably more than 20 degrees with the plane spanned by the X and Y axes.

According to embodiments, in the stepped portion, the first and/or second outer wall forms a pair of sloping first surfaces, being symmetrical about the plane spanned by the Z and Y axes, extending between and merging with the first and/or second back contact surfaces and the corresponding first and/or second front contact surfaces.

According to embodiments, in the stepped portion, the first and/or second outer wall forms an intermediate divider region, extending between the first or second sloping back surfaces, and moreover extending between and merging with the first or second back divider region and the first or second front divider region or connecting region.

According to embodiments, the first and/or second back divider region, and the corresponding intermediate divider region, form a continuous divider region, the maximum extension of which in the Z direction away from the XY plane is diminishing from a maximum adjacent the connector end of the nose portion along the Y axis towards the free end of the nose portion.

According to embodiments, at least in the back portion, the opposing side surfaces comprises opposing, essentially planar, back side contact surfaces, and at least in the front portion, the opposing side surfaces comprises opposing, essentially planar front side contact surfaces, the back side contact surfaces and the front side contact surfaces being located in different planes.

According to embodiments, the entire front side contact surfaces are located closer to the plane spanned by the Z and Y axes than the entire back side contact surfaces.

According to embodiments, the opposing front side contact surfaces extend substantially from the free end of the nose portion.

According to embodiments, the opposing back side contact surfaces extend at least from the plane spanned by the X and Z axes, in a direction towards the connector end of the nose portion along the Y axis, over a distance r, preferably 2r, where r is the maximum radius of the through hole.

According to embodiments, the opposing back side contact surfaces extend at least from the plane spanned by the X and Z axes, in a direction towards the free end of the nose portion along the Y axis, at least over a distance r, where r is the maximum radius of the through hole.

According to embodiments, the opposing side surfaces defines opposing sloping side surfaces interconnecting the opposing back side contact surfaces and the front side contact surfaces.

According to embodiments, the sloping side surfaces comprise curved surfaces.

According to embodiments, the pair of front side surfaces and the pair of back side surfaces form an angle with the YZ plane being less than 5 degrees, preferably less than 2 degrees.

According to embodiments, the back side contact surfaces extend over a distance in the direction of the Z axis corresponding to at least 3 r, where r is the maximum radius of the through holes.

According to embodiments, the free end of the nose portion comprises an outer end wall.

According to embodiments, the angle alfa is between 0.5 and 5 degrees, most preferred between 1 and 3 degrees.

In a second variant, the object of the invention is achieved by an adaptor for attachment of a tooth to the lip of a bucket of a working machine, such as an excavator or loader, the adaptor comprising a connector portion for arrangement to a bucket, and a nose portion for arrangement in a corresponding cavity of a tooth, the nose portion having a width in a horizontal direction (H), intended to extend along the lip of bucket, and having a length extending in a longitudinal direction (L) from a connector end adjacent the connector portion of the adaptor, to a free end, and having an outer wall, the outer wall comprising a first outer wall and an externally opposed second outer wall, and externally opposing side walls, interconnecting said first and second outer walls, the nose portion delimiting a through hole extending between said opposing side walls, for receiving a pin extending through the nose portion for attachment of the tooth to the adaptor, a first axis X being defined extending through the centre of through hole, a second axis Y extending along the nose portion from the connector end of the nose portion towards the free end of the nose portion, and a third axis Z being orthogonal to said first and second axes X, Y, the three axes X, Y, Z thereby forming an orthogonal axes system, meeting at an origo, whereby each point of the outer wall (may be defined by Cartesian coordinates (x, y, z), wherein the nose portion defining a back portion extending along the Y axis, the back portion being at least partially located between the plane spanned by the X and Z axes and the connection end of the nose portion, in said back portion, for each point y along the X axis, the first outer wall and the second outer wall each displays a contour formed by points (x, z), the contour being symmetrical about the Z axis and having a maximum width WI along the X axis, the contour being defined by the following: in peripheral portions at abs (x) greater than or equal to $0.9\times WI/2$, a first maximum abs(z) is defined in a pair of points (x1, z1), for abs (x) less than abs (x1), abs(z) is diminishing until a minimum abs(z) is defined at (x2, z2), and for abs (x) less than abs(x2), abs(z) is increasing until a maximum abs(z) is defined at (x3, z3), wherein $abs(z3)>abs(z1)>abs(z2)$, and $abs(z3)-abs(z1)>0.03\times WI$, preferably $abs(z3)-abs(z1)<0.6\times WI$.

Advantageously, $abs(z3)-abs(z1)>0.1\times WI$. Preferably, $abs(z3)-abs(z1)<0.3\times WI$.

The object of the invention is also achieved by a tooth having a cavity designed so as to fit with an adaptor as described in the above.

At the attachment end of the tooth, the open end of the cavity is delimited by the inner wall, and surrounded by an outer wall of the tooth, which may be forming a tooth wall edge.

The nose portion of the adaptor extends from a coupling portion, where the coupling portion forms a rim surrounding the base of the nose portion. The shape of the rim may advantageously correspond to the tooth wall edge of the tooth, such that, when the tooth and the adaptor are assembled, the rim will face said tooth wall edge, and the outer wall of the tooth and of the coupling portion of the adaptor will form an assembled outer surface having generally having a smooth appearance.

The rim and the tooth wall edge may advantageously be designed so as to fit closely with each other, so as to hinder debris from entering between the nose portion and the inner wall of the cavity of the tooth.

When reference is made herein to the XY plane or the YX plane, it is referred to the plane spanned by the X and Y axes; and similar definitions apply to other planes referring to the three orthogonal axes X, Y Z.

BRIEF DESCRIPTION OF THE DRAWINGS

The various aspects of the invention, including its particular features and advantages, will be readily understood from the following detailed description and the accompanying drawings, in which.

DETAILED DESCRIPTION

Figure 1:
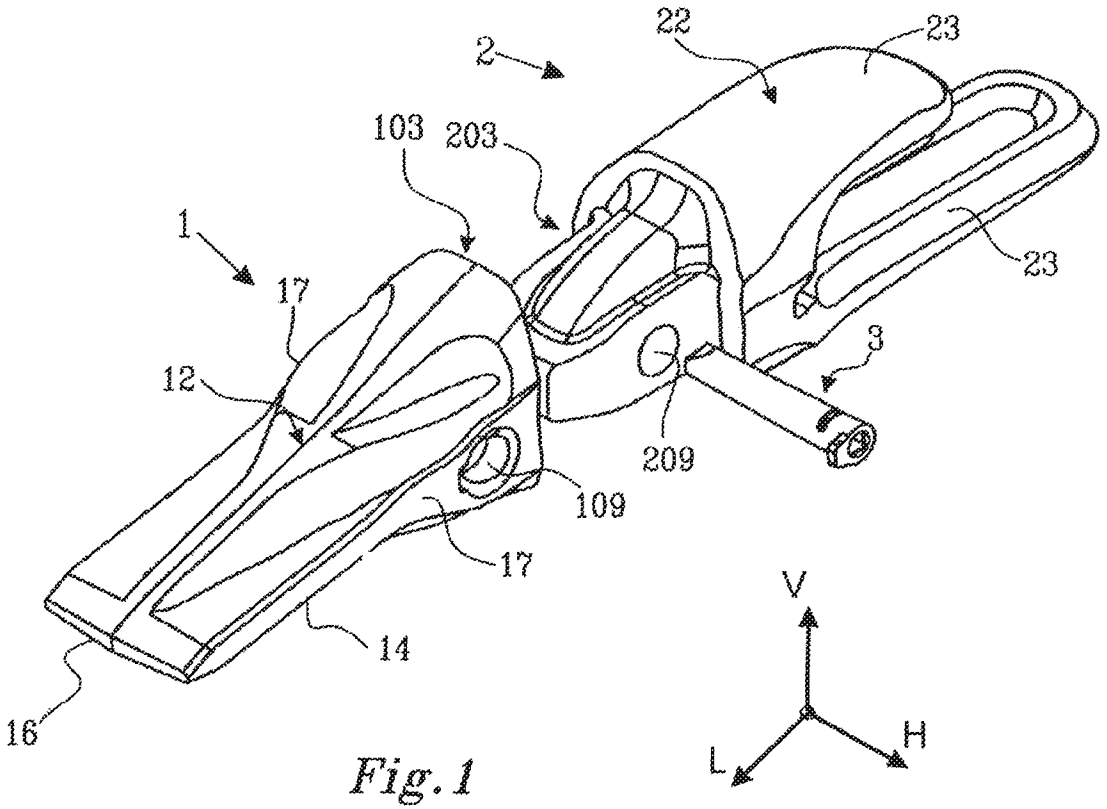
FIG. 1 illustrates an embodiment of a tooth, an adaptor and an attachment pin.

The present invention will now be described more fully with reference to the accompanying drawings, in which example embodiments are shown. However, this invention should not be construed as limited to the embodiments set forth herein. Disclosed features of example embodiments may be combined as readily understood by one of ordinary skill in the art to which this invention belongs. Like numbers refer to like elements throughout. Well-known functions or constructions will not necessarily be described in detail for brevity and/or clarity.

Where several drawings illustrate the same embodiment, it is to be understood that a reference number indicating a feature in one drawing may be referred to throughout the description, even if the number is not repeated in every drawing of the embodiment.

In the below, features of the tooth and of the adaptor proposed herein, as well as their function and advantages achieved, will be described in general. For better understanding, reference will also be made to the embodiments described in the enclosed drawings. However, it is to be understood that the features and/or advantages are not delimited to the depicted embodiments, but may be applied to various designs in accordance with the understanding of the skilled person.

The disclosure relates generally, in a first aspect, to a tooth for attachment to the lip of a bucket of a working machine via an adaptor. The outer design of such a tooth may be selected for the desired purpose thereof, such as digging, shoveling etc. Generally, such a tooth will however extend between a coupling portion for coupling the tooth to the lip of a bucket, usually via an adaptor, and a tip portion for penetrating into the material to be worked.

Generally, the tooth will extend in a longitudinal direction from said coupling portion to the tip of the tooth. Moreover, the tooth will have an extension in a direction along the lip of the bucket, hereinafter referred to as a "horizontal" direction. Finally, the tooth will have an extension along a direction perpendicular to the longitudinal and the horizontal direction, i.e. a "thickness". This direction is referred to herein as a "vertical direction". Generally, the thickness along said vertical direction is greatest at the coupling portion of the tooth, and diminishes towards the tip of the tooth.

In line with the above, the tooth is having an exterior surface comprising two externally opposed outer working surfaces, namely a first working surface and a second working surface. The working surfaces have a width in a horizontal direction, intended to extend along the lip of a bucket, when arranged thereto. The working surfaces have a length extending between an attachment end of the tooth and a tip of said tooth. The working surfaces will extend in a tooth-like manner along said length while converging in a vertical direction such that the opposed first and second working surface are connected at said tip of the tooth.

When in use, the working surfaces are intended to be directed towards the front/back of the bucket for performing working operations, and thus they may be seen as forming extensions of the inner and outer surface of the bucket, respectively, said extensions protruding from the lip of the bucket.

The exterior surface of the tooth may further define opposing outer side walls, extending essentially only along the vertical and longitudinal directions, and interconnecting the first and second working surface.

Generally, the first outer working surface may be the working surface intended to continue from the inner side of the bucket, and the second outer working surface may be the surface intended to continue from the outer side of the bucket.

The tooth comprises a cavity for receiving a portion of said adaptor, the cavity extending between said first and second opposed outer working surfaces from an open end, at said attachment end of the tooth, to a bottom end. Said cavity is designed for attachment of the tooth to an adaptor, as will be described in the below.

Hence, the tooth comprises a cavity for receiving a portion of said adaptor, the cavity extending between said first and second opposed outer working surfaces from an open end, at said attachment end of the tooth, to a bottom end; the cavity being delimited by an inner wall.

The inner wall comprises first and second internally facing inner walls, being the internal surfaces associated with said first outer working surface and said second working outer surface, respectively, and opposing side walls interconnecting said first and second inner walls.

The opposing side walls delimit opposing through holes for receiving a pin extending through the cavity, for attachment of the tooth to the adaptor.

Hence, the opposing through holes may allow for insertion of a pin, generally along the horizontal direction through the cavity. Hence, it is envisaged that the pin will extend generally along the lip of the bucket. Such a pin will allow for secure fastening of the tooth to an adaptor.

In a second aspect, the disclosure relates generally to an adaptor for attachment of a tooth to the lip of a bucket of a working machine, such as an excavator or loader. The adaptor comprises a connector portion for arrangement to a bucket, and a nose portion for arrangement in a corresponding cavity of a tooth.

Figure 19:
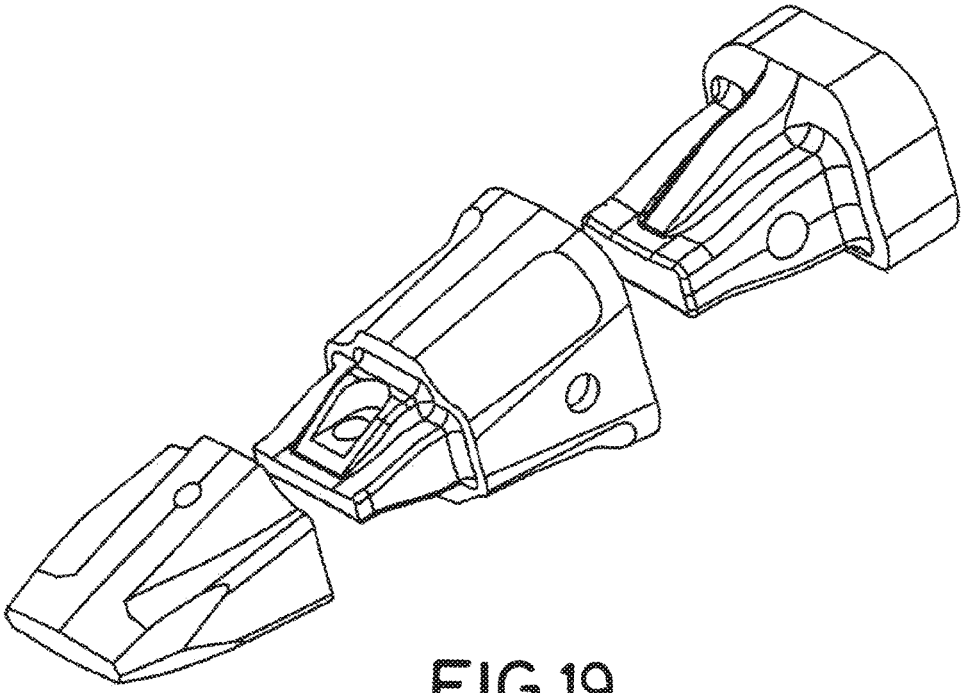
FIG. 19 is a perspective view of a tooth and an adaptor in a three part system.
Figure 20:
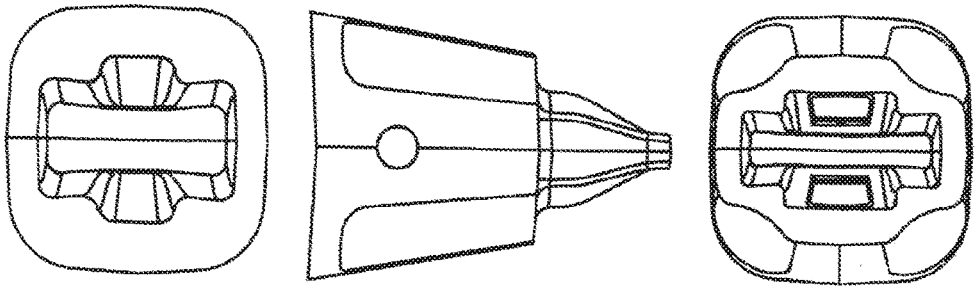
FIG. 20 illustrates other views of the three part system of FIG. 19.

The connector portion may have any desired shape enabling attachment thereof to the lip of a bucket. Conventionally, such attachment may be made e.g. by soldering. For example, the connector portion may display a fork-shaped appearance, defining two bifurcated leg portions between which the lip of the bucket may be arranged. The adapters can be fixed to the blade in different ways, such as welded, be part of the blade as cast nose or be mechanically attached. For instance in mining, three part systems are used, shown in FIGS. 19 and 20, wherein the nose portion of the adapter forms part of the blade of the bucket, being the nose portion a cast nose. Therefore, it is possible that the connector portion forms part of the blade of the bucket, this solution being known as cast nose.

Using the directions as defined in the above, the connector portion will generally allow for arrangement of the lip of the bucket along a "horizontal" direction.

The nose portion of the adaptor extends from the connector portion along a longitudinal direction from a connector end (towards the connector portion) to a free end. The nose portion defines an outer wall, which is designed such that the nose portion fits into the cavity of a corresponding tooth and enables coupling between the tooth and the adaptor.

To enable fastening of the nose portion of the adaptor in the coupling portion of the tooth, the nose portion is provided with a through hole extending along a horizontal direction, corresponding to the through holes of the tooth. Accordingly, a pin may be inserted through the assembly of the coupling portion of the tooth and the nose portion of the adaptor.

For attachment of the tooth to the adaptor, the cavity of the tooth is placed on to the nose portion and an attachment pin is secured in the passage formed by the through holes of the tooth and the through hole of the adaptor.

Turning now to the exemplary embodiments, the above-mentioned features are explained with reference to a first embodiment of a tooth illustrated in FIGS. 3 to 7, and to a corresponding first embodiment of an adaptor illustrated in FIGS. 8 to 10.

Figure 2:
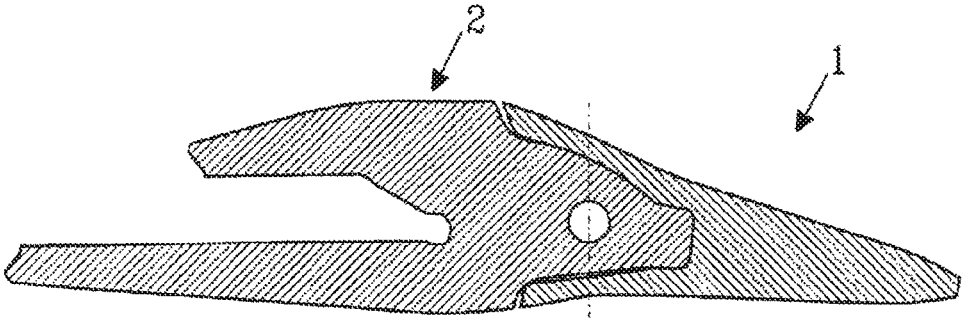
FIG. 2*a* is a vertical view from above of the tooth and the adaptor of FIG. 1 when assembled.
FIG. 2*b* is a horizontal view of the tooth and the adaptor of FIG. 1 when assembled.
FIG. 2*c* is a cross-sectional view of the tooth and the adaptor of FIG. 1 when assembled.
Figure 2A:
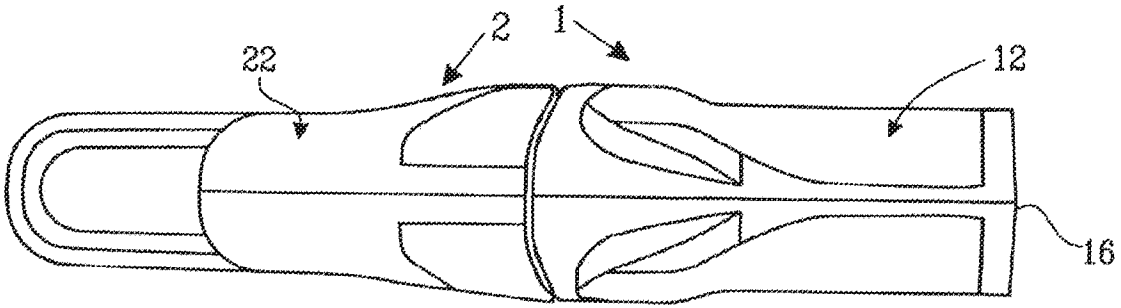
Figure 2B:
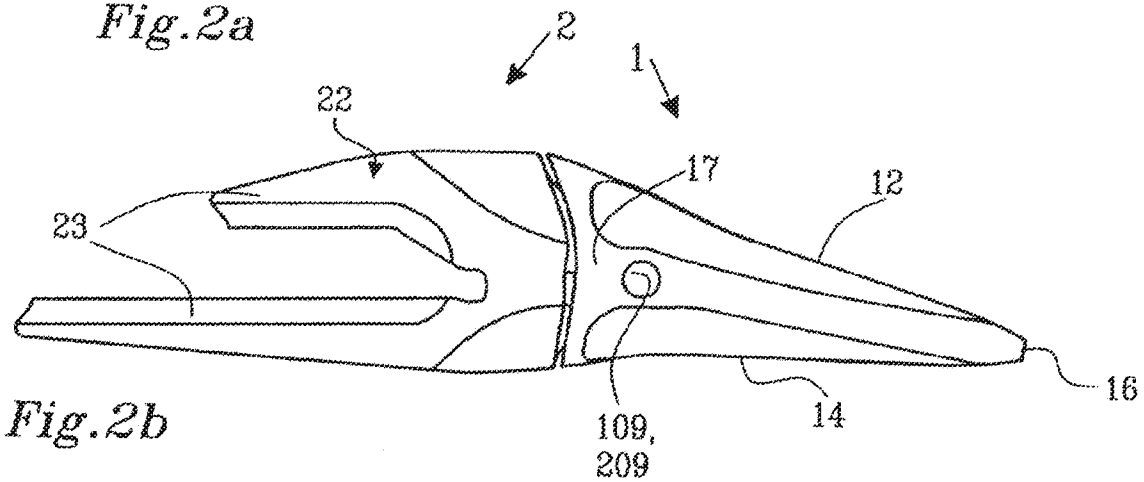

FIG. 1 illustrates the first embodiment of the tooth 1, and the first embodiment of the adaptor 2 for attachment of the tooth 1 to the lip of a bucket of a working machine, and an attachment pin 3 for attachment of the tooth to the adaptor. FIGS. 2*a*, 2*b*, and 2*c* illustrate the tooth and the adaptor when interconnected.

The tooth 1 has an exterior surface comprising two externally opposed outer working surfaces, namely a first working surface 12 and a second working surface 14, the working surfaces 12, 14 having a width in a horizontal direction H, intended to extend along said lip of a bucket, and having a length L extending between an attachment end and a tip 16 of said tooth, the working surfaces 12, 14 extending along said length L while converging in a vertical direction V, such that the opposed first and second working surface 12, 14 are connected at said tip 16 of the tooth.

The first and second working surfaces 12, 14 form the major outer surface area of the tooth, and will, in use be directed towards the front/back of the bucket for performing working operations.

The exterior surface of the tooth 1 further defines opposing outer side walls 17, extending essentially only along the vertical and longitudinal directions, and interconnecting the first and second outer walls 12, 14.

For coupling of the tooth 1 to an adaptor 2, which, in the illustrated embodiment, in turn is to be fastened to a bucket of a working machine, the tooth 1 comprises cavity 103 extending from an attachment end of the tooth, opposite the tip 16 of the tooth.

Figure 3:
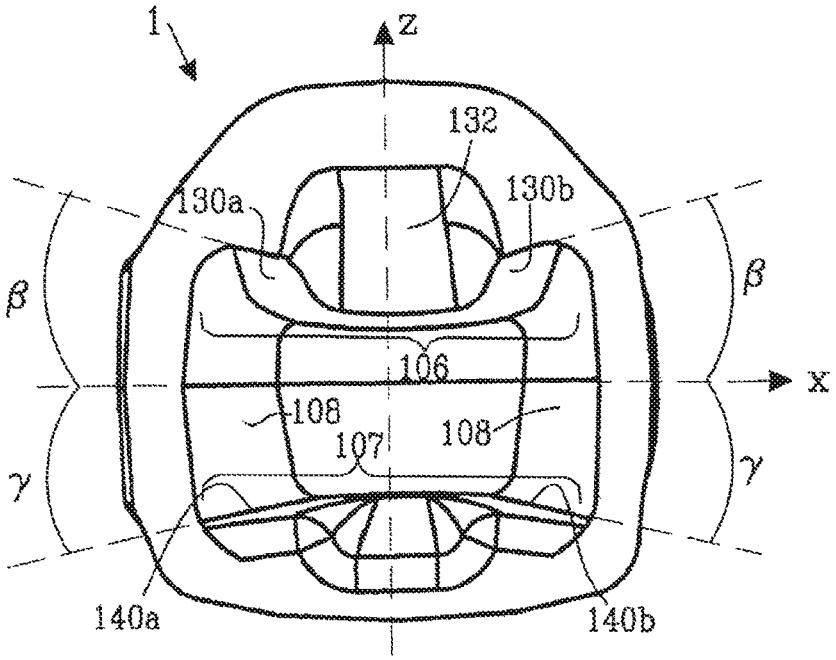
FIGS. 3 and 4 are perspective views of the tooth of FIG. 1.

Hence, as illustrated e.g. in FIG. 3, the tooth comprises a cavity 103 for receiving a portion of said adaptor, the cavity 103 extending between said first and second opposed outer working surfaces 12, 14 from an open end 104, at said attachment end of the tooth, to a bottom end 105. The cavity 103 is delimited by an inner wall 102.

The tooth 1 moreover defines opposing through holes 109 in the outer wall of the tooth 1. The opposing through holes 109 form a passage for receiving a pin extending through the coupling portion of the tooth, which passage extends generally in the horizontal direction H across the tooth.

The adaptor 2 is intended for attachment of a tooth to the lip of a bucket of a working machine, such as an excavator or loader. To this end the adaptor 2 comprises a connector portion 22 for arrangement to a bucket, and a nose portion 203 for arrangement in a corresponding cavity 103 of a tooth 1.

The connector portion 22 may have any desired shape enabling attachment thereof to the lip of a bucket. In the embodiment described in FIGS. 1 to 2*c*, and FIGS. 8 to 10, the connector portion forms a forked structure 23, having two vertically separated legs in between which the lip of a bucket may be positioned. Hence, the lip of the bucket will be arranged so as to extend generally along the horizontal direction H.

As seen e.g. in FIGS. 8, and 10*a* to 10*d*, the nose portion 203 extends along the longitudinal direction L from a connector end 204 to a free end 205, and has an outer wall 202.

The outer wall 202 comprises a first outer wall 206 and an opposing second outer wall 207, the first and second outer walls 206, 207 extending in the horizontal direction H, which, when arranged to a bucket, extend along the lip of thereof.

Moreover, the outer wall 202 comprises opposing side walls 208, interconnecting said first and second inner walls 206, 207.

A through hole 209 is extending through the nose portion 203, along the horizontal direction H.

For attachment of the tooth 1 to the adaptor 2, the nose portion 203 is introduced into the cavity 103 and an attachment pin 3 is secured in the passage formed by the through hole 109 of the tooth 1 and the through hole 209 of the adaptor.

When the tooth 1 is secured to an adaptor 2 arranged at the lip of the bucket, the tooth and adaptor arrangement is ready for use.

As mentioned in the above, the tooth 1 is designed such that the first outer wall 12 and the second outer wall 14 will be the major "working surfaces" of the tooth, and hence be effective to perform the working operation of digging, shoveling etc.

Accordingly, in use, relatively large forces will appear coming from the generally vertical direction V and being applied to the first outer wall 12 or the second outer wall 14, and adjacent the tip 16 of the tooth.

Also, longitudinal forces may be applied from a generally longitudinal direction L, onto the very end of the tip of the tooth 16, and horizontal forces may be applied, acting primarily on the outer side surfaces 17.

Naturally, the division of forces into vertical, longitudinal and horizontal forces is a simplification of the actual forces appearing when the tooth and the adaptor are used. However, when designing a coupling between a tooth and an adaptor, such simplified notions are nevertheless useful, and will be used in the below to explain the behaviour of the tooth and adaptor described herein.

It will be understood herein, that the terms "vertical", "horizontal", and "longitudinal" are a defined in relation to the tooth and to the adaptor only.

By "horizontal" is meant a direction parallel to the direction along which a lip of a bucket to which the adaptor is to be attached extends.

By "longitudinal" is meant a direction of extension of the tooth and the adaptor from an attachment end located towards the bucket, and extending towards the tip of the tooth, perpendicular to the horizontal direction By "vertical" is meant a direction perpendicular to both the horizontal and the longitudinal directions.

Although the above-mentioned directions are described with reference to the embodiment of the drawings, it is submitted that the description thereof is not limited to such embodiments, but may easily be applied to other embodiments of tooth and adaptors.

It will be understood, that as vertically, horizontally or longitudinally directed forces are applied to the tip of the tooth when in use, these forces will be transmitted to the adaptor portion via the contact created between the tooth and the adaptor in the cavity of the tooth and the nose portion of the adaptor.

The description of the first aspect of the invention, namely a tooth, will now be continued by describing the cavity, said cavity being delimited by an inner wall.

The inner wall comprises first and second internally facing inner walls, being the internal surfaces associated with said first outer working surface and said second working outer surface, respectively.

Accordingly, the first and second inner walls will primarily be involved in the transfer of vertical forces applied to the first or second outer working surfaces.

In addition to the first and second inner walls, the inner wall comprises opposing side walls, interconnecting said first and second inner walls.

Moreover, the opposing side walls delimit the opposing through holes for receiving a pin extending through the cavity for attachment of the tooth to the adaptor portion.

It follows from the above that the through holes may hence be arranged such that a pin extending through the holes will extend in a direction substantially parallel to the lip of a bucket onto which the tooth is to be arranged (i.e. the horizontal direction H).

For the purpose of enabling further definition of features of the tooth, a first axis X may be defined extending through the centres of the opposite through holes.

A second axis Y may be defined extending along the cavity from the open end of the cavity towards the bottom end of the cavity, and a third axis Z may be defined being orthogonal to said first and second axes X, Y.

The three axes X, Y, Z are thereby forming an orthogonal axes system, meeting at an origo, whereby each point of the inner wall may be defined by Cartesian coordinates (x, y, z).

From the above definitions, it follows that the axis X, extending through the through holes, will be substantially parallel to the horizontal direction H, discussed in the above.

However, although the axis Z will generally extend so as to have a component along the vertical direction V, the axis Z need not be parallel to the vertical direction V.

Similarly, although the axis Y will generally extend so as to have a component along the longitudinal direction L, the axis Y need not be parallel to the longitudinal direction L.

This is because the cavity of the tooth need not be perfectly aligned with the general outer shape of the tooth. Instead, there is room for variation, e.g. in the shape of the portion of the tooth extending longitudinally beyond the cavity. In all, the horizontal, vertical and longitudinal directions as discussed herein are to be seen as general directions in space, and are used for general explanations only, which is why no more precise definitions are required. In contrast, the X, Y and Z axes are specifically defined, and the embodiments will described in detail with reference thereto.

To exemplify the above-mentioned features, reference will now be made to the first exemplary embodiment of a tooth and in particular to FIGS. 3 to 5.

Figure 4:
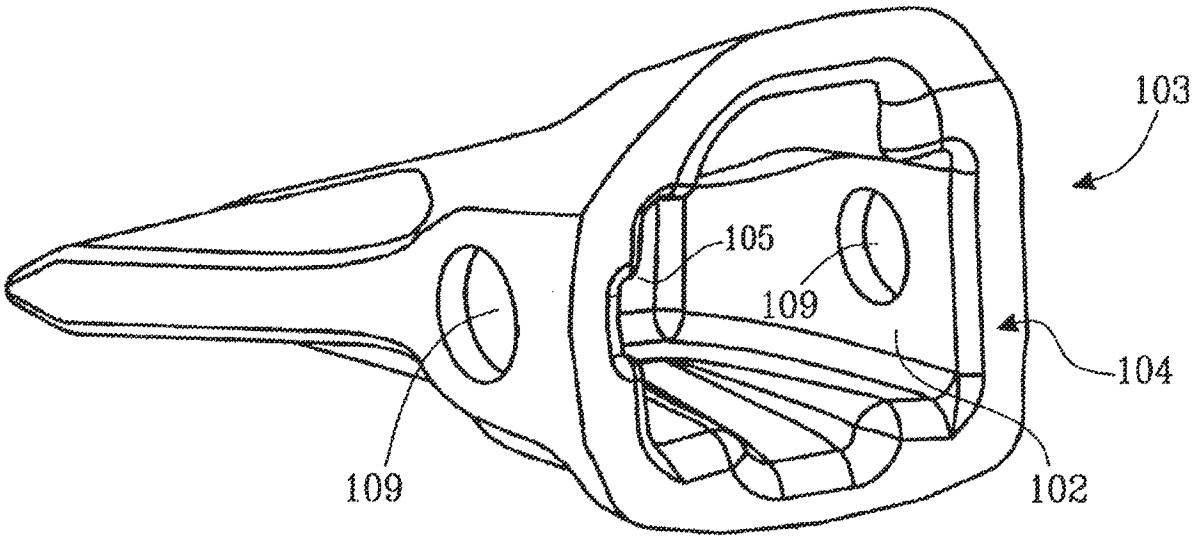
Figure 5:
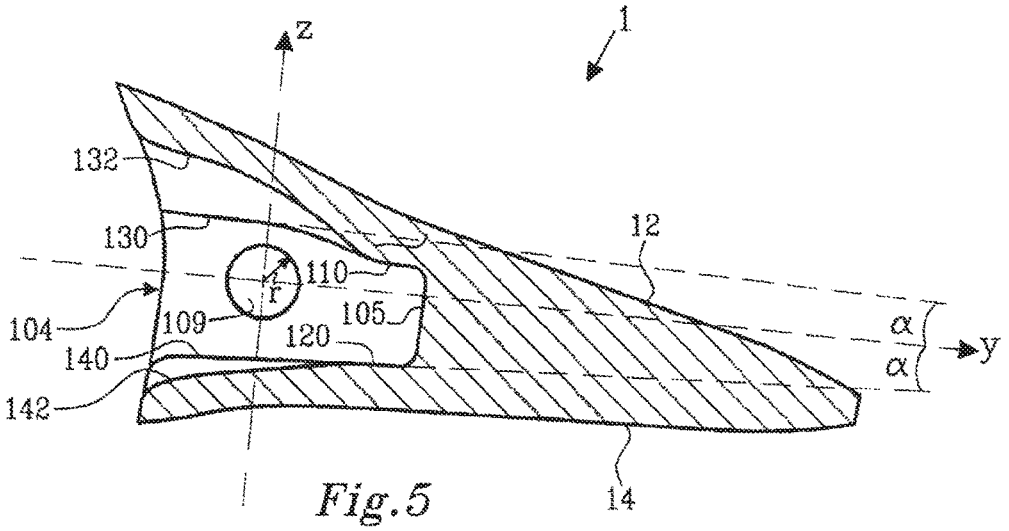
FIGS. 5 and 5' are cross-sectional views if the tooth of FIG. 1, taken along the Z and Y axes.
Figure 5:
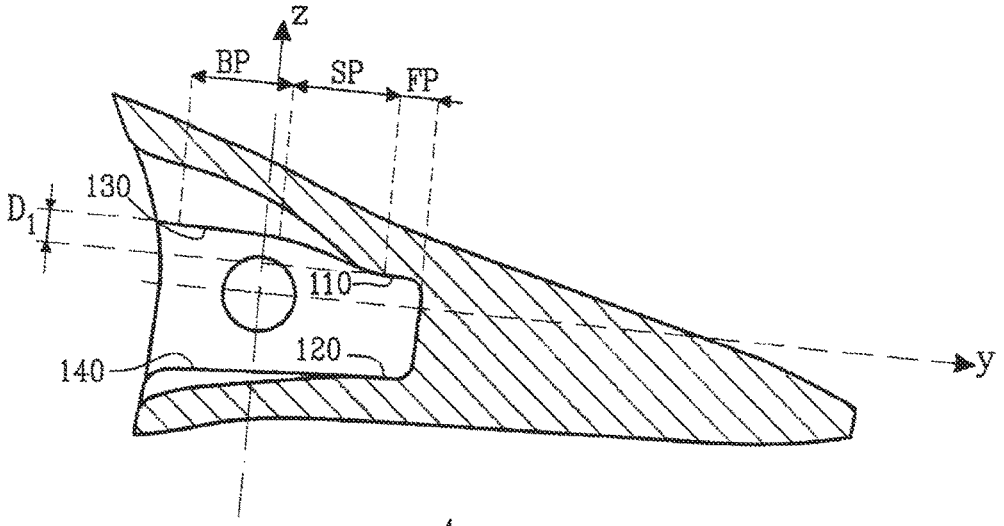

FIGS. 3 to 5 illustrate an embodiment of a tooth having a cavity 103, the cavity being delimited by an inner wall 102.

The inner wall 102 comprises opposing first and second internally facing inner walls 106, 107, being the internal surfaces associated with said first working surface 12 and said second working surface 14, respectively.

Moreover, the inner wall 102 comprises internally opposing side walls 108, interconnecting said first and second inner walls 106, 107. The opposing side walls 108 are generally the inner surfaces associated with the outer side walls.

The opposing side walls 108 delimit opposing through holes 109 for receiving a pin 3 extending through the cavity 103 for attachment of the tooth 1 to the adaptor 2. The pin 3, when arranged through the through holes 109 will hence extend in a direction substantially parallel to the lip of the bucket onto which the tooth is to be arranged, namely the horizontal direction H, as mentioned in the above.

The definition of the three axes X, Y and Z may be made in reference to the embodiment described in FIGS. 3 to 5, as follows: The first axis X is defined extending through the centres of the opposite through holes 109, the second axis Y is extending along the cavity 103 from the open end 104 of the cavity towards the bottom end 105 of the cavity, and the third axis Z is orthogonal to said first and second axis X, Y.

In the figures, it is seen how the three axes X, Y, Z are thereby forming an orthogonal axis system, meeting at an origo, wherein each point of the inner wall 102 may be defined by Cartesian coordinates x, y, z.

The cavity defines a back portion extending along the Y axis, the back portion being at least partially located between the plane spanned by the X and Z axis and the open end of the cavity, and a front portion extending along the Y axis, the front portion being located between the plane spanned by the X and Z axes and the bottom end of the cavity; and a stepped portion, interconnecting the back portion and the front portion.

Hence, contact surfaces are provided in a back portion and a front portion of the cavity, on the first and second internally opposing inner walls. When in use, the back and front, first and second contact surfaces of the tooth will be in contact with corresponding surfaces of the adaptor, and hence be efficient to transfer forces applied to the tooth to the adaptor.

When the tooth is in use, attached to a bucket via the adaptor, vertical loads applied to the first or second outer surface of the tooth, and at the tip of the tooth, will frequently appear and will moreover be relatively large forces. Accordingly, it is desired that the coupling is well adapted to withstand such vertical loads.

Vertical loads will generally be transferred from the first or second outer working surface, adjacent the tip of the tooth, to the first and second contact surfaces of the first and second inner wall of the cavity. The first and second contact surfaces will be working in pairs. If a vertical force is acting towards the second outer wall of the tip of the tooth, the first back contact surfaces and the second front contact surfaces will form a pair transmitting the load to the nose portion of the adaptor.

Similarly, if a vertical force is acting towards the first outer wall of the tip of the tooth, the second back contact surfaces, and the first front contact surfaces, will form a pair transmitting the load to the nose portion of the adaptor.

In order for the contact surfaces to efficiently transfer vertical loads, it is generally desired that the contact surfaces shall be as close to parallel to each other, and to the Y axis, as possible (as seen in any plane parallel to the plane spanned by the Y and Z axes). However, in order to enable fitting and removal of the tooth onto/from the adaptor, a slight deviation from parallel surfaces are necessary. The deviation could be up to 5 degrees, preferably no more than 2 degrees.

Therefore, all of said first and second back and front contact surfaces are to form an angle (alfa) of less than 5 degrees with the Y axis, as seen in any plane parallel to the plane spanned by the Z and Y axes. Preferably, the angle alfa may be less than 2 degrees.

At least the first and the second back contact surfaces are to form the same angle (alfa) of less than 5 degrees with the Y axis. This defines the Y-axis at the bisector between the first and second back contact surfaces.

The back portion extends along the Y axis, and is at least partially located between the plane spanned by the X and Z axes and the open end of the cavity. As will be described in the below, the first and second pairs of back contact surfaces, with the corresponding back divider regions, are extending in the back region, and hence the back contact surfaces will be at least partially extending behind the plane spanned by the X and Z axes, that is behind the centres of the holes for the attachment pin. The first and second front contact surfaces are, in contrast, arranged in the front portion, which is located in front of the centres of the holes for the attachment pin. Due to this arrangement, and, when the front and back contact surfaces are working in pairs, a force distribution is enabled, which diminishes the strain on the area of the tooth adjacent the holes for the attachment pin. This will diminish the risk that the tooth is broken or damaged in the area adjacent the holes for the attachment pin, and hence enable the use of lesser material.

Accordingly, the attachment pin arrangement is protected from overload. This in turn invokes that the function of the pin is maintained during use of the tooth, resulting in stable function of the attachment and maintained possibilities for removal of the tooth from the adaptor.

The first front contact surface is located closer to the plane spanned by the X and Y axes than the first back contact surfaces.

The arrangement with the first and/or second back and the corresponding first and/or second front contact surfaces extending in different planes, with the front contact surface located closer to the plane spanned by the X and Y axes than the back contact surface contributes to the controlled force distribution protecting the pin area of the connection. Moreover, the arrangement provides for the cavity becoming narrower in the direction towards the tip of the tooth, hence following the general requirement for a tooth having an outer surface tapering towards the tip.

The cavity defines a stepped portion, interconnecting the back portion and the front portion. In the stepped portion, the first and/or inner wall forms a slope interconnecting the first and/or second back contact surface and the first front contact surface.

The slope should advantageously be curved. Preferably, the slope may be S-shaped.

It will be understood, that for being a "slope", the slope should deviate from the plane of the first back contact surface, and approach the plane spanned by the X and Y axes, so as to interconnect with the first front contact surface.

Advantageously, the slope could interconnect a front and back contact surface arranged such that, if they were interconnected by a straight line, such a line would form an angle of more than 10 degrees, preferably more than 20 degrees with the plane spanned by the X and Y axes.

For exemplification of the above mentioned features, reference will now be made to the embodiments of the drawings, and again in particular to FIGS. 3 to 5.

The illustrated tooth comprises a cavity 103. The first wall 106 comprises a pair of essentially planar first back contact surfaces 130*a,b*, and the second wall 107 comprises a pair of opposing, essentially planar second back contact surfaces 140*a,b*. Hence, the cavity defines a back portion wherein both the first and the second inner wall 106, 107 comprises a pair of first/second back contact surfaces.

Also, in a front portion located between the plane spanned by the X and Z axes and the bottom end 105 of the cavity 103, the first wall 106 and the second wall 107 each comprises a pair of essentially planar front contact surfaces 110*a,b*, 120*a,b*, being symmetrical about the plane spanned by the Z and Y axes. Hence, the cavity 103 defines a front portion wherein each one of the first and the second inner wall 106, 107 comprises a pair of essentially planar first/second front contact surfaces 110*a, b*; 120 *a, b*. These surfaces will be described in more detail later on in this application.

As may be seen in the figures, an essentially planar contact surface may be a part of a larger portion of the contour formed by the inner wall, such as a ledge or shelf.

To determine whether an essentially planar contact surface may be defined, it may be controlled whether there is a part of the portion fulfilling the requirement for being deemed "essentially planar"—that is, coinciding with a planar imaginary square having the dimensions D×D where any deviations from such a square is less than 0.2 D. An area fulfilling those conditions may be a contact surface provided other conditions defined herein are fulfilled.

In embodiment of FIGS. 1 to 10, the pair of first back contact surfaces 130*a,b*, and the pair of first front contact surfaces 110 *a,b* are all found on a structure of the first inner wall 106 forming a ledge which extends along the side walls 108 and the bottom wall 105. Hence, the ledge is approximately U-shaped. The first back contact surfaces 130*a, b* are essentially flat portions of the ledge in the back portion of the cavity. The first front contact surfaces 110*a, b* are essentially flat portions of the ledge in the front portion of the cavity.

Between the first back contact surfaces 130*a, b*, and the first front contact surfaces 110*a,b*, a stepped portion is defined. In the stepped portion, the first inner wall 106 is sloping so as to connect the first back contact surfaces 130*a, b* with the first front contact surface 110.

In the illustrated embodiment, in the stepped portion, it is seen how the ledge forming the contact surfaces approaches the plane spanned by the X and Y axes.

Hence, each one of the pair of first back contact surfaces 130*a,b* is located in a different plane than the corresponding first front contact surface 110*a,b*, and the entire first front contact surfaces 110*a,b* are located closer to the plane spanned by the X and Y axes than the entire first back contact surfaces 130, *a,b*. The first back contact surfaces 130*a,b* and the first contact surfaces 110*a,b* are interconnected via the stepped portion.

A first stepped distance D1 along the Z axis is bridged by the first inner wall 106 along the stepped portion SP, between the first back contact surfaces 130*a,b* and the first front contact surfaces 110*a,b*.

In the illustrated embodiment, the second back contact surfaces 140*a,b*, and the second front contact surfaces 120*a,b* are arranged in a similar relationship as the first back contact surfaces 130*a,b* and the first front contact surfaces 110*a,b*. Accordingly, there is a a second stepped distance D2 along the Z axis is bridged by the second inner wall 107 along the stepped portion SP, between the second back contact surfaces 140*a,b* and the second front contact surfaces 120*a,b*. The relationship between the first stepped distance D1 and the second stepped distance D2 will be relevant to the degree of symmetry of the cavity.

In the illustrated embodiment, the first stepped distance D1 equals to the second stepped distance D2, and the first and second front and back contact surfaces are symmetrically arranged. Such embodiments might be particularly advantageous for certain applications, such as excavator applications because the tooth wears symmetrically on the two externally opposed outer working surfaces 12 and 14.

Moreover, as in the illustrated embodiment, the entire cavity may be substantially symmetrical about the plane spanned by the X and Y axes.

Also embodiments where the first stepped distance deviates slightly from the second stepped distance may be advantageous for such applications. Hence, 0.80 D1<D2<=D1, may be a suitable range for such applications.

All of the first and second, back and front contact surfaces 110, 120, 130, 140 form an angle alfa of less than 2 degrees with the Y axis.

In the illustrated embodiment, all of the first and second, back and front contact surfaces also form the same angle alfa of less than 2 degrees with the Y axis.

In the embodiment illustrated in FIGS. 1-10, the first back and front contact surfaces 130*a,b* 110 *a,b* are found on a structure of the first inner wall 106 forming a ledge which extends along the side walls 108 and the bottom wall 105. As may be seen in the figures, this ledge is essentially planar when seen in a cross section along a YZ plane.

Similarly, the second back and front contact surfaces 140*a,b*, 120 *a,b* are found on a structure of the second inner wall 107 forming a ledge which extends along the side walls 108 and the bottom wall 105.

The first back contact surfaces 130*a,b*; and the second front contact surfaces 120 *a,b* will work together to transmit vertical loads applied to the second outer wall adjacent the tip of the tooth, and the second back contact surfaces and the first front contact surfaces will work together to transmit vertical loads applied to the first outer wall of the tip of the tooth.

Continuing now the general description of the first aspect of the invention, in the back portion, the first inner wall will comprise a pair of essentially planar first back contact surfaces which are symmetrical about, and facing away from, the plane spanned by the Z and Y axes, so as to form an angle beta with the plane spanned by the X and Y axes being less than 35 degrees. In addition, the pair of first back contact surfaces are separated by a first back divider region where the inner first wall extends beyond the pair of first contact surfaces in the Z direction away from the XY plane.

Similarly, in the back portion, the second inner wall will comprise a pair of essentially planar second back contact surfaces, being symmetrical about, and facing away from, the plane spanned by the Z and Y axes, so as to form an angle gamma with the plane spanned by the X and Y axes being less than 35 degrees, the pair of second back contact surfaces being separated by an second back divider region where the inner second wall extends beyond the pair of second contact surfaces in the Z direction away from the XY plane.

Turning to the exemplary embodiments of FIGS. 1-10, in the back portion, the pair of essentially planar first back contact surfaces 130*a, b*, are symmetrical about, and facing away from, the plane spanned by the Z and Y axes, so as to form an angle beta with the plane spanned by the X and Y axes being less than 35 degrees, and the pair of first back contact surfaces 130*a, b* are separated by a first back divider region 132 where the inner first wall 106 extends beyond the pair of first contact surfaces 130*a, b* in the Z direction away from the XY plane.

Likewise, the pair of essentially planar second back contact surfaces 140*a, b*, are symmetrical about, and facing away from, the plane spanned by the Z and Y axes, so as to form an angle gamma with the plane spanned by the X and Y axes being less than 35 degrees, the pair of second back contact surfaces 140*a, b* being separated by an second back divider region 142 where the inner second wall 107 extends beyond the pair of second contact surfaces 140*a, b* in the Z direction away from the XY plane.

The above-mentioned features applied in the back portion of the cavity may convey several advantages to the proposed tooth including those mentioned in the above.

With reference to the embodiment illustrated in FIGS. 1-10, the proposed back portion BP enables an advantageous force distribution in the coupling between the tooth and the adaptor.

When the tooth 1 is connected to the adaptor 2, contact between the tooth and the adaptor is to take place between the pairs of first and second back contact surfaces 130 *a,b*; 140*a,b*, but not at the first and second back divider regions 132, 142, separating the respective pairs of contact surfaces 130*a,b*; 140*a,b*. The first and second back divider regions 132, 142 of the inner wall 102 of the cavity 103 are hence portions of the inner wall 102 which are not intended to be in contact with the adaptor 2.

Accordingly, along the back portion BP, in each one the first inner wall 106 and in the second inner wall 107, the contact between the tooth 1 and the adaptor 2 is to take place over two contact surfaces 130*a,b*; 140 *a,b* which are spaced along the X axis. This means that loads that shall be distributed in the back portion BP are distributed between two separated planar contact surfaces, working in parallel. This will per se diminish the concentration of loads appearing in the material of the tooth. In particular, the separation of the back contact surfaces by means of a back divider region 132, 142 will inhibit force concentrations appearing in the tooth material at the centre of the tooth, along the plane spanned by the Z and Y axes. The avoidance of force concentrations invokes less risk of the tooth cracking or breaking. Accordingly, the thickness of the tooth wall (between the first/second inner wall 106, 107 and the corresponding outer working surface 12, 14) may be reduced, which enables use of a lesser amount of material.

Moreover, each pair of first and second back contact surfaces 130*a,b*; 140 *a,b* are symmetrical about, and facing away from, the plane spanned by the ZY axes, so as to form an angle beta with the plane spanned by the X and Y axes being less than 35 degrees.

When the pairs of back contact surfaces 130*a,b*; 140*a,b* are active distributing loads to corresponding back contact surfaces 230*a,b*; 240 *a,b* of the nose portion of the adaptor 2, the directions of the forces involved will hence have a component acting towards the plane spanned by the Z and Y axes. This in turn means that, when loads are applied to the contact surfaces 130*a,b*; 140 *a,b*, the effect thereof will be that the tooth 1 is further secured onto the adaptor 2. This contributes to a secure coupling.

Also, the arrangement of the pairs of inclined back contact surfaces 130*a,b*; 140 *a,b* separated by the back divider region 132,142, extending beyond the inclined back contact surfaces in a direction away from the plane spanned by the X and Y axes, enables the contour of the inner walls 106,107 and consequently also the outer walls 12, 14 of the tooth to be optimized for wear purposes.

As briefly mentioned in the above, when the tooth is in use, the first and second outer wall 12, 14 will be subject to wear, gradually removing material from said outer walls 12,14. Generally the wear will start at the tip 16 of the tooth, and gradually shorten the tooth. If the wear should reach the contact surfaces 130*a, b*, 140*a,b* between the tooth 1 and the adaptor 2, the connection between the tooth and the adaptor will be impaired, and the tooth must be replaced before the wear reaches the contact surfaces.

Generally, when subject to wear, the outer wall of the tooth will be altered following a wear curve, as material will gradually be removed from the first and second working surfaces of the tooth. Hence, the first and/or second working surface may assume a curved outer shape. Such a curve may be described, when seen in a cross direction along an XZ plane, as a symmetrical curve having an apex at the Z axis and sloping towards the side walls of the tooth.

In the tooth illustrated in the drawings, if an outer working surface 12, 14 is subject to wear, and gradually conforms to such a curve, it will be understood that the contact surfaces 130*a,b*; 140 *a,b* will be protected due to the back divider region 132, 142 extending beyond the surfaces. In other words, the contact surfaces 130*a,b*; 140*a,b* will be the last portions of the inner walls 106, 107 of the cavity 103 to be affected by the wear. This ensures that the tooth 1 will remain be stably secured on the adaptor even when considerable wear has taken place.

Moreover, advantageously, the back divider region 132, 142 and the outermost portions (towards the side surfaces 108) of the back contact surfaces 130*a,b*, 140*a,b* may be positioned along a curve approximately corresponding to a wear curve. Hence, it may be ensured, that when wear occurs, the contact surfaces are the last surfaces to be effected thereby. Also, the arrangement will make optimum use of the material in the tooth, since the tooth will function satisfactory until most of the material of the outer wall is effectively worn away. Hence, the material of the tooth will be efficiently used, since a large portion of the material used for the tooth will actually be available for use and wear. When the tooth is finally worn out and must be replaced, a relatively small proportion of the initial amount of material of the tooth remains.

Also, the back divider region 132, 142 extending beyond the back contact surfaces 130*a, b*; 140*a, b* in the first and second inner wall of the cavity enables the corresponding back divider region of the nose portion 232, 242 of the adaptor 2 to extend beyond the back contact surfaces 230*a,b*; 240*a,b* of the adaptor 2. Hence, the back divider region 232, 242 of the nose portion will add material to the nose portion, whereby sufficient strength of the nose portion may be ensured.

It will be understood that the explanations above apply to the first contact surfaces 130*a,b* and the first back divider region 132 and to the second contact surfaces 140*a,b* and the second back divider region 142.

An alternative manner of describing the desired geometry for the cavity is to consider the contour of the cavity in the back portion, as will be made in the following with reference to FIG. 6". Accordingly, a tooth having a cavity defined as described in the above, wherein, in the back portion, the first wall displays a contour formed by points x, z, the contour being symmetrical about the Z axis and having a maximum width WI.

The contour being defined by the following:

in peripheral portions at abs (x) greater than or equal to 0.9×WI/2, a first maximum abs(z) is defined in a pair of points (x1, z1), for abs (x) less than abs (x1), abs(z) is diminishing until a minimum abs(z) is defined at (x2, z2), and for abs (x) less than abs(x2), abs(z) is increasing until a maximum abs(z) is defined at (x3, z3).

The same applies for the second wall (107), facing the first wall (106), in the back portion of the cavity. The appearances of the first wall and of the second wall may be varied so as to be adapted to various applications.

Figure 6:
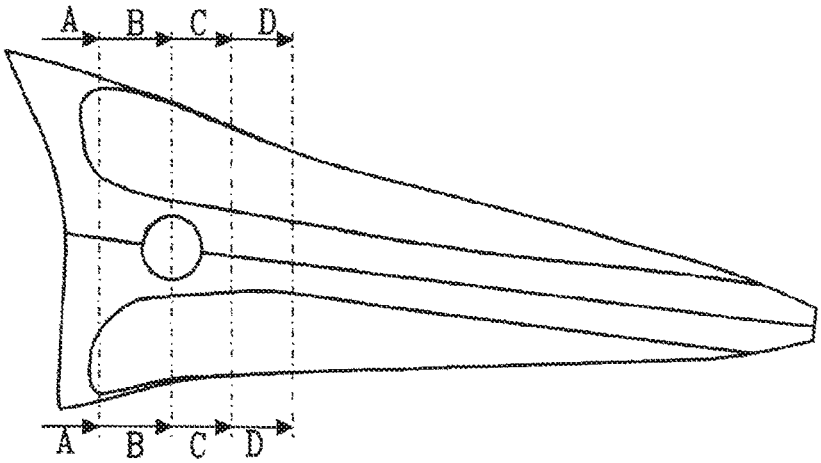
FIGS. 6*a*, 6', 6
Figure 6A:
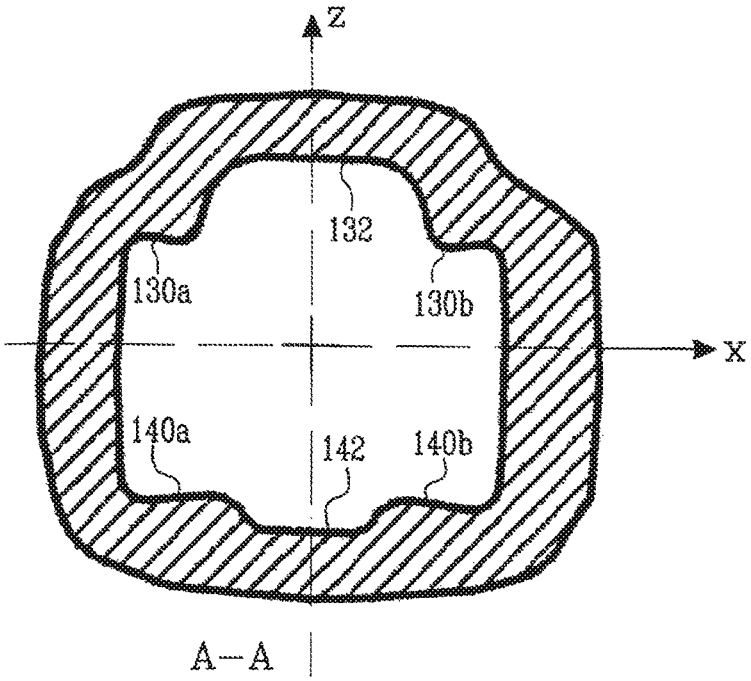
Figure 6B:
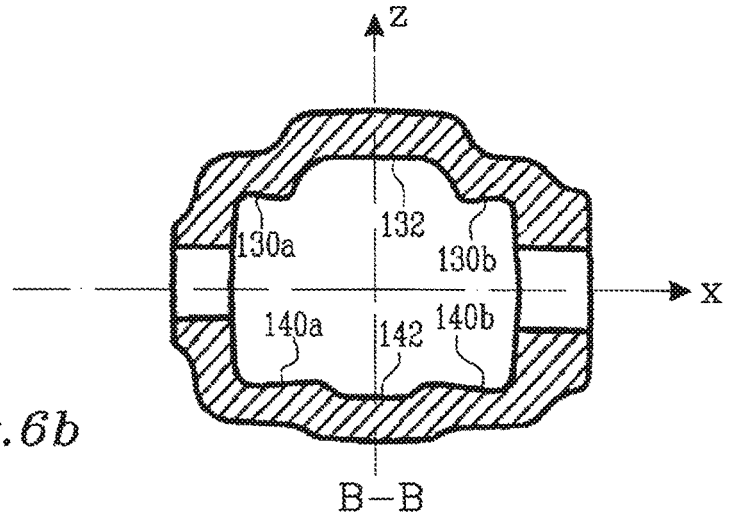
" and FIGS. 6*b* to 6*d* are cross-sections of the tooth of FIG. 1, taken along the sections as depicted in FIG. 5"
Figure 6C:
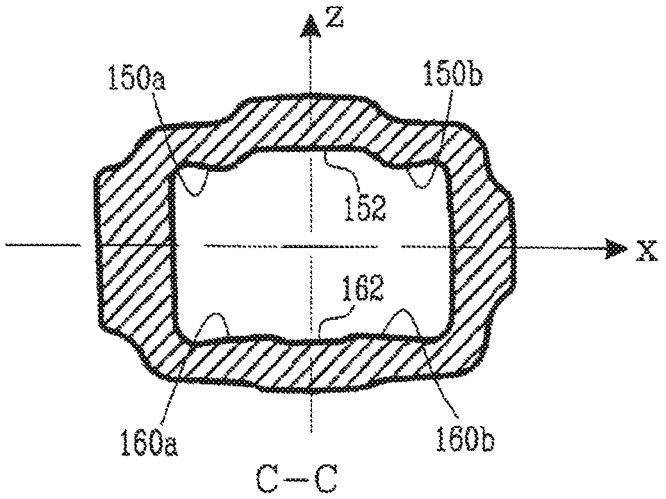

In the illustrated embodiment, as seen in FIG. 6", the pairs (x1, abs(z1)), (x2, abs(z2)), and (x3, abs(z3)) of the first inner wall are equal to the pairs (x1, abs(z1)), (x2, abs(z2)), and (x3, abs(z3)) of the second inner wall. This corresponds to a back portion being symmetrical about the XY plane, which may be desired for certain applications.

According to other embodiments, at least one out of the pairs (x1, abs(z1)); (x2, abs(z2)) and (x3, abs(z3)) may differ between the first inner wall and the second inner wall. This means that the back portion is asymmetrical about the XY plane, which may be desired for certain applications.

The above-mentioned description captures a contour comprising the inclined surfaces for providing a locking effect as described in the above, and being adapted to conform to a wear curve, resulting in the favorable behavior of the coupling after considerable wear, as also described in the above.

Advantageously, abs(z3)−abs(z1)>0.03×WI. This sets a relationship between the width of the first or second wall, and the height of the back divider region, which is advantageous in terms of force distribution and strength.

Advantageously, abs(z3)−abs(z1)<0.6×WI.

It will be understood, that with the above description, between (x1, z1) and (x2, z2), the contour generally follows a straight line z=k×abs(x)+K, where k and K are constants. The straight lines correspond to the essentially planar back contact surfaces.

The constant k=tan(beta or gamma), where beta or gamma is in line with what has been described in the above.

The minimum abs(z) points (at (x2, z2)) will be defined in the junctions between the essentially planar back contact surfaces and the back divider region.

It will be understood, that the above description of features and advantages made in relation to a tooth, are applicable also to the adaptor to which the tooth is to be fastened. Generally, all features described in relation to the tooth have a corresponding counterpart in the adaptor.

Referring to the embodiment of the drawings, there is an adaptor 2 for attachment of a tooth to the lip of a bucket of a working machine, such as an excavator or loader, the adaptor 2 comprising a connector portion 22 for arrangement to a bucket, and a nose portion 203 for arrangement in a corresponding cavity of a tooth 1, The nose portion 203 having a width in a horizontal direction H, which, when the adaptor arranged to a bucket, extend along the lip of thereof, and having a length extending in a longitudinal direction L from a connector end 204 at the connector portion 22 to a free end 205, and having an outer wall 202, The outer wall 202 comprising a first outer wall 206 and an externally opposed lower outer wall 207, and externally opposing side walls 208, interconnecting said upper and lower inner walls 206, 207, the nose portion 203 comprising a through hole 209 extending between said opposing side walls 208, for receiving a pin extending through the nose portion 203 for attachment of the tooth 1 to the adaptor 2, a first axis X being defined extending through the centre of through hole 209, a second axis Y extending along the nose portion 203 from the connector end 204 of the nose portion towards the free end 205 of the nose portion, and a third axis Z being orthogonal to said first and second axis X, Y, the three axes X, Y, Z thereby forming an orthogonal axes system, meeting at an origo, whereby each point of the inner wall 102 may be defined by Cartesian coordinates (x, y, z), wherein the nose portion 203 defines a back portion extending along the Y axis and being at least partially located between the plane spanned by the X and Z axes and the connector end 204 of the nose portion, a front portion extending along the Y axis, the front portion being located between the plane spanned by the X and Z axes and the free end 205 of the nose portion; a stepped portion, interconnecting the back portion and the front portion; in the back portion, the first and second outer walls 206, 207, each comprises a pair of essentially planar back contact surfaces 230*a, b*; 240*a,b*, each pair of back contact surfaces being symmetrical about, and facing towards, the plane spanned by the Z and Y axes, so as to form an angle beta, gamma with the plane spanned by the X and Y axes being less than 35 degrees, each pair of back contact surfaces 230*a, b*; 240 *a,b* being separated by a back divider region 232, 242, extending beyond the pair of first contact surfaces 230*a, b* in the Z direction away from the XY plane;

In the front portion, the first and second outer wall 206, 207 each comprises a pair of essentially planar front contact surfaces, being symmetrical about the plane spanned by the Z and Y axes, all contact surfaces forming an angle alfa less than 5 degrees with the Y axis, as seen in a XZ plane, the first and/or second front contact surfaces (210*a,b*; 220*a,b*) being located closer to the plane spanned by the X and Y axes than the corresponding back contact surfaces (230*a,b*; 240*a,b*), and the first and/or second outer wall (206, 207) of the stepped portion forming a slope wherein at least a portion of the outer wall approaches the XY plane towards the bottom wall, interconnecting said first and/or second back contact surfaces and the corresponding first and/or second front contact surface.

The embodiment of an adaptor illustrated in FIGS. 7 to 10, is moreover an adaptor, wherein in the back portion, for each point y along the x axis, the first and/or second outer wall (206, 207) displays a contour formed by points (x, z), the contour being symmetrical about the Z axis and having a width WI along the X axis, the contour being defined by the following:

in peripheral portions at abs (x) greater than or equal to 0.9×WI/2, a first maximum abs(z) is defined in a pair of points (x1, z1), for abs (x) less than abs (x1), abs(z) is diminishing until a minimum abs(z) is defined at (x2, z2), and for abs (x) less than abs(x2), abs(z) is increasing until a maximum abs(z) is defined at (x3, z3), wherein abs(z3)>abs(z1)>abs(z2), and the first back contact surfaces extend between the points (x1, z1) and (x2, z2), whereas the first back divider region extends between the points (x2, z2) (x2 negative) and (x2, z2) (x2 positive), including the maximum abs(z)(x3), z3), wherein abs(z3)−abs(z1)>0.03×WI.

In the illustrated embodiment, abs(z3)−abs(z1)<0.6×WI.

Advantageously, the angles beta and gamma are less than 35 degrees and greater than 5 degrees.

In the illustrated embodiment, as may be seen in FIG. 6' the angles beta and are substantially equal.

However, for other applications, the angles beta and gamma may advantageously be different.

Generally, the respective angles of inclination of the first and second back contact surfaces should be selected so as to accomplish the desired tightening effect, while still allowing for distribution of the vertical forces to which the tooth is subject during use. Moreover, the form of the wear curve as explained in the above, is taken into account.

The pairs of first and/or second back contact surfaces preferably extend substantially from the opposing side walls. This will enable as large separation of the pair of contact surfaces as possible, and move the load transfer between the tooth and the adaptor away from the plane spanned by the Z and Y axes.

Generally, sharp corners and edges are to be avoided when shaping the tooth cavity and the adaptor nose, since any such sharp portions will be prone to create load concentrations, and therefore risk becoming a weak part of the coupling.

Accordingly, and as illustrated by the embodiment of the Figures, although it is desired that the substantially flat pair of back contact surfaces 130*a, b*; 140*a, b* shall extend substantially from the opposing side walls 108, it is understood that a smoothly curved corner region between each side wall 108 and back contact surface 130*a, b*; 140*a, b* may be provided.

Advantageously, at least the first back contact surfaces may extend from the plane spanned by the Z and X axes and over a distance along the Y axis towards the open end of the tooth corresponding to at least the greatest radius r of the opposing holes. preferably at least 2r.

Moreover, the first back contact surfaces may extend forwardly of the plane spanned by the Z and X axes, for example about the distance r.

Each one out of the pair of the first and/or second back contact surfaces may extend at least over a distance along the X axis of 0.2×W, where W is the extension of the first/second inner wall along the X axis, as seen in a cross section parallel to the plane spanned by the X and Z axes.

In particular for symmetrical applications, and as in the illustrated embodiment, it is suitable that, throughout a majority of the back portion region the extension along the X axis of the first back contact surfaces 130*a, b* is substantially equal the extension along the X axis of the opposing second back contact surfaces 140*a,b*.

With the expression "a majority" is meant herein at least 50%, preferably at least 70%, most preferred at least 80%.

This provides for relatively wide second back contact surfaces, which are used to balance the vertical load applied to the outer first surface adjacent the tip of the tooth. Also, the relatively narrow first back contact surfaces enables the provision of a relatively wide first back divider region. Hence, the nose portion of the adaptor may be provided with a relatively wide back divider region, adding material to the adaptor and acting as a bar enhancing the strength of the nose portion on the first side thereof.

The above-mentioned features of the contact surfaces of the tooth, applies equally to the contact surfaces of the adaptor.

Figure 8:
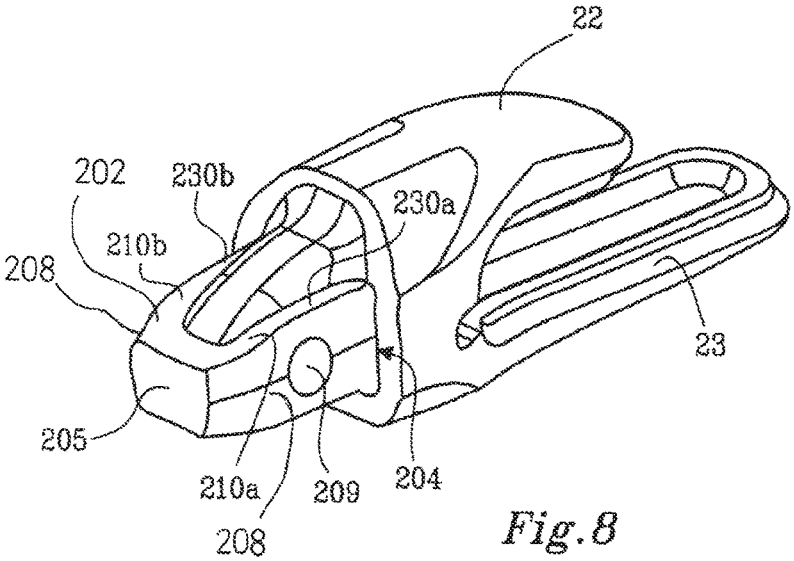
FIG. 8 is a perspective view of the adaptor of FIG. 1.
Figure 9:
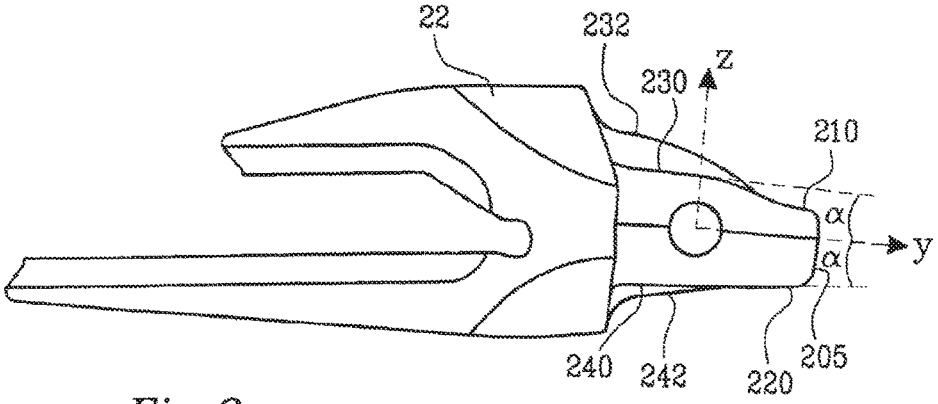
FIGS. 9 and 9' are side views of the adaptor of FIG. 1.
Figure 9:
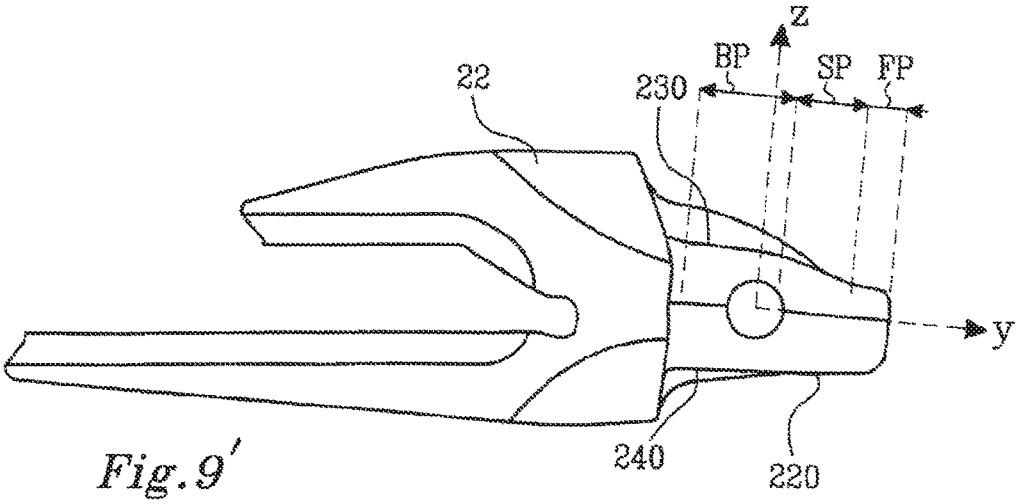
Figure 10:
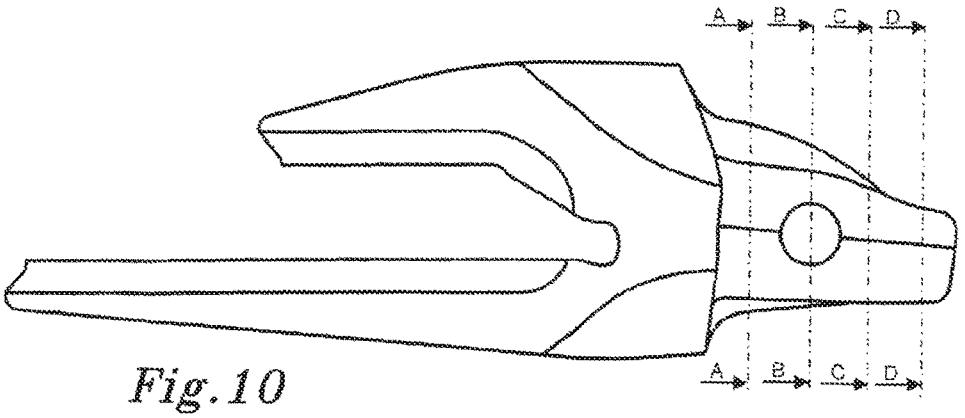
FIGS. 10*a* to 10*d* are cross-sections of the adaptor of FIG. 1, taken along the sections illustrated in FIG. 9"
Figure 10A:
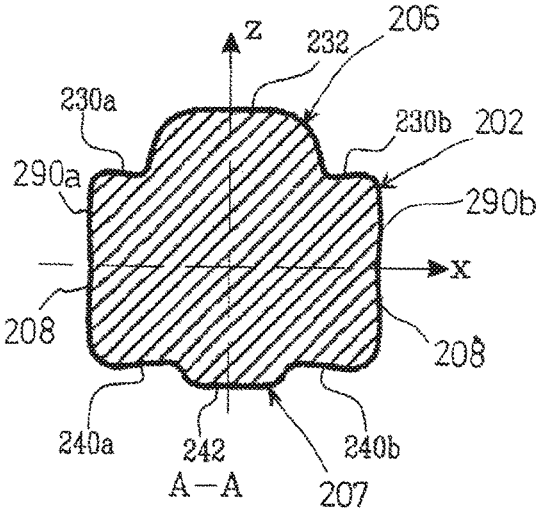
Figure 10B:
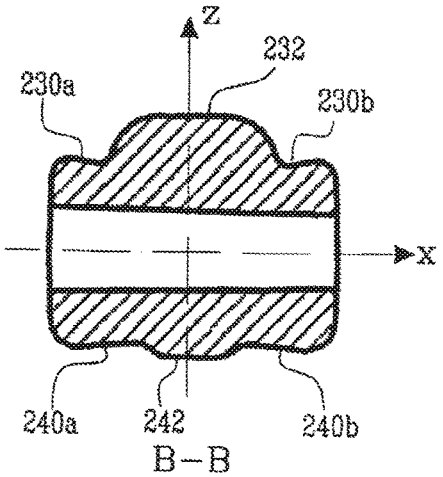
Figure 10C:
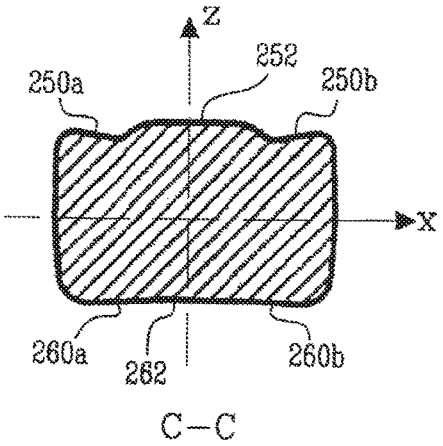
Figure 10D:
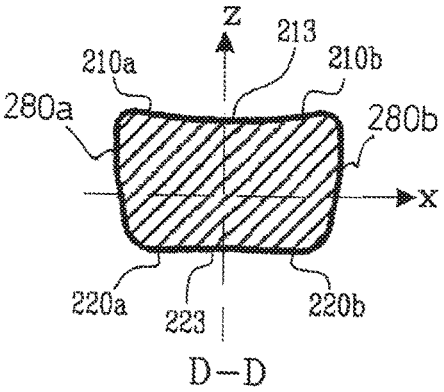
Figure 11:
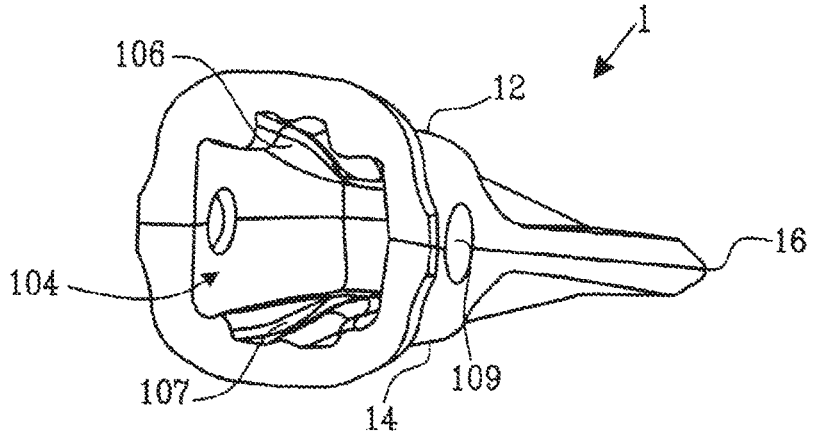
FIGS. 11 and 12 are perspective view of a second embodiment of a tooth.
Figure 12:
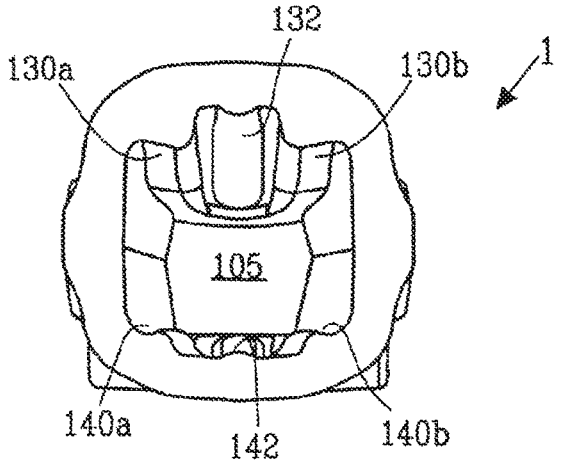
Figure 13:
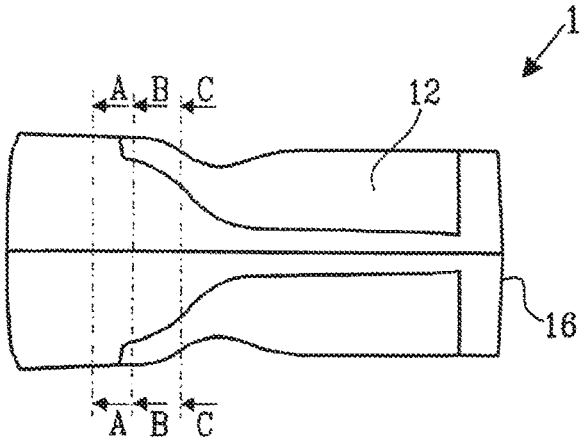
FIG. 13 is a top view of the tooth of FIG. 11.
Figure 14A:
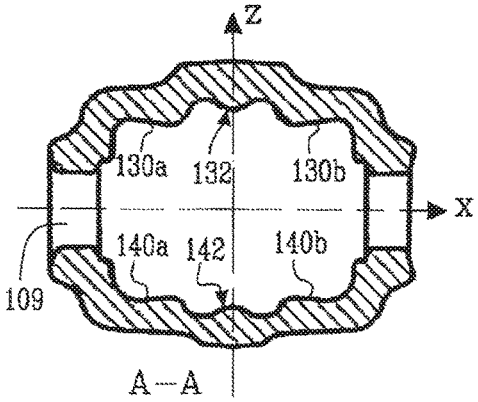
FIGS. 14 *a-c* are cross-sections of the tooth of FIG. 11, taken along the sections illustrated in FIG. 13.
Figure 14B:
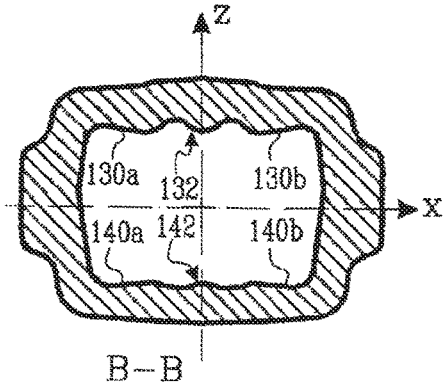
Figure 14C:
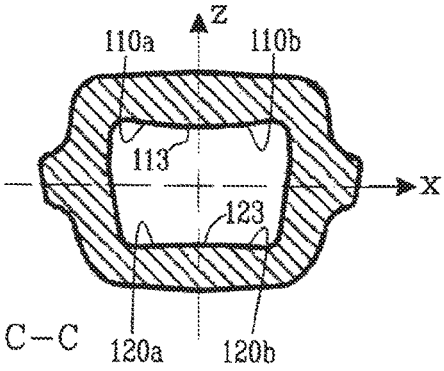
Figure 14:
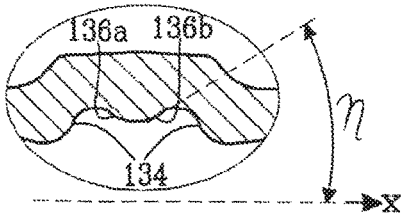
Figure 14:
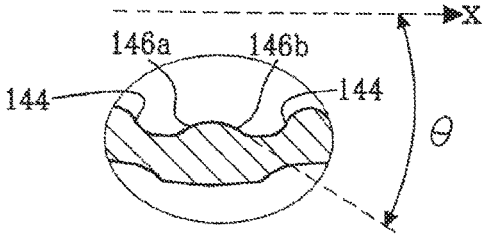
Figure 15:
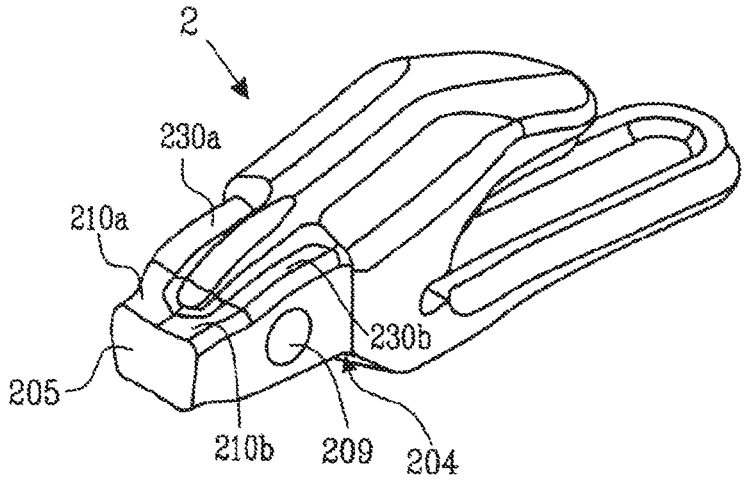
FIG. 15 is a perspective view of a second embodiment of the adaptor, intended for use with the tooth of FIG. 11.
Figure 16:
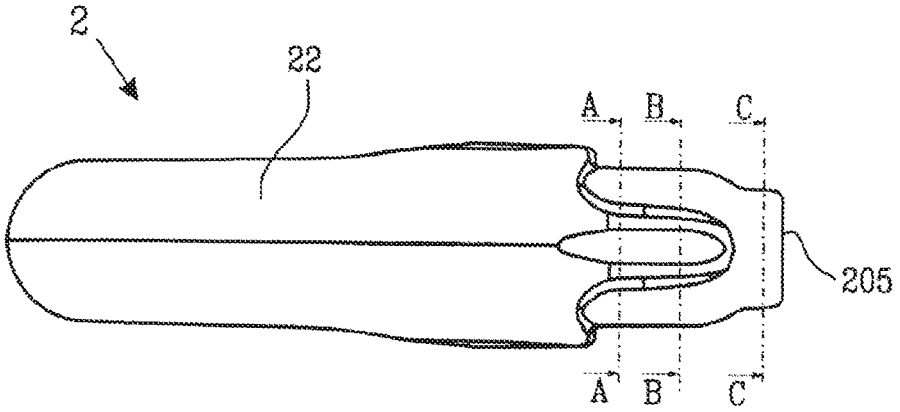
FIG. 16 is a top view of the adaptor of FIG. 15.
Figure 17A:
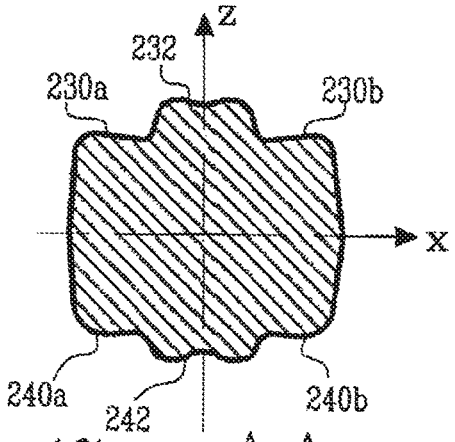
FIGS. 17*a* to 17*c* are cross-sections of the adaptor of FIG. 15, taken along the sections depicted in FIG. 16.
Figure 17B:
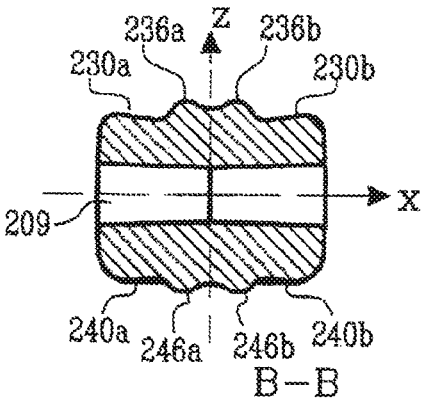
Figure 17C:
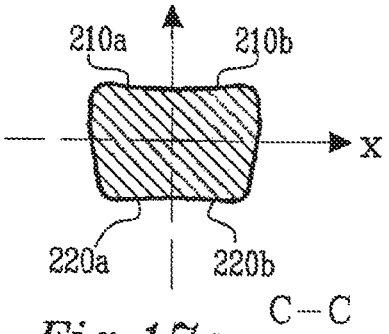
Figure 18:
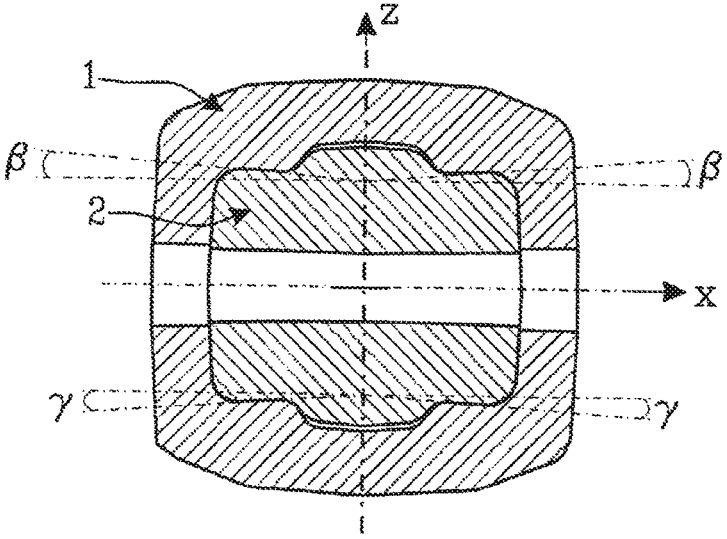
FIG. 18 is a cross-section of the assembled tooth and adaptor of FIG. 2*c*, taken along the X and Z axes.

The embodiment of an adaptor illustrated in the drawings, in particular in FIGS. 8-10, is an adaptor, wherein the angle (beta, gamma) is less than 25 degrees, preferably 10 to 20 degrees, preferably 12 to 17 degrees, most preferred about 15 degrees.

The angle gamma of the second outer wall 207 is substantially the same as the angle beta of the first outer wall 206, preferably 10 to 20 degrees.

The pairs of first and/or second back contact surfaces 230*a, b*; 240 *a, b* extend substantially from the opposing side walls 208, and preferably substantially to the respective back divider region 232, 242.

The back portion, comprising the first and second back contact surfaces 230*a, b*; 240*a, b* extends at least from the plane spanned by the Z and X axes, and over a distance along the Y axis, in a direction towards the connector end 204, corresponding to at least the greatest radius r of the opposing through hole 209.

The back portion, comprising the first and second back contact surfaces 230*a, b*; 240*a, b* extends also in front of the plane spanned by the Z and X axes and over a distance along the Y axis, in a direction towards the free end 205, corresponding to at least the greatest radius r of the through hole 209.

Each one out of the pair of the first and/or second back contact surfaces 230*a, b*; 240*a, b* extends at least over a distance along the X axis of 0.2×WI, where WI is the extension of the first/second outer wall 206, 207 along the X axis.

Throughout a majority of the back portion, the extension along the X axis of the first back contact surfaces 230*a, b* is less than the extension along the X axis of the opposing second back contact surfaces 240*a,b*.

Turning again to the tooth, the first and second back contact surfaces are each separated by a first and second back divider region, respectively. The first and/or second back divider region may comprise a pair of divider side surfaces, being symmetrical about, and facing towards, the ZY plane.

Advantageously, the first and/or second back divider region extend substantially from the first and/or second back contact surfaces, respectively.

As previously explained, sharp corners and edges should be avoided, which is why the divider side surfaces may be joined to the back contact surfaces via a smoothly curved junction region.

The extension of the first/second back divider region in the Z direction away from the XY plane may hence be determined by the extension of the respective pair of divider side surfaces in said direction.

In the embodiment illustrated in FIGS. 1-10, the first and second back divider region 132, 142 each comprises a pair of divider side surfaces 134, being symmetrical about, and facing towards, the ZY plane. The pairs of divider side surfaces 134, 144 extend substantially from the first and/or second back contact surfaces 130*a, b*, 140 *a,b*, respectively.

The back divider region and hence the divider side surfaces may form part of a larger portion of the contour formed the inner wall, such as a ridge.

In the embodiment illustrated in FIGS. 1-10, a first ridge is formed in the first wall 106, extending along the Y axis essentially from the open end 104 of the cavity. Between the first back contact surfaces 130*a,b*, the ridge forms the first back divider region 132 comprising the pair of first divider side surfaces 134.

The ridge extends beyond the first back contact surfaces 130*a,b* along the Y axis, and into an stepped portion, which will be described later on in this application.

Similarly, in the embodiment illustrated in the Figures, a second ridge is formed in the second wall 107, extending along the Y axis essentially from the open end 104 of the cavity. Between the second back contact surfaces 140*a,b*, the ridge forms the second back divider region 142 comprising the pair of second divider side surfaces 144.

For symmetrical applications, such as e.g. for excavators, and as depicted in the illustrated embodiments, over a majority of the first back and back portions, the maximum extension of the first back divider region in the Z direction away from the XY plane is substantially equal to the maximum extension of the second back divider region in the Z direction away from the XY plane.

As explained in the above, this configuration is favourable for applications where, during use, vertical forces will be applied relatively symmetrically to the first outer surface and to the second outer surface of the tooth.

Advantageously, the extension of the first and/or second back divider region in the Z direction away from the XY plane diminishes from a maximum adjacent the open end of the cavity along the Y axis towards the bottom end of the cavity.

With the extension of the back divider region in the Z direction diminishing towards the bottom end of the cavity, it is possible to design a tooth having an outer surface narrowing towards the tip thereof, as is desired for ensuring sufficient penetration of the tooth when in use. Moreover, it will be understood that the advantages with the back divider region separating the first and second back contact surfaces are most pronounced in the first and second back portion of the cavity of the tooth.

The divider side surfaces of the cavity are generally not intended to be in contact with the adaptor's nose portion. Accordingly, some variation of the shape of the divider side surfaces may be tolerated, as long as the tooth fits on the intended adaptor's nose portion.

However, generally, it is desired that the divider side surfaces form curved or gently cured portions, again avoiding sharp edges or corners.

Preferably, each one of the pair of divider side surfaces may comprise a steeper region wherein, a tangent to the side surface in the XZ plane forms an angle of more than 45 degrees with the X axis, followed by a flatter region, wherein a tangent to the side surface in the XZ plane forms an angle of less than 45 degrees with the X axis.

Hence, the back divider region will increase in distance from the contact surfaces, along the Z-axis, with a fast increase rate adjacent the contact surfaces, and slower or not at all in a region adjacent the Z axis.

Hence, the steeper region of each one of the pair of divider side surfaces has a greater extension along the Z axis than along the X axis. Since this surface is not intended to take up any vertical loads applied substantially parallel to the Z axis, such a configuration is suitable.

However, to provide for sufficient strength while avoiding load concentrations in the tooth and/or adaptor, it is desirable that the steeper region of each one of the pair of divider side surfaces, along a majority of the steeper region's length along the X axis, a tangent to the side surface in the XZ plane forms an angle of more than 45 degrees, less than 80 degrees with the X axis towards the Z axis.

In the flatter region of each one of the pair of divider side surfaces, along a majority of its length along the X axis, a tangent to the divider side surface in the XZ plane may form an angle of less the 5 degrees with the X axis towards the Z axis.

Hence, the flatter region may, at least along a portion thereof, be essentially parallel to the X axis.

In the illustrated embodiments, with particular reference to FIG. 6''', each one out of the pairs of side surfaces 134, 144 of both the first back divider 132 and the second back divider 142 comprise a steeper region 134', 144' wherein, a tangent to the side surface in the XZ plane forms an angle of more than 45 degrees with the X axis, followed by a flatter region 134", 144" wherein a tangent to the side surface in the XZ plane forms an angle of less than 45 degrees with the X axis.

Hence, the steeper region of each one of the pair of divider side surfaces 134', 144' has a greater extension along the Z axis than along the X axis.

Moreover, along a majority of the steeper region's 134' length along the X axis, a tangent to the side surface in the XZ plane forms an angle of more than 45 degrees, and less than 80 degrees with the X axis towards the Z axis.

In the flatter region 134", 144" of each one of the pair of divider side surfaces, along a majority of its length along the X axis, a tangent to the divider side surface in the XZ plane may form an angle of less the 5 degrees with the X axis towards the Z axis.

Hence, the flatter region is, at least along the majority thereof, essentially parallel to the X axis.

The above-described features relating to the divider region of a tooth, applies equally to a divider region of a nose portion of an adaptor. However, the features are naturally inverted, such that the ridge forming a divider region described in the above, corresponds to a protruding rib formed by the nose portion.

The embodiment of an adaptor, illustrated in FIGS. 8 to 10, is an adaptor wherein the first and/or second back divider region 232, 242 comprises a pair of divider side surfaces 234, 244, being symmetrical about, and facing away from, the ZY plane.

The pair of divider side surfaces 234, 244 of the first and/or second back divider region 232, 242 extend substantially from the first and/or second back contact surfaces 230*a,b*, 240*a,b*, respectively.

The extension of the first and/or second back divider region 232, 242 in the Z direction away from the XY plane is determined by the extension of the corresponding pair of divider side surfaces 234, 244 in said direction.

The extension of the first and/or second back divider region 232, 242 in the Z direction away from the XY plane has a maximum adjacent the connector end 204 of the nose portion and is diminishing along the Y axis towards the free end of the nose portion 205.

For the first and/or second divider region, each one of the pair of divider side surfaces 234, 244 comprises a steeper region 234', 244' wherein a tangent to the side surface in the XZ plane forms an angle of more than 45 degrees with the X axis, followed by a flatter region 234', 244'" wherein a tangent to the side surface in the XZ plane forms an angle of less than 45 degrees with the X axis.

Said steeper region 234', 244' of each one of the pair of divider side surfaces 234, 244 has a greater extension along the Z axis than along the X axis.

For the first and/or second back divider region, along a majority of the steeper region's 234', 244' length along the X axis, a tangent to the side surface in the XZ plane forms an angle of more than 45 degrees and less than 80 degrees with the X axis towards the Z axis.

For the first and/or second back divider region, along a majority of the flatter region's 234", 244" length along the X axis, a tangent to the divider side surface in the XZ plane forms an angle of less the 5 degrees with the X axis towards the Z axis.

When the tooth and the adaptor are assembled, contact is intended to take place between the contact surfaces of the tooth and the adaptor, respectively, but not at the back divider region. Therefore, the relative sizes of the features should be adjusted such that a gap is obtained between the divider regions of the tooth and the adaptor, when the contact surfaces of the tooth and the adaptor is in contact.

In the first and second front portions, the essentially planar contact surfaces may advantageously be arranged similarly to the arrangement in the first and back portions.

Accordingly, in the front portion, the first inner wall may comprise a pair of essentially planar first front contact surfaces, being symmetrical about, and facing away from, the plane spanned by the Z and Y axes, so as to form an angle delta with the plane spanned by the X and Y axes being less than 35 degrees.

Moreover, in the front portion, the second inner wall may comprise a pair of essentially planar second front contact surfaces, being symmetrical about, and facing away from, the plane spanned by the Z and Y axes, so as to form an angle epsilon with the plane spanned by the X and Y axes being less than 35 degrees.

Advantageously, the angle delta and/or the angle epsilon is 10 to 20 degrees, preferably 12 to 17 degrees, most preferred about 15 degrees.

Preferably, the angle delta=angle beta, and angle epsilon=angle gamma. Hence, the first front and back contact surfaces will extend in parallel to each other, and the second back and front contact surfaces will extend in parallel to each other.

In the embodiment illustrated in FIGS. 1 to 7, the front portion FP, the first inner wall 106 comprises a pair of essentially planar first front contact surfaces 110*a, b*, being symmetrical about, and facing away from, the plane spanned by the Z and Y axes, forming an angle delta with the plane spanned by the X and Y axes being less than 35 degrees.

Similarly, in the front portion FP, the second inner wall 107 comprises a pair of essentially planar second front contact surfaces 120*a, b*, being symmetrical about, and facing away from, the plane spanned by the Z and Y axes, so as to form an angle epsilon with the plane spanned by the X and Y axes being less than 35 degrees.

Advantageously, the angle delta and/or the angle epsilon are less than 25 degrees, preferably 10 to 20 degrees, preferably 12 to 17 degrees, most preferred about 15 degrees.

As mentioned in the above, the first front and back contact surfaces may be arranged in parallel planes, the planes being in a translated relationship, such that the first front contact surfaces are located closer to the plane spanned by the Y and X axes, than the first back contact surfaces.

In the first front portion and/or second front portion, the pair of first/second front contact surfaces may be separated by a first/second front divider region where the inner first/second wall extend beyond the pair of first/second front contact surfaces in the Z direction away from the XY plane, at least along a divided portion of the extension of the first/second front contact surfaces along the Y axis.

It will be understood, that a separation of the contact surfaces by a front divider region in the front portions of the cavity will provide essentially the same advantages as in the back portions of the cavity. However, due to the force distribution, the advantages with providing a divider region in the front of the cavity are not as pronounced as in the back. Moreover, since the need for penetration of the tooth requires that its outer shape narrows towards the tip thereof, the provision of a front divider region must be balanced with the room available therefore.

Therefore, although the pair of front contact surfaces may advantageously be separated by a front divider region, this is not necessary to achieve some of the advantages previously mentioned herein.

Alternatively or in addition to the above, in the first front portion and/or the second front portion, the pair of first/second front contact surfaces may be connected by a first/second front connecting region where the inner first/second wall extend in the Z direction towards the XY plane the, at least along a connected portion of the extension of the first/second front contact surfaces along the Y axis.

Hence, a connection region is directed towards the XY plane, which is in contrast to the divider region being directed away from the XY plane. The connection region is however not to have an extension along the Z axis being comparable to that of the divider regions. Instead, the connection region is to form a smooth, curved connection between the pair of front contact surfaces.

In the embodiment illustrated in FIGS. 1 to 10, the pair of first and second front contact surfaces 110*a, b*; 120 *a,b* extend along the Y axis from the bottom end 105 of the cavity. In a first connected portion, extending from said bottom end, the respective pairs of first/second front contact surfaces 110*a, b*; 120 *a,b* are connected by a first/second front connecting region 113, 123 respectively. In the front connecting regions 113, 123, the inner first/second wall 106, 107 interconnects the pair of first/second contact surfaces, and extends towards the XY plane.

The pairs of first and second front contact surfaces may in other embodiments also extend beyond the connected portion, further away from the bottom end of the cavity along the Y axis. Here, the connected portion may be followed by a divided portion, where the pair of first/second front contact surfaces are separated by a first/second front divider region, respectively. In the first/second front divider regions, the inner first/second wall extend beyond the pair of first/second front contact surfaces in the Z direction away from the XY plane.

In the illustrated embodiment, the connected portion comprising the first/second front contact surfaces 110, 120 and the connecting region 113, 123 there between forms part of the structure forming a ledge as previously described, and which forms a continued structure with the first/second back contact surfaces in the exemplified embodiment.

Generally, any such connected portion should be located closer to the bottom end of the cavity than a divided portion, if present.

Figure 6D:
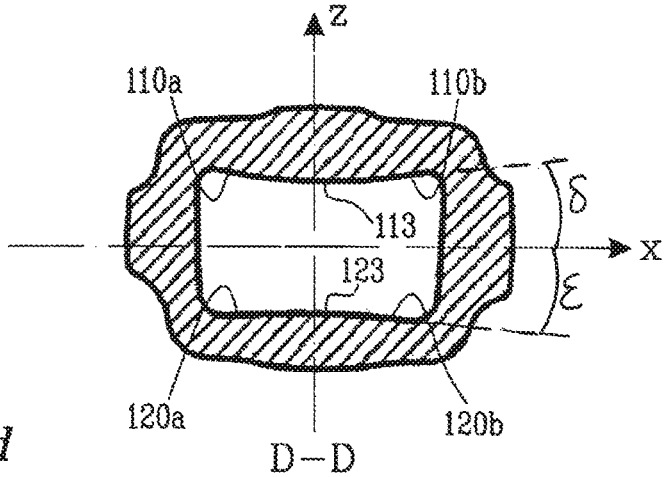
Figure 6:
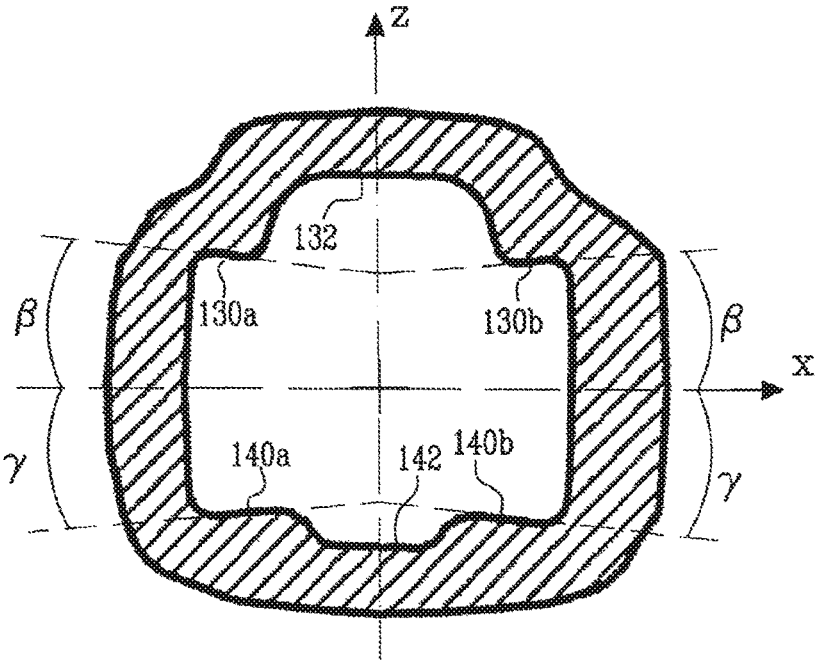
Figure 6:
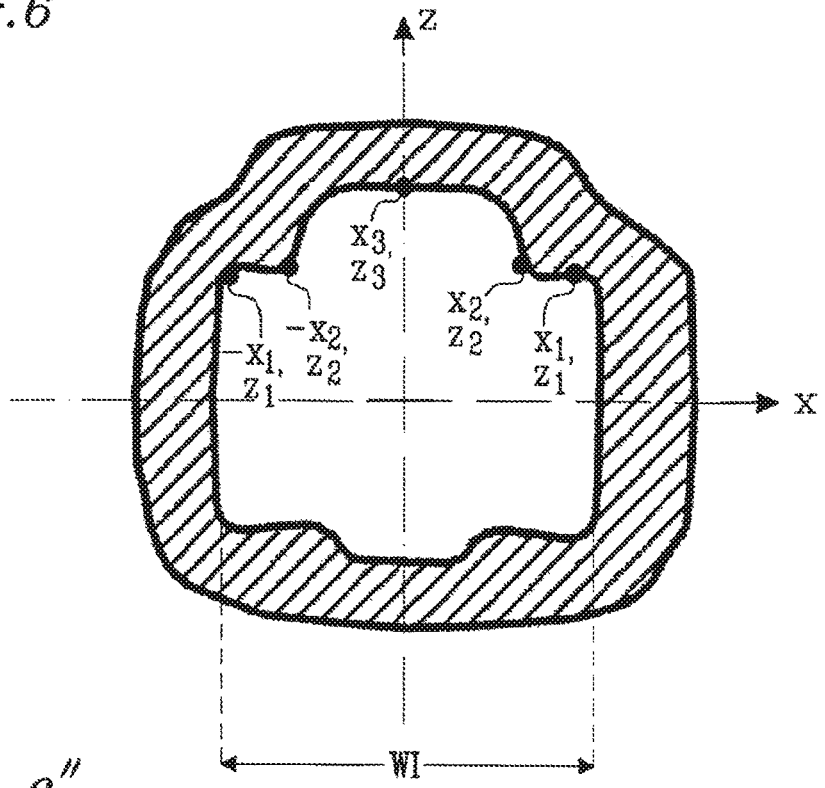
Figure 6:
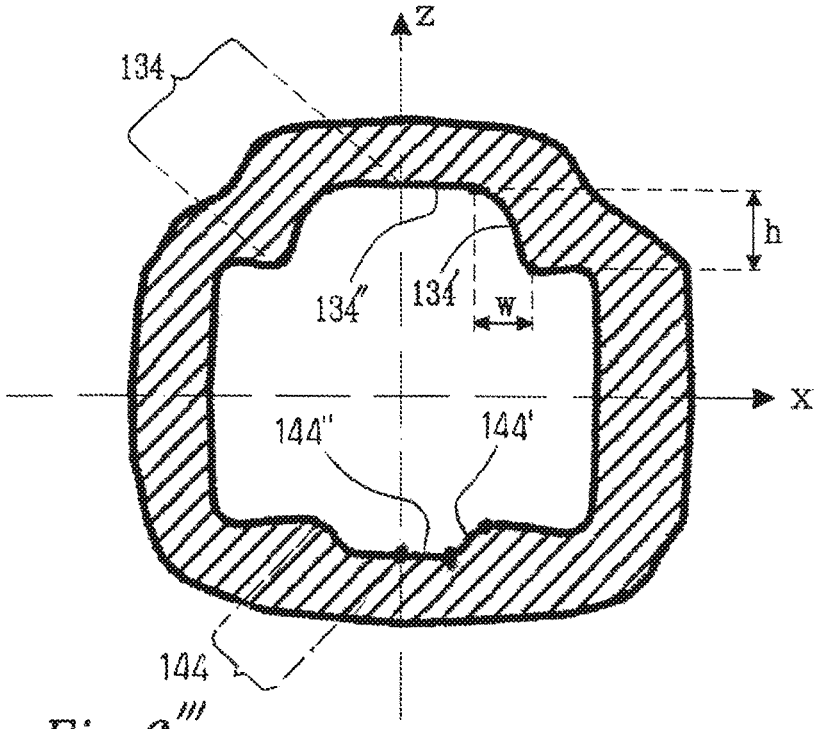
Figure 7:
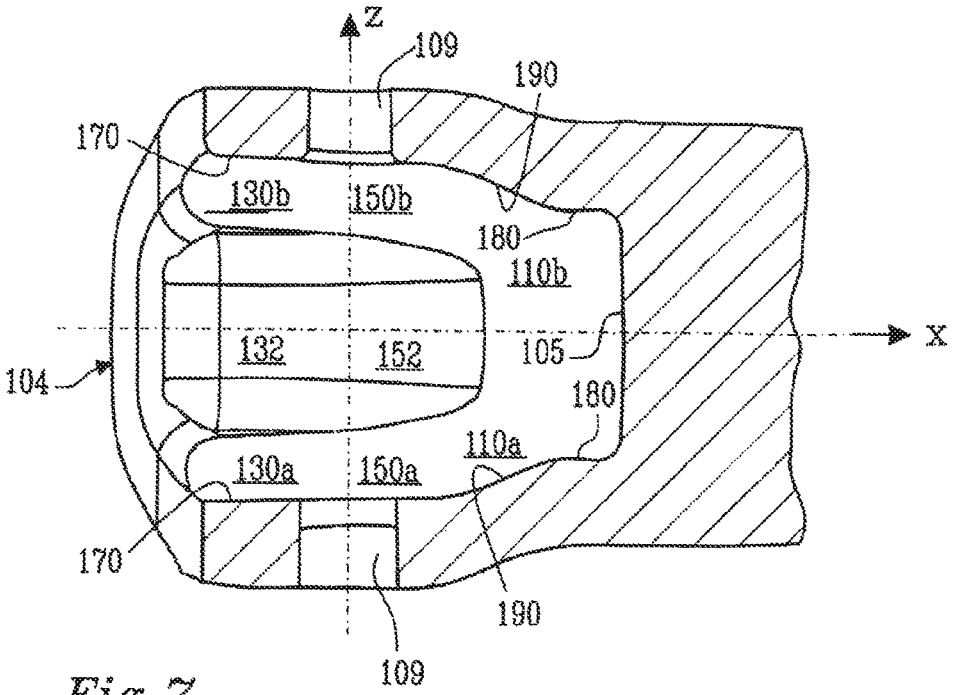
FIG. 7 is a cross sectional view of the tooth of FIG. 1, taken along the X and Y axes.

In the illustrated embodiment, an end portion of the cavity, towards the bottom end may form an approximately four sided shape, which may be seen in FIG. 6*d*, comprising the opposing side walls, the pair of first contact surfaces 110*a,b* with their connected region 113, and the pair of second contact surfaces 120*a,b* with their connected region 123.

In the illustrated embodiment, the first and second front contact surfaces 110*a,b*, 120 *a,b* extend substantially from the bottom end 105 of the cavity 103.

However, embodiments may be envisaged where the length of the connected portion of the first inner wall need not be similar to the length of the connected portion of the second inner wall.

Accordingly, by the definition of terms, it may be considered that the second back contact surfaces 140 extend from the plane spanned by the X and Z axes, and backwards towards the open end 104 of the cavity, almost all the way to the cavity. As may be seen in FIG. 5, the planar second back contact surfaces 140 extend almost to the open end 104, the ledge forming the contact surfaces deviating from the respective planes only at an outermost region adjacent the open end 104.

However, that the surfaces are defined herein as "contact surfaces" does not necessitate that contact will indeed take place over the entire surfaces in practical circumstances, when the tooth 1 is arranged on a corresponding adaptor portion 2. Indeed, the surfaces most likely for actual contact to occur are the second back contact surfaces 140 and the first front contact surfaces 110, at least when considering a down vertical load being applied to the tip of the tooth 1.

The above-mentioned features described in connection with a tooth, is naturally equally applicable for the nose portion of an adaptor. With reference to the embodiment of the drawings, FIGS. 8-10 illustrates an embodiment wherein, in the front portion, the first and/or second inner wall 206,207 comprises a pair of essentially planar first and/or second front contact surfaces 210*a, b*, 220*a,b*, being symmetrical about, and facing towards, the plane spanned by the Z and Y axes, so as to form an angle delta with the plane spanned by the X and Y axes being less than 35 degrees.

In the front portion region FP, the second inner wall 207 comprises a pair of essentially planar second front contact surfaces 220*a, b*, being symmetrical about, and facing away from, the plane spanned by the Z and Y axes, so as to form an angle epsilon with the plane spanned by the X and Y axes being less than 35 degrees.

The angle delta and/or the angle epsilon is less than 25 degrees, preferably 10 to 20 degrees, preferably 12 to 17 degrees, most preferred about 15 degrees, preferably the angle delta=angle beta, and angle epsilon=angle gamma.

In the front portion, there is an interconnected portion wherein at least one, preferably both, of the pairs of first or second front contact surfaces 210*a, b*; 220*a*, bare connected by a first or second front connecting region 213, 223 where the outer first/second wall 206,207 extend in the Z direction along or towards the XY plane.

The connected portion is located closer to the free end 205 of the nose portion than said divided portion.

Turning again to the description of the tooth, the stepped portion of the cavity extends between the back portion and the front portion of the cavity. By terms of definition, the back portion of the cavity is a portion along the length of the Y axis within which both the first and the second inner walls display a pair of first/second back contact surfaces, separated by a back divider region and as described in the above. The front portion of the cavity is a portion along the length at least one of the Y axis within which both the first and the second inner walls display a pair of first or second front contact surfaces, arranged symmetrically about the Z and Y axes.

The stepped portion of the cavity interconnects the back portion and the front portion. One or more of the essentially planar contact surfaces may optionally extend from the back or front portion into the stepped portion of the cavity.

However, the stepped portion shall interconnect at least the first back contact surfaces and the first front contact surfaces which are located in different planes. To this end, the stepped portion comprises a slope.

In the stepped portion, the first inner wall may advantageously merge with the first back contact surfaces, the first back divider region, and with the first front contact surfaces.

Advantageously, the stepped portion comprises a slope forming an S-shape so as to merge with the said surfaces.

To this end, the stepped portion may form a pair of sloping first surfaces, being symmetrical about, and facing away from, the plane spanned by the Z and Y axes, extending between and merging with the first back contact surfaces and the first front contact surfaces.

Also, the stepped portion may form an intermediate divider region, extending between the intermediate first back surfaces, and moreover extending between and merging with the first back divider region and the first front divider region. Although the intermediate divider region may advantageously have a sloping or stepped shape, in order to follow a general, narrowing contour of the tooth, this is not necessary. The the back contact surfaces, meaning that the surfaces interconnecting these contact surfaces must be sloped—this is the sloping first surfaces mentioned in the above. However, since the purpose of the intermediate divider region in the stepped portion of the tooth is to give room for a corresponding protruding divider region of the adaptor, which in turn provides strength to the adaptor, the divider region could be arranged having other shapes in the stepped region. Accordingly, the divider region in the stepped portion of the cavity is referred to as an "intermediate" divider region rather than a "sloping" divider region—as there is indeed no requirement that this particular region shall be sloping.

The first back divider region, the intermediate divider region, and any first front divider region may hence form a continuous divider area, the maximum extension of which in the Z direction away from the XY plane is diminishing from a maximum adjacent the open end of the cavity along the Y axis towards the bottom end of the cavity.

In the embodiment illustrated in FIGS. 1-10, the first inner wall 106 of the cavity 103 forms such a slope between the first back contact surfaces 130*a, b* and the first front contact surfaces 110*a, b*.

The first inner wall 106 of the stepped portion merges with the first back contact surfaces 130*a, b*, the first back divider region 132, and with the first front contact surfaces 110*a, b*. To this end, the stepped portion forms a pair of intermediate first back surfaces 150*a, b*, being symmetrical about, and facing away from, the plane spanned by the Z and Y axes, extending between and merging with the first back contact surfaces 130*a, b* and the first front contact surfaces 110 *a, b*.

Also, the stepped portion forms a intermediate divider region 152, extending between the intermediate first back surfaces 150*a,b*, and moreover extending between and merging with the first back divider region 132 and the first front divider region 112

Accordingly, the first back contact surfaces 130*a,b*, the first back surfaces 150*a,b*, of the stepped portion, and the first front contact surfaces 110 together form a ledge as previously described. The ledge being generally U-shaped and extending along the side walls 108 and the bottom wall 105 of the cavity 103.

The first back divider region 132 and, the intermediate divider region 152 and the front divider region 112, form a continuous divider area. The extension of the continuous divider area in the Z direction away from the XY plane is diminishing from a maximum adjacent the open end 104 of the cavity along the Y axis towards the bottom end of the cavity 105, where the continuous divider area merges with the first front contact surfaces 110 and the connecting surface.

Accordingly, the continuous divider area is equal to the ridge as previously described, extending in the first inner wall 106, in a direction along the Y-axis. The ridge is partially surrounded by the ledge as described in the above.

In the illustrated embodiment, the second side wall 107 is substantially symmetrical to the first inner wall, about the XY plane. Accordingly, a similar continuous divider area is formed in the second inner wall 107, extending in a direction along the Y-axis, and partially surrounded by a ledge.

The above-mentioned features apply similarly to the nose portion of an adaptor. With reference to the drawings, FIGS. 7 to 10, there is described an adaptor wherein, in the stepped portion, the first inner wall merges with the first back contact surfaces 230*a, b*, the first back divider region 232, and with the first front contact surfaces 210*a, b*, forming said slope 250 *b* at least between the first back contact surfaces and the first front contact surfaces 210*a, b*.

The second outer wall 207 in the stepped portion forms a slope 260*a,b* approaching the plane spanned by the X and Y axis while extending towards the free end 205, interconnecting said second back contact surfaces 240*a,b* and said second front contact surface 220*a,b*.

In the stepped portion, the first and/or second outer wall 206, 207 merges with the first and/or second back contact surfaces 230*a, b*, 240*a,b*, the first and/or second back divider region 232, 242, and with the first and/or second front contact surface(s) 210*a, b*, 220*a,b*, forming said slope(s) 250*a,b*, 260*a,b* at least between the first and/or second back contact surfaces 230*a,b*; 240*a,b* and the first and/or second front contact surfaces 210*a, b*; 220*a,b*.

The slope is curved, forming an S-shape.

The first front and back contact surfaces 210*a,b*, 230*a,b*; 220*a,b*; 240 *a,b*, being connected by said slope 250*a,b*; 260*a,b*, are arranged such that, if they were interconnected by a straight line, such a line would form an angle of more than 10 degrees, preferably more than 20 degrees with the plane spanned by the X and Y axes.

The stepped portion, the first and/or second inner wall 206, 207 forms a pair of sloping first surfaces 250*a, b*; 260 *a,b*, being symmetrical about the plane spanned by the Z and Y axes, extending between and merging with the first and/or second back contact surfaces 230*a, b*; 240 *a,b* and the corresponding first and/or second front contact surfaces 210 *a, b*, 220 *a,b*.

In the stepped portion, the first and/or second outer surface 206, 207 forms an intermediate divider region, extending between the first or second sloping back surfaces 250*a,b*, and moreover extending between and merging with the first or second back divider region 232, 242 and the first or second front divider region 212,222.

The first and/or second back divider region 232, 242, and the corresponding intermediate divider region 252, 262, form a continuous divider region, the maximum extension of which in the Z direction away from the XY plane is diminishing from a maximum adjacent the connector end 204 of the nose portion along the Y axis towards the free end of the nose portion 205.

As has been discussed in the above, the divider regions contribute to several advantages with the wear connection. The separation of the contact surfaces contributes to a more even force distribution in the wall surrounding the cavity of the tooth. Accordingly, less material is required to form a sufficiently strong tooth, and a tooth having a relatively thin wall around the cavity may be formed.

When considering the divider regions of the nose portion of the adaptor, the reverse will be true. In the divider region(s) of the adaptor, more material is added, contributing to the strength of the adaptor. Accordingly, the arrangement with the contact surfaces and the divider region(s) contributes to an advantageous distribution between tooth cavity walls and adaptor portion of the volume available for the connection between tooth and adaptor.

Advantageously, the divider regions (back, intermediate, front) may form a continuous divider region extending along the tooth. In the illustrated embodiment, such a continuous divider region forms a structure, namely a ridge.

The continuous divider region may advantageously be shaped so as to follow the general, narrowing space of the tooth, meaning that the height of the continuous divider region (Z direction) may preferably diminish towards the bottom end of the cavity.

Advantageously, a first and/or second continuous divider region may extend throughout the back portion, and forwardly of the plane spanned by the X and Z axes, at least to a distance r in front of the plane spanned by the X and Z axes, where r is the radius of the through hole 109, preferably 1.5 r.

Hence, the continuous divider region will extend over the through holes of the tooth 1 (or the adaptor 2) and, for the adaptor 2, contribute to the strength of the adaptor 2 over the region of the through hole 209.

Advantageously, the height (z-direction) of the continuous divider region may diminish softly, preferably following a radius R.

As the continuous divider region diminishes in size and width along the Z axis, it is the steeper regions of the divider side surfaces which diminishes in height and width (Z and X). The flatter region of the divider side surfaces remains essentially constant, interconnecting the steeper regions, until eventually merging into the front contact surface.

As discussed in the above, the first and second inner walls of the cavity will be effective to transfer vertical loads applied to the tip of the tooth when in action. However, the tip of the tooth may also be subject to horizontal loads.

Such horizontal loads will generally be transferred to the adaptor portion via the opposed side surfaces of the cavity, and the opposed side surfaces of the adaptor. Again, as for the first/second inner walls, the side surfaces will work in pairs including a front side surface extending through the first and front portions, and a back side surface extending through the first and back portions, said front and back side surfaces being located on opposite sides of the plane spanned by the Z and Y axes.

As for the first/second contact surfaces, if considering the load distribution, it is preferred that the front side surfaces and the back side surfaces are parallel to the plane spanned by the Z and Y axes. However, for enabling assembly of the tooth and the adaptor portion, a slight deviation from this must be allowed.

By terms of definition, all back contact surfaces (side, first, or second) must have an extension in the back portion of the cavity. However, the back contact surfaces need not be confined to the back portion of the cavity but may continue their extension over the plane spanned by the X and Z axes. In this case, the back contact surface will have one area portion extending behind the plane spanned by the X and Z axes, and one area portion extending forward of the plane spanned by the X and Z axes.

Returning now to the embodiment depicted in FIGS. 1 to 10, in the back portion BP the opposing side surfaces 108 comprises opposing, essentially planar, back side contact surfaces 170*a,b*. In the front portion, the opposing side surfaces 108 comprises opposing, essentially planar front side contact surfaces 180*a,b*.

The opposing back side contact surfaces 170*a,b* extend from the plane spanned by the X and Z axes, in a direction towards the open end 105 of the cavity along the Y axis, over a distance r where r is the maximum radius of the through holes 109.

Moreover, the back side contact surfaces 170*a,b* extend over a distance in the direction of the Z axis corresponding to at least 3 r, where r is the maximum radius of the through holes 109.

The extension of the back side contact surfaces 170*a,b* along the Y axis could, but does not necessarily correspond to the extension of the back portion BP along the Y axis.

In the illustrated embodiment, the back side contact surfaces 170*a,b* and the front side contact surfaces 180*a,b* are located in the same planes. Accordingly, the inner side walls 108 are formed as essentially planar surfaces. Other embodiments are conceivable, where the front side contact surfaces 180*a,b* are located in different planes than the back side contact surfaces 170*a,b*. In this case, the front side contact surfaces 180*a,b*, and the back side contact surfaces 170*a,b* may be interconnected by intermediate side surfaces, which may preferably be curved.

The opposing front side contact surfaces 180*a,b* may extend substantially from the bottom end 105 of the cavity.

The pair of front side surfaces and the pair of back side surfaces form an angle with the YZ plane being less than 2 degrees.

The above-mentioned features relating to the side surfaces of the tooth are equally applicable to the adaptor. With reference to the drawings there is described an adaptor, wherein, at least in the back portion, the opposing side surfaces 208 comprises opposing, essentially planar, back side contact surfaces 270*a,b*, and at least in the front portion, the opposing side surfaces 208 comprises opposing, essentially planar front side contact surfaces 280*a,b*.

The back side contact surfaces 270*a,b* and the front side contact surfaces a,b, are located in the same planes, respectively.

When the tooth and the adaptor are interconnected, the respective front and back side contact surfaces 170*a,b*, 270*a,b*, 190*a,b*, 290*a,b* are intended to contact each other. However, no contact is to take place in any sloping intermediate side regions. Accordingly, the tooth and the adaptor may be designed in relation to each other such that when the respective front and back side surfaces are in contact with each other, there is no contact along the sloped side regions.

Having discussed vertical forces and transversal forces that may affect the tip of the tooth, when in working condition, longitudinal forces will now briefly be mentioned. Longitudinal forces may act on the tip of the tooth and generally along a longitudinal direction thereof. Such forces are primarily to be taken up by a contact surface in the form of an inner bottom wall of the cavity.

As illustrated in FIG. 2*c*, the inner bottom wall 105 of the cavity will hence contact the tip portion 205 of the adaptor, and forces may be transmitted between the surfaces thereof.

With reference to the drawings, FIGS. 7 to 10, there is disclosed an embodiment of an adaptor wherein, at least in the back portion, the opposing side surfaces 208 comprises opposing, essentially planar, back side contact surfaces 270 *a,b*, and at least in the front portion, the opposing side surfaces 208 comprises opposing, essentially planar front side contact surfaces 280*a,b*.

The back side contact surfaces 270 *a,b* and the front side contact surfaces 280*a,b* are located in the same planes.

The opposing front side contact surfaces 280*a,b* extend substantially from the free end 205 of the nose portion.

The opposing back side contact surfaces 270*a,b* extend at least from the plane spanned by the X and Z axes, in a direction towards the connector end 205 of the nose portion along the Y axis, at least over a distance r, where r is the maximum radius of the through hole 209.

The opposing back side contact surfaces 270*a,b* extend at least from the plane spanned by the X and Z axes, in a direction towards the free end 205 of the nose portion along the Y axis, at least over a distance r, where r is the maximum radius of the through holes 209.

The pair of front side surfaces 280 and the pair of back side surfaces 270 form an angle with the YZ plane being less than 5 degrees, preferably less than 2 degrees. The back side contact surfaces 270*a,b* extend over a distance in the direction of the Z axis corresponding to at least 3 r, where r is the maximum radius of the through hole 209.

The free end 204 of the nose portion comprises an inner bottom wall being essentially parallel to the plane spanned by the X and Z axes.

The coupling between the tooth 1 and the adaptor 2 may advantageously be designed such that a smooth outer surface of the coupling is formed. This is illustrated for the first embodiments of the tooth and the adaptor in FIGS. 2*a*-2*c*.

At the attachment end of the tooth 1, the open end 104 of the cavity is delimited by the inner wall 102, and surrounded by an outer wall of the tooth, forming a tooth wall edge. The nose portion of the adaptor 2 extends from a coupling portion, with the coupling portion forming a rim surrounding the base of the nose portion. The shape of the rim corresponds to the tooth wall edge of the tooth, such that, when the tooth and the adaptor are assembled, the rim will face said tooth wall edge, and the outer wall of the tooth and of the coupling portion of the adaptor will form an assembled outer surface having generally having a smooth appearance.

The rim and the tooth wall edge may advantageously be designed so as to fit closely with each other, so as to hinder debris from entering between the nose portion and the inner wall of the cavity of the tooth.

A second embodiment of a tooth will now be described with reference to FIGS. 11-14. A corresponding second embodiment of an adaptor is exemplified in FIGS. 15 to 17. Numerous features of the embodiments of FIGS. 11 to 17 are similar to those described in connection with the embodiments of FIGS. 1 to 10. Such similar features have generally been provided with similar reference numbers.

In the following description of the embodiments of FIGS. 11 to 17, focus will be made on the features not previously described with reference to the embodiments of FIGS. 1 to 10.

In the second illustrated embodiment of a tooth, the cavity comprises, in at least one out of the first and second back divider regions, a pair of essentially planar secondary first/second back contact surfaces, extending from the divider side surfaces towards the YZ plane, the secondary first/second back contact surfaces being symmetrical about, and facing away from, the plane spanned by the Z and Y axes, so as to form an angle (eta, theta) with the plane spanned by the X and Y axes being less than 35 degrees.

In an initial state, when the tooth and the nose portion of the adaptor are interconnected, the back divider regions of the tooth and the nose portion are not to be in contact with each other. Accordingly, the height of the divider regions of the cavity of the tooth is slightly higher, and the width of the divider regions of the cavity of the tooth is slightly wider, than the corresponding divider regions of the nose portion. Instead, contact between the tooth and the nose portion is ensured via the front and back first/second contact surfaces.

However, during use, and under certain load conditions, the tooth and/or the adaptor nose may become subject to inner wear and/or deformation, affecting the contact surfaces. In this case, a wear situation may be created in which the secondary contact surfaces of the divider regions may come into contact with each other. Accordingly, the secondary contact surfaces may be effective to take over distribution of some of the loads of which the tooth and adaptor is affected.

In the embodiment of a tooth described in FIGS. 11 to 14, in both the first and second back divider regions 132,142, there is a pair of essentially planar secondary first/second back contact surfaces 136*a, b*; 146*a, b*, extending from the divider side surfaces towards the YZ plane. The secondary first back contact surfaces 136*a, b* are symmetrical about, and facing away from, the plane spanned by the Z and Y axes, so as to form an angle eta with the plane spanned by the X and Y axes being less than 35 degrees. The secondary second back contact surfaces 146*a, b* are symmetrical about, and facing away from, the plane spanned by the Z and Y axes, so as to form an angle theta with the plane spanned by the X and Y axes being less than 35 degrees.

The essentially planar secondary first and second back contact surfaces 136*a, b*; 146*a, b* are substantially parallel to the respective first and second back contact surfaces 130*a, b*; 140 *a, b*.

In the illustrated embodiment, the pairs of secondary contact surfaces 136*a,b*; 146 *a,b* extend along the Y axis substantially following the entire divider region, extending as it may through the back portion, sloped portion and/or the front portion.

The features relating to secondary contact surfaces apply similarly to the nose portion of the adaptor. With reference to the drawings, FIGS. 15 to 17, there is described an embodiment of an adaptor wherein a pair of essentially planar secondary first/second back contact surfaces 236*a, b*; 246*a, b*, extend from the divider side surfaces towards the YZ plane, the secondary first/second back contact surfaces 236*a, b*; 246*a, b* being symmetrical about, and facing away from, the plane spanned by the Z and Y axes, so as to form an angle eta, theta with the plane spanned by the X and Y axes being less than 35 degrees.

The essentially planar secondary first/second back contact surfaces 236*a, b*; 246*a, b* are substantially parallel to the respective first/second back contact surfaces 230*a, b*; 240 *a, b*.

Numerous alternative embodiments may be designed in accordance with the above. The size and shape of the various features described may be varied to suit different applications, and different requirements on the tooth and the adaptor.

The adaptor described herein is described as forming one unitary structure, to be attached directly to the bucket, and to which the tooth is directly coupled. Generally, it is preferred that the adaptor is indeed one unitary structure. However, other embodiments may be envisaged where the adaptor is a multi-piece structure, for example comprising a first piece interconnected to a second piece, where the first piece is to be attached to the bucket and the second piece is to be coupled to the tooth.

The tooth is preferably formed as one unitary structure.

Example embodiments described above may be combined as understood by a person skilled in the art. Although the invention has been described with reference to example embodiments, many different alterations, modifications and the like will become apparent for those skilled in the art.

Therefore, it is to be understood that the foregoing is illustrative of various example embodiments and that the invention is defined only the appended claims.

Although the above disclosure is made of an adaptor and a tooth of a kind being generally symmetrical, i.e. 0.80 D1<D2<=1, it is to be understood that the features and advantages described herein may also be obtained by an adaptor and a tooth of a kind being generally asymmetrical, i.e. where 0<=D2<=0.80 D1. Hence, the relationship between D1 and D2 may be varied to suit different intended applications of the coupling.

As used herein, the term "comprising" or "comprises" is open-ended, and includes one or more stated features, elements, steps, components or functions but does not preclude the presence or addition of one or more other features, elements, steps, components, functions or groups thereof.

The invention claimed is:

1. A tooth (1) for attachment to the lip of a bucket of a working machine via an adaptor;

the tooth having an exterior surface comprising two externally opposed outer working surfaces, namely a first working surface (12) and a second working surface (14), the working surfaces (12, 14) having a width (W) in a horizontal direction (H) that, when the tooth is attached to the lip of the bucket, extends in a direction parallel to said lip of the bucket, and having a length (L) extending between an attachment end and a tip (16) of said tooth, the working surfaces (12, 14) extending along said length (L) while converging in a vertical direction (V) to connect at said tip (16) of the tooth;

the tooth (1) further comprising:

a cavity (103) for receiving a portion of said adaptor, the cavity (103) extending between said first and second working surfaces (12, 14) from an open end (104), at said attachment end of the tooth, to a bottom end (105); the cavity (103) being delimited by an inner wall (102);

said inner wall (102) comprising:

first and second internally facing inner walls (106, 107), being internal surfaces associated with said first working surface and said second working surface (12,14), respectively; and opposing side walls (108), interconnecting said first and second inner walls (106, 107);

the opposing side walls (108) delimiting opposing through holes (109) for receiving a pin extending through the cavity (103) for attachment of the tooth (1) to the adaptor portion;

a first axis X extending through centres of the opposing through holes (109);

a second axis Y extending along the cavity (103) from the open end (104) of the cavity towards the bottom end (105) of the cavity; and a third axis Z being orthogonal to said first and second axes X, Y;

the three axes X, Y, Z thereby forming an orthogonal axes system, meeting at an origin, whereby each point of the inner wall (102) may be defined by Cartesian coordinates (x, y, z); and wherein:

the cavity defines:

a back portion (BP) extending along the Y axis, the back portion being at least partially located between an XZ plane spanned by the X and Z axes and the open end (104) of the cavity, a front portion (FP) extending along the Y axis, the front portion being located between the XZ plane and the bottom end (105) of the cavity; and a stepped portion (SP), interconnecting the back portion and the front portion;

in the back portion, the first and second inner walls (106, 107), each comprises a pair of essentially planar back contact surfaces (130*a,b*; 140*a,b*), each pair of back contact surfaces being symmetrical about, and facing away from, a YZ plane spanned by the Y and Z axes, so as to form an angle (beta, gamma) with an XY plane spanned by the X and Y axes being less than 35 degrees;

each pair of back contact surfaces (130*a,b*; 140*a,b*) being separated by a back divider region (132, 142), extending beyond the pair of back contact surfaces (130*a, b*) in the Z direction away from the XY plane;

in the front portion, the first and second inner wall (106, 107) each comprises a pair of essentially planar front contact surfaces (110*a,b*, 120*a,b*), being symmetrical about the YZ plane;

each of the front and back contact surfaces forming an angle (alfa) less than 5 degrees with the Y axis, as seen in any plane parallel to the YZ plane;

the front contact surfaces of the first inner wall and/or the front contact surfaces of the second inner wall (110*a,b*; 120*a,b*) being located closer to the XY plane than the corresponding back contact surfaces (130*a,b*, 140 *a,b*); and in the stepped portion, the first and/or second inner wall (106, 107) forming a slope (150*a,b* and 160*a,b*) wherein at least a portion of the inner wall approaches the XY plane towards the bottom wall (105), interconnecting said first and/or second back contact surfaces (130*a,b*, 140*a,b*) and the corresponding first and/or second front contact surface (110*a,b*; 120*a,b*);

wherein a first stepped distance, D1, along the Z axis is bridged by the first inner wall (106) along the stepped portion (SP), between the first back contact surfaces (130) and the first front contact surfaces (110); and wherein a second stepped distance, D2, along the Z axis is bridged by the second inner wall (107) along the stepped portion (SP), between the second back contact surfaces (140) and the second front contact surfaces (120); wherein 0.80 D1<D2<=D1.

2. The tooth in accordance with claim 1 wherein each one of the pair of the first and/or second back contact surfaces (130*a,b*; 140*a,b*) extends at least over a distance along the X axis of 0.2×WI, where WI is a distance between the first and second internally facing inner walls (106, 107) along the X axis.

3. The tooth in accordance with claim 1, wherein the first and/or second back divider region (132, 142) comprises a pair of divider side surfaces (134, 144), being symmetrical about, and facing towards, the ZY plane, wherein extension of the first and/or second back divider region (132, 142) in the Z direction away from the XY plane is determined by the extension of the corresponding pair of divider side surfaces (134, 144) in said direction.

4. The tooth in accordance with claim 3 wherein, through a majority of the back portion of the cavity, the extension of the first back divider region (132) in the Z direction away from the XY plane is substantially equal to the extension of the second back divider region (142) in the Z direction away from the XY plane.

5. The tooth in accordance with claim 3, wherein, for the first and/or second back divider region (132, 142), each one of the pair of divider side surfaces (134, 144) comprises a steeper region (134', 144') wherein a tangent to the side surface in the XZ plane forms an angle of more than 45 degrees with the X axis, followed by a flatter region (134", 144'") wherein a tangent to the side surface in the XZ plane forms an angle of less than 45 degrees with the X axis, wherein for the first and/or second back divider region, along a majority of the steeper region's (134', 144') length along the X axis, a tangent to the side surface in the XZ plane forms an angle of more than 45 degrees and less than 80 degrees with the X axis towards the Z axis.

6. The tooth in accordance with claim 1, wherein, in the back portion, the first and/or second inner wall (106, 107) displays a contour formed by points (x, z), the contour being symmetrical about the Z axis and having a width WI along the X axis, the contour being defined by the following: in peripheral portions at abs(x) greater than or equal to 0.9×WI/2, a first maximum abs(z) is defined in a pair of points (x1, z1), for abs(x) less than abs(x1): abs(z) is diminishing until a minimum abs (z) is defined at (x2, z2), and for abs(x) less than abs(x2): abs(z) is increasing until a maximum abs(z) is defined at (x3, z3), wherein abs(z3)>abs(z1)>abs(z2), and the pair of first and/or second back contact surfaces (130*a,b*; 140*a,b*) extends between the points (x1, z1) and (x2, z2), wherein abs(z3)−abs(z1)>0.03×WI and wherein abs(z3)−abs(z1)<0.6×WI.

7. The tooth in accordance with claim 1, wherein, in the front portion, the first and/or second inner wall (106, 107) comprises the pair of essentially planar first and/or second front contact surfaces (110*a,b*, 120*a, b*), being symmetrical about, and facing away from, the YZ plane, so as to form an angle (delta, epsilon) with the XY plane being less than 35 degrees.

8. A tooth in accordance with claim 7, wherein, in the front portion, there is at least an interconnected portion wherein at least one of the pairs of first or second front contact surfaces (110*a, b*; 120*a, b*) are connected by a first or second front connecting region (113, 123) where the first or second internally facing inner wall (106, 107) extends in the Z direction along or towards the XY plane, wherein said connected portion is located closer to the bottom end (105) of the cavity than said divided portion.

9. The tooth in accordance with claim 1, wherein, in the stepped portion, the first and/or second inner wall (106, 107) merges with the first and/or second back contact surfaces (130*a, b*, 140*a,b*), the first and/or second back divider region (132, 142), and with the first and/or second front contact surfaces (110*a, b*, 130 *a,b*), forming said slope(s) (150*a,b*, 160 *a,b*) at least between the first and/or second back contact surfaces (130*a,b*; 140 *a,b*) and the first and/or second front contact surfaces (110*a, b*, 120*a,b*).

10. The tooth in accordance with claim 1, wherein said first and/or second front and back contact surfaces (110*a,b*, 130*a,b*; 120*a,b*, 140*a,b*)), being connected by said slope (150*a,b*, 160*a,b*), are arranged such that, if they were interconnected by a straight line, such a line would form an angle of more than 10 degrees with the XY plane.

11. The tooth in accordance with claim 8, wherein first and/or second the back divider region (132, 142), and the corresponding intermediate divider region (152, 162), form a continuous divider region, the maximum extension of which in the Z direction away from the XY plane is diminishing from a maximum adjacent the open end (104) of the cavity along the Y axis towards the bottom end of the cavity (105).

12. The tooth in accordance with claim 1, wherein, at least in the back portion, the opposing side surfaces (108) comprises opposing, essentially planar, back side contact surfaces (170*a,b*) and, at least in the front portion, the opposing side surfaces (108) comprises opposing, essentially planar front side contact surfaces (180*a,b*), the back side contact surfaces (170*a,b*) and the front side contact surfaces (180*a, b*) being located in different planes, wherein the entire front side contact surfaces (180*a,b*) are located closer to the YZ than the entire back side contact surfaces (170*a,b*).

13. The tooth in accordance with claim 12, wherein the pair of front side surfaces and the pair of back side surfaces form an angle with the YZ plane being less than 5 degrees.

14. The tooth (1) in accordance with claim 6, wherein (x1, abs(z1)), (x2, abs(z2)), and (x3, abs(z3)) of the first inner wall (106) are equal to (x1, abs(z1)), (x2, abs(z2)), and (x3, abs(z3)) of the second inner wall (107).

15. An adaptor (2) for attachment of a tooth to the lip of a bucket of a working machine the adaptor (2) comprising a connector portion (22) configured to be attached to the bucket, and a nose portion (203) configured to be inserted in a corresponding cavity of a tooth (1);

the nose portion (203) having a width in a horizontal direction (H), that, when the tooth is attached to the lip of the bucket, extends in a direction parallel to said lip of the bucket, and having a length extending in a longitudinal direction (L) from a connector end (204) adjacent the connector portion (22) of the adaptor, to a free end (205), and having an outer wall (202);

the outer wall (202) comprising a first outer wall (206) and an externally opposed second outer wall (207); and externally opposing side walls (208), interconnecting said first and second outer walls (206, 207);

the nose portion (203) delimiting a through hole (209,) extending between said opposing side walls (208), for receiving a pin extending through the nose portion (203) for attachment of the tooth (1) to the adaptor (2);

a first axis X being defined extending through the centre of through hole (209);

a second axis Y extending along the nose portion (203) from the connector end (204) of the nose portion towards the free end (205) of the nose portion; and a third axis Z being orthogonal to said first and second axes X, Y;

the three axes X, Y, Z thereby forming an orthogonal axes system, meeting at an origo, whereby each point of the outer wall (202) may be defined by Cartesian coordinates (x, y, z);

wherein the nose portion (203) defines:

a back portion (BP) extending along the Y axis, the back portion being at least partially located between an XZ plane spanned by the X and Z axes and the connector end (204) of the nose portion;

a front portion (FP) extending along the Y axis, the front portion being located between the XZ plane and the free end (205) of the nose portion (203); and a stepped portion (SP), interconnecting the back portion (BP) and the front portion (FP);

in the back portion, the first and second outer walls (206, 207), each comprises a pair of essentially planar back contact surfaces (230*a, b*; 240*a,b*);

each pair of back contact surfaces being symmetrical about, and facing towards, a YZ plane spanned by the Y and Z axes, so as to form an angle (beta, gamma) with an XY plane spanned by the X and Y axes being less than 35 degrees;

each pair of back contact surfaces (230*a, b*; 240 *a,b*) being separated by a back divider region (232, 242), extending beyond the pair of first contact surfaces (230*a, b*) in the Z direction away from the XY plane;

in the front portion, the first and second outer wall (206, 207) each comprises a pair of essentially planar front contact surfaces (210*a,b*, 220*a,b*), being symmetrical about the YZ plane;

each of the front and back contact surfaces forming an angle (alfa) less than 5 degrees with the Y axis, as seen in any plane parallel to the YZ plane;

the front contact surfaces (210*a,b*; 220*a,b*) of the first and/or second outer wall being located closer to the XY plane than the corresponding back contact surfaces (230*a,b*, 240 *a,b*); and in the stepped portion, the first and/or second outer wall (206, 207) forming a slope (250*a,b*) wherein at least a portion of the outer wall approaches the XY plane towards the bottom wall (205), interconnecting the contact surfaces (230*a,b*, 240*a,b*) of the first and/or second outer walls and the corresponding first and/or second front contact surface (210*a,b*; 220*a,b*), wherein a first stepped distance D1 along the Z axis is bridged by the first outer wall (206) along the stepped portion (SP), between the first back contact surfaces and the first front contact surfaces; and wherein a second stepped distance D2 along the Z axis is bridged by the second outer wall (207) along the stepped portion (SP), between the second back contact surfaces and the second front contact surface; wherein 0.80 D1<D2<=D1.

16. The adaptor in accordance with claim 15, wherein each one out of the pair of the first and/or second back contact surfaces (230*a, b*; 240*a, b*) extends at least over a distance along the X axis of 0.2×WI, where WI is the extension of the first/second outer wall (206, 207) along the X axis.

17. The adaptor in accordance with claim 15, wherein the first and/or second back divider region (232, 242) comprises a pair of divider side surfaces (234, 244), being symmetrical about, and facing away from, the ZY plane, wherein the extension of the first and/or second back divider region (232, 242) in the Z direction away from the XY plane is determined by the extension of the corresponding pair of divider side surfaces (234, 244) in said direction.

18. The adaptor in accordance with claim 17, wherein, through a majority of the back portion of the nose portion, the extension of the first back divider region (232) in the Z direction away from the XY plane is substantially the same as the extension of the second back divider region (242) in the Z direction away from the XY plane.

19. The adaptor in accordance with claim 17, wherein, for the first and/or second back divider region, each one of the pair of divider side surfaces (234, 244) comprises a steeper region (234', 244') wherein a tangent to the side surface in the XZ plane forms an angle of more than 45 degrees with the X axis, followed by a flatter region (234', 244''') wherein a tangent to the side surface in the XZ plane forms an angle of less than 45 degrees with the X axis, wherein, for the first and/or second back divider region, along a majority of the steeper region's (234',234') length along the X axis, a tangent to the side surface in the XZ plane forms an angle of more than 45 degrees and less than 80 degrees with the X axis towards the Z.

20. The adaptor in accordance with claim 15, wherein, in the back portion, the first and/or second outer wall (206, 207) displays a contour formed by points (x, z), the contour being symmetrical about the Z axis and having a width WI along the X axis, the contour being defined by the following: in peripheral portions at abs(x) greater than or equal to 0.9×WI/2, a first maximum abs(z) is defined in a pair of points (x1, z1), for abs(x) less than abs(x1): abs(z) is diminishing until a minimum abs (z) is defined at a pair of points (x2, z2), and for abs(x) less than abs(x2): abs(z) is increasing until a maximum abs(z) is defined at a pair of points (x3, z3), wherein abs(z3)>abs(z1)>abs(z2), and the pair of first and/or second back contact surfaces (130*a,b*; 140*a,b*) extends between the points (x1, z1) and (x2, z2), wherein abs(z3)−abs(z1)>0.03×WI, wherein abs(z3)−abs(z1)<0.6×WI.

21. The adaptor in accordance with claim 15, wherein, in the front portion, the first and/or second outer wall (206,207) comprises the pair of essentially planar first and/or second front contact surfaces (210*a, b*, 220*a,b*), being symmetrical about, and facing towards, the YZ plane, so as to form an angle (delta, epsilon) with the XY plane being less than 35 degrees.

22. The adaptor in accordance with claim 15, wherein, in the front portion, there is at least an interconnected portion wherein at least one of the pairs of first or second front contact surfaces (210*a, b*; 220*a, b*) are connected by a first or second front connecting region (213, 223) where the first or second outer wall (206,207) extends in the Z direction along or towards the XY plane, wherein said connected portion is located closer to the free end (205) of the nose portion than said divided portion.

23. The adaptor in accordance with claim 15, wherein, in the stepped portion, the first and/or second outer wall (206, 207) merges with the first and/or second back contact surfaces (230*a, b*, 240*a,b*), the first and/or second back divider region (232,242), and with the first and/or second front contact surfaces (210*a, b*, 230*a,b*)), forming said slope(s) (250*a,b*, 260*a,b*) at least between the first and/or second back contact surfaces (230*a,b;* 240*a,b*) and the first and/or second front contact surfaces (210*a, b*, 220*a,b*).

24. The adaptor in accordance with claim 23, wherein the first and/or second back divider region (232, 142), and the corresponding intermediate divider region (252,262), form a continuous divider region, the maximum extension of which in the Z direction away from the XY plane is diminishing from a maximum adjacent the connector end (204) of the nose portion along the Y axis towards the free end of the nose portion (205).

25. The adaptor in accordance with claim 15, wherein, at least in the back portion, the opposing side surfaces (208) comprises opposing, essentially planar, back side contact surfaces (270*a,b*), and at least in the front portion, the opposing side surfaces (208) comprises opposing, essentially planar front side contact surfaces (280*a,b*), the back side contact surfaces (270*a,b*) and the front side contact surfaces (280*a,b*) being located in different planes, wherein the entire front side contact surfaces (280*a,b*) are located closer to the YZ plane than the entire back side contact surfaces (270*a,b*).

26. The adaptor in accordance with claim 24, wherein the pair of front side surfaces (280) and the pair of back side surfaces (270) form an angle with the YZ plane being less than 5 degrees.

* * * * *